US011519238B2

(12) United States Patent
Olivant et al.

(10) Patent No.: US 11,519,238 B2
(45) Date of Patent: Dec. 6, 2022

(54) APPARATUS AND METHOD FOR CONVEYING A TOOL INTO AND/OR FROM A WELL INSTALLATION

(71) Applicant: Baker Hughes Energy Technology UK Limited, Bristol (GB)

(72) Inventors: Christopher Olivant, Glasgow (GB); Robert Olsen, Stavanger (NO); Jarle Hvidsten, Nailsea (GB)

(73) Assignee: BAKER HUGHES ENERGY TECHNOLOGY UK LIMITED, Bristol (GB)

( * ) Notice: Subject to any disclaimer, the term of this patent is extended or adjusted under 35 U.S.C. 154(b) by 0 days.

(21) Appl. No.: 16/606,295

(22) PCT Filed: Apr. 10, 2018

(86) PCT No.: PCT/EP2018/059165
§ 371 (c)(1),
(2) Date: Oct. 18, 2019

(87) PCT Pub. No.: WO2018/192802
PCT Pub. Date: Oct. 25, 2018

(65) Prior Publication Data

US 2020/0123870 A1 Apr. 23, 2020

(30) Foreign Application Priority Data

Apr. 19, 2017 (GB) ..... 1706211

(51) Int. Cl.
*E21B 33/068* (2006.01)
*E21B 33/076* (2006.01)

(52) U.S. Cl.
CPC ..... *E21B 33/068* (2013.01); *E21B 33/076* (2013.01)

(58) Field of Classification Search
CPC ..... E21B 23/00; E21B 33/068; E21B 33/072; E21B 33/076; E21B 41/06
See application file for complete search history.

(56) References Cited

U.S. PATENT DOCUMENTS 2,555,145 A * 5/1951 McKinney ..... E21B 33/072 254/29 R
2004/0173347 A1 9/2004 Dallas
(Continued)

FOREIGN PATENT DOCUMENTS

WO WO2006061645 A1 6/2006
WO WO2015162241 A1 10/2015

OTHER PUBLICATIONS

International Search Report of the International Searching Authority for PCT/EP2018/059165 dated Aug. 1, 2018.

*Primary Examiner* — James G Sayre
(74) *Attorney, Agent, or Firm* — Baker Hughes Patent Org.

(57) ABSTRACT

An apparatus (10; 110; 310) for conveying a tool (12; 112; 312) into and/or from a well installation (W) comprises a conveying arrangement (16; 116; 316) configured for coupling to a housing (14; 114; 314) for receiving the tool to be conveyed (12; 112; 312). The conveying arrangement (16; 116; 316) includes an actuator arrangement (28; 128; 328) configurable between a retracted configuration and an extended configuration. The apparatus (10; 110; 310) is configured for location on a wellhead (WH) of the well installation (W), movement of the actuator arrangement (28; 128; 328) between the retracted configuration and the extended configuration moving the tool to be conveyed (12; 112; 312) into and/or from the housing (14; 114; 314) and thus into and/or from the well installation (W).

18 Claims, 45 Drawing Sheets

(56) References Cited

U.S. PATENT DOCUMENTS

| | | | | |
|---|---|---|---|---|
| 2008/0078557 | A1* | 4/2008 | Dallas | E21B 33/068<br>166/381 |
| 2017/0044861 | A1 | 2/2017 | Guedes et al. | |

* cited by examiner

APPARATUS AND METHOD FOR CONVEYING A TOOL INTO AND/OR FROM A WELL INSTALLATION

FIELD

This invention relates to an apparatus and method for conveying a tool into and/or from a well installation.

BACKGROUND

In the oil and gas exploration and production industry, wells are drilled to access subsurface hydrocarbon-bearing rock formations, the well boreholes typically then being lined ("cased") with sections of bore-lining tubing.

In the case of subsea well installations, the well borehole is typically drilled from an offshore platform or vessel which communicates with the wellhead located on the seabed via a riser. In order to support the bore-lining tubing and associated equipment in the well, a tubing hanger is run through the riser and lands in the wellhead. A valve assembly, known as a tree, is deployed and connected to the wellhead, the tree controlling access to/from the well via a system of valves, including amongst other things a production master valve (PMV) and a production swab valve (PSV).

In order to ensure that there is at least two safety barriers between the well and the environment, in addition to a primary downhole safety valve the tubing hanger may be configured to receive a plug, known as a tubing hanger plug, which provides a secondary barrier where required.

Tubing hanger plugs may be deployed and retrieved on a number of occasions during the operational lifetime of a given well. Conventionally, this may be performed by an intervention or workover operation, for example employing a completion workover riser (CWOR) system or a Light Well Intervention System (LWIS).

While effective, there are significant challenges associated with conventional equipment and techniques.

For example, conventional workover techniques require significant equipment, vessel and personnel mobilisation, resulting in significant costs to the operator. Moreover, the vessels required to perform such operations are highly specialised and have limited availability, restricting the capacity to perform operations.

SUMMARY

According to a first aspect, there is provided an apparatus suitable for location on a wellhead of a well installation and for conveying a tool into and/or from the well installation, the apparatus comprising:

a conveying arrangement configured for mounting on a housing for receiving the tool to be conveyed into and/or from the well installation, wherein the conveying arrangement is couplable to the tool to be conveyed, and wherein the conveying arrangement comprises an actuator arrangement configurable between a retracted configuration and an extended configuration to move the tool into and/from the housing and thereby convey the tool into and/or from the well installation.

In some embodiments, the apparatus may be arranged such that reconfiguration of the actuator arrangement from the retracted configuration to the extended configuration moves the tool to be conveyed towards the well installation. For example, the reconfiguration of the actuator arrangement from the retracted configuration to the extended configuration may move the conveying arrangement towards the well installation to either deploy the tool to be conveyed into the well installation or to engage the tool to be conveyed for retrieval from the well installation.

Alternatively, the apparatus may be arranged such that reconfiguration of the actuator arrangement from the retracted configuration to the extended configuration moves the tool away from the well installation. For example, the reconfiguration of the actuator arrangement from the retracted configuration to the extended configuration may move the tool away from the well installation to retrieve the tool from the well installation. In such embodiments, the reconfiguration of the actuator arrangement from the extended configuration to the retracted configuration may move the tool to be conveyed towards the well installation to either deploy the tool to be conveyed into the well installation or to engage the tool to be conveyed for retrieval from the well installation.

The apparatus may comprise the housing.

The housing may be configured to form a pressure containing body of the apparatus.

A packing seal arrangement may be disposed between the conveying arrangement and the housing. In use, the packing seal arrangement may ensure pressure competent sealing between the housing and the conveying arrangement.

The apparatus may be couplable—either directly or indirectly—to the wellhead of the well installation.

The housing may comprise, or may be configured for coupling to, a connector. The connector may connect the apparatus to the well installation, in particular but not exclusively the wellhead of the well installation.

The actuator arrangement may be reconfigurable between the extended configuration and a further extended configuration, that is the actuator arrangement may be reconfigurable from the extended configuration to the further extended configuration and vice-versa.

In some embodiments, the apparatus may be arranged such that reconfiguration of the actuator arrangement from the extended configuration to the further extended configuration moves the tool to be conveyed towards the well installation. For example, the reconfiguration of the actuator arrangement from the extended configuration to the further extended configuration may move the conveying arrangement towards the well installation to either deploy the tool to be conveyed into the well installation or to engage the tool to be conveyed for retrieval from the well installation.

Alternatively, the apparatus may be arranged such that reconfiguration of the actuator arrangement from the extended configuration to the further extended configuration moves the tool away from the well installation. For example, the reconfiguration of the actuator arrangement from the extended configuration to the further extended configuration may move the tool away from the well installation to retrieve the tool from the well installation. In such embodiments, the reconfiguration of the actuator arrangement from the further extended configuration to the extended configuration may move the tool to be conveyed towards the well installation to either deploy the tool to be conveyed into the well installation or to engage the tool to be conveyed for retrieval from the well installation.

The apparatus may be configurable to convey the tool to be conveyed a distance greater than the minimum height of the actuator arrangement.

The actuator arrangement may be configured to have a maximum height greater than double the minimum height of the actuator arrangement.

Beneficially, embodiments of the present invention, amongst other things, provide a compact apparatus which has reduced transport volume compared to conventional systems while retaining functionality.

In the case of a subsea well installation, an apparatus according to embodiments of the present invention may be transported on, deployed from and/or retrieved to a lower category vessel compared to those highly specialised vessels required by conventional systems, such as a Completion Workover Riser (CWOR) system or a Light Well Intervention System (LWIS). By way of example, a lower category vessel is generally smaller than a conventional subsea construction vessel, dedicated well intervention vessel and/or drilling rig and may be outfitted with less equipment, for example a subsea crane and a remotely operated vehicle (ROV), and/or less complex equipment than required by conventional systems. The capability to transport, deploy and/or retrieve the apparatus with a lower category vessel in turn results in reduced equipment and personnel requirements, resulting in a significant cost benefit to the operator. Moreover, the ability to perform operations via a lower category vessel means that there is more capacity to carry out operations when required or desired, since such lower category vessels have higher availability compared to the highly specialised vessels and personnel required with conventional systems.

As described above, the apparatus is configured to convey the tool to be conveyed into and/or from the well installation. For example, the apparatus may be configured to deploy the tool to be conveyed into the well installation. Alternatively or additionally, the apparatus may be configured to retrieve the tool to be conveyed from the well installation, for example to permit an intervention or workover operation to be carried out on the well installation and/or where the tool to be conveyed is to be repaired or replaced.

In particular embodiments, the tool to be conveyed may comprise a plug. More particularly, but not exclusively, the plug may comprise a tubing hanger plug for deployment into, and/or retrieval from, a tubing hanger disposed in the wellhead.

Embodiments of the present invention may beneficially permit location and/or recovery of the tubing hanger plug to/from the wellhead using a lower category vessel and with reduced personnel and equipment requirements compared to the highly specialised vessels required by conventional systems.

The actuator arrangement may comprise an actuator.

The actuator arrangement may comprise a single actuator.

The actuator arrangement may comprise a plurality of actuators.

In particular embodiments, the actuator arrangement may comprise one or more hydraulic actuator. Alternatively, or additionally, the actuator arrangement may comprise one or more pneumatic actuator, one or more electric actuator, one or more screw jack or the like.

The actuator may comprise a piston arrangement.

The actuator may comprise a cylinder.

The piston arrangement may be disposed in the cylinder.

The cylinder may form a housing for the piston arrangement.

The actuator may comprise a first member.

The first member may comprise a first piston member of the piston arrangement.

The actuator may comprise a second member.

The second member may comprise a second piston member of the piston arrangement.

The first member and the second member may be telescopically arranged.

The second member may be carried by the first member.

The first member may be wholly or partially disposed within the cylinder when the actuator arrangement defines the retracted configuration.

The first member may be slidably disposed in the cylinder.

The first member may be axially movable relative to the cylinder to reconfigure the actuator arrangement between the retracted configuration and the extended configuration.

The second member may be wholly or partially disposed within the first member.

The second member may be wholly or partially disposed within the first member when the actuator arrangement defines the retracted configuration.

The second member may be partially disposed within the first member when the actuator arrangement defines the extended configuration.

The second member may be slidably disposed in the first member.

The second member may be axially moveable relative to the first member.

The second member may be axially moveable relative to the first member to reconfigure the actuator arrangement between the extended configuration and the further extended configuration.

The actuator arrangement may be configured to move the second member between a retracted position relative to the first member and an extended position relative to the first member.

The conveying arrangement may be configured for coupling, either directly or indirectly, to the tool to be conveyed.

The conveying arrangement may comprise a coupling arrangement for coupling the conveying arrangement to the tool to be conveyed.

The coupling arrangement may comprise a connector for coupling the conveying arrangement, for example the actuator arrangement, to the tool to be conveyed.

The connector may be configured to connect the conveying arrangement to a selected tool or a variety of different tools.

In some embodiments, the coupling arrangement may comprise a yoke.

In some embodiments, the coupling arrangement may comprise a coupling member, such as a rod, a tie, a tube, a wire or other suitable arrangement.

The yoke may be coupled to the coupling member.

The apparatus may be configured to apply a force on the tool to be conveyed.

The apparatus may be configured to apply a force on the tool to be conveyed to activate and/or de-activate the tool to be conveyed.

In some embodiments, the force may be applied directly to the tool to be conveyed by the apparatus. Beneficially, embodiments of the apparatus may thus be configured—in addition to conveying the tool to be conveyed into and/or from the well installation—to perform the functions of setting and/or unsetting the tool to be conveyed. This may be achieved without the requirement to remove the apparatus from the wellhead to run in a separate setting tool or control infrastructure.

In other embodiments, the force may be applied to the tool to be conveyed indirectly, for example via a setting tool or an unsetting tool.

The force may comprise a mechanical force. For example, at least one of movement of the actuator arrangement to/from the extended configuration and movement of the actuator arrangement to/from the further extended configuration may apply a mechanical force on the tool to be conveyed or part of the tool to be conveyed.

The conveying arrangement may apply a push force on the tool or part of the tool.

The conveying arrangement may apply a pull force on the tool or part of the tool.

Alternatively or additionally, the apparatus may be configured to apply a pressure force to the tool to be conveyed.

In particular embodiments, the apparatus may comprise a communication arrangement.

The communication arrangement may be configured to communicate fluid power to the tool to be conveyed.

Beneficially, embodiments having a communication arrangement provide the ability to communicate pressure and/or fluid power to the tool to be conveyed to, for example, control tool functions without the requirement to remove the apparatus from the wellhead to run in separate control infrastructure.

The communication arrangement may be configured to apply the pressure force to the tool directly.

Alternatively, the communication arrangement may be configured to apply the pressure force to the tool to be conveyed indirectly, for example via a setting tool, a release tool and/or a retrieval tool.

The communication arrangement may be configured to communicate electrical power and/or an electrical signal to the tool to be conveyed.

The communication arrangement may be configured to communicate optical power and/or an optical signal to the tool to be conveyed.

The communication arrangement may comprise a control line arrangement.

The control line arrangement may comprise a first control line.

The first control line may comprise a first portion.

The first portion of the first control line may be disposed in the first member.

The first control line may comprise a second portion.

The second portion of the first control line may be disposed in the second member.

The first portion and second portion of the first control line may be telescopically arranged.

The control line arrangement may comprise a second control line.

The second control line may comprise a first portion.

The first portion of the second control line may be disposed in the first member.

The second control line may comprise a second portion.

The second portion of the second control line may be disposed in the second member.

The first portion and second portion of the second control line may be telescopically arranged.

Beneficially, the provision of telescopically arranged first and second portions permits continuous fluid communication to be maintained when the actuator arrangement defines the extended and/or further extended configurations.

As described above, the actuator arrangement may comprise a piston arrangement, the first member comprising a first piston member and the second member comprising a second piston member.

The first piston member may comprise a piston and a piston rod. The piston may define a first chamber and a second chamber in the housing.

In use, fluid in, or supplied to, the first chamber may urge the first piston member towards the extended position relative to the housing. Fluid in, or supplied to, the second chamber may urge the first piston member towards a retracted position relative to the housing.

The second piston member may comprise a piston and a piston rod.

The first piston member may comprise a channel for directing fluid in, or supplied to, the first chamber to the second piston member.

In use, fluid in, or supplied to, the first chamber may urge the second piston member towards the extended position relative to the first piston member.

A chamber may be defined between the second piston member and the first piston member.

Fluid in, or supplied to, the chamber may urge the second piston member towards a retracted position relative to the first piston member.

A first port may communicate with the first chamber.

The first port may provide fluid communication between the first chamber and a fluid supply.

A second port may communicate with second chamber.

The second port may provide fluid communication between the second chamber and a fluid supply.

A third port may communicate with the chamber defined between the first piston member and the second piston member.

The third port may communicate with the chamber via one or more gallery.

The gallery may be disposed in the first piston member.

The third port and the gallery may provide fluid communication between the chamber and a fluid supply when the actuator arrangement defines the extended configuration, that is, when the first piston member defines the extended position relative to the housing.

Beneficially, this provides a simple means of running control lines into the tool to be conveyed without compromising the integrity of the tool and/or the integrity of the apparatus. This reduced complexity would also improve the overall reliability of the apparatus.

The apparatus may be configured for operation by a remotely operated vehicle (ROV).

The apparatus may comprise a control panel.

The control panel may be configured to permit operation of the apparatus by the ROV.

The apparatus may be configured for control via one or more control valve. The one or more control valve may be disposed externally to the apparatus.

The apparatus may be configured for deployment to a subsea location.

The apparatus may be configured to be conveyed to the subsea location by a conveyance, such as a wire or the like.

The apparatus may comprise, may be coupled to, or otherwise operatively associated with, a fluid delivery arrangement.

The fluid delivery arrangement may comprise a fluid communication passage.

In particular embodiments, the fluid communication passage may be formed in, or disposed in, the housing of the apparatus.

The fluid communication passage may be in fluid communication with a production bore of the well installation, for example a production bore of a valve assembly.

The fluid communication passage may communicate with an annulus bore of the well installation.

The apparatus may comprise a plurality of communication passages in communication with a plurality of bore and/or cavities in the well installation. The fluid delivery arrangement may be configured to perform a fluid intervention operation on the well installation.

The fluid delivery arrangement may be configured to perform a fluid injection operation on the well installation.

Beneficially, the fluid injection operation may enhance recovery rates.

The fluid delivery operation may comprise injecting one or more chemical into the well installation. The chemical may remove deposits, e.g. fines, scale, wax or asphaltenes, from the well installation and/or associated tools and equipment.

The fluid delivery operation may comprise one or more chemical into the rock formation surrounding the well installation. This may comprise one or more of: fracturing the formation to create or enhance flow paths; injecting scale inhibiting chemicals that will gradually be released with the produced fluids and thus prevent scale forming in the flow paths; injecting acid to break or clean the rock; and/or injecting acids to dissolve fine particles accumulated in the flow paths.

The fluid delivery arrangement may be configured to retrieve a volume of fluid from the well installation. For example, the fluid delivery arrangement may be configured to perform a fluid sampling operation, and/or may permit fluid to flow back to surface for clean up or testing purposes.

The fluid delivery arrangement may, for example, be configured to perform a bullheading operation whereby fluid is pumped into the well installation to provide or assist in well control.

The fluid delivery arrangement may comprise a fluid intervention module.

The fluid delivery arrangement may comprise a fluid conduit arrangement.

In particular embodiments, the fluid conduit arrangement may comprise an umbilical.

The fluid conduit arrangement may comprise one or more hose, pipe, e.g. flexible pipe, or the like.

The fluid conduit arrangement, for example the umbilical, may be couplable to the fluid intervention module.

In use, the umbilical may supply fluid to the fluid intervention module.

In other embodiments, alternative means for conveying fluid to the fluid intervention module may be used. For example, fluid may be supplied via the ROV, or from a reservoir held on the apparatus.

Alternatively or additionally, the fluid delivery arrangement may be configured to communicate with a downhole tool, such as a formation isolation valve (FIV).

The fluid delivery arrangement may, for example, be configured to communicate a signal to the downhole tool.

Alternatively or additionally, the fluid delivery arrangement may be configured to communicate with the downhole tool to operate the downhole tool.

The signal may comprise a pressure pulse.

In particular embodiments, the signal comprises a plurality of pressure pulses.

The fluid delivery arrangement may comprise, may be coupled to, or operatively associated with, a pump.

The pump may be configured to inject fluid into the well installation.

The pump may be configured to generate the signal to be conveyed to the downhole tool.

The pump may be provided on the apparatus.

The pump may be provided on the fluid intervention module.

Alternatively, the pump may be provided at a remote location, for example on the ROV or on an intervention vessel.

The apparatus may comprise the tool to be conveyed.

The tool to be conveyed may comprise a downhole tool.

The tool to be conveyed may comprise a plug, such as a tubing hanger plug.

The apparatus may be configured to convey the tool to be conveyed into and/or from the well installation through the valve assembly.

The apparatus may comprise a setting tool.

The setting tool may be operatively associated with the tool to be conveyed.

The setting tool may be configured for coupling to the tool to be conveyed.

In use, the apparatus may convey the tool and the setting tool into the well installation simultaneously.

Alternatively, the apparatus may convey the tool and the setting tool into the well installation sequentially.

The apparatus may comprise a release tool.

The release tool may be operatively associated with the tool to be conveyed.

The release tool may be couplable to the tool to be conveyed.

The apparatus may be configured to convey the release tool into the well installation.

The apparatus may be configured to convey the release tool from the well installation.

The apparatus may comprise a retrieval tool.

The retrieval tool may be operatively associated with the tool to be conveyed.

The retrieval tool may be couplable to the tool to be conveyed.

The apparatus may be configured to convey the retrieval tool into the well installation.

The apparatus may be configured to convey the retrieval tool and the tool to be conveyed from the well installation.

The setting tool, the release tool and/or the retrieval tool may comprise separate tools.

In other embodiments, setting, release and/or retrieval of the tool to be conveyed may be achieved with a single tool.

The apparatus may be couplable to, provided in combination with, or form part of, a tool assembly.

According to a second aspect, there is provided a tool assembly comprising the apparatus of the first aspect; and a subsea valve assembly.

Beneficially, embodiments of the present invention facilitate conveyance of the subsea valve assembly using the apparatus.

The tool assembly may comprise a plug tool assembly.

The tool assembly may comprise the tool to be conveyed.

The tool to be conveyed may comprise a plug, such as a tubing hanger plug.

The valve assembly may comprise a subsea tree.

The valve assembly may comprise a Christmas tree, for example a Vertical Christmas tree or a Horizontal Christmas tree.

The apparatus—in particular but not exclusively the housing of the apparatus—may be configured to couple to the valve assembly.

The apparatus may be configured to convey the tool to be conveyed into and/or from the well installation through the valve assembly.

The tool assembly may comprise a setting tool.

The setting tool may be operatively associated with the tool to be conveyed.

The setting tool may be configured for coupling to the tool to be conveyed.

In use, the apparatus may convey the tool and the setting tool into the well installation simultaneously.

Alternatively, the apparatus may convey the tool and the setting tool into the well installation sequentially.

The tool assembly may comprise a release tool.

The release tool may be operatively associated with the tool to be conveyed.

The release tool may be couplable to the tool to be conveyed.

The apparatus may be configured to convey the release tool into the well installation.

The apparatus may be configured to convey the release tool from the well installation.

The tool assembly may comprise a retrieval tool.

The retrieval tool may be operatively associated with the tool to be conveyed.

The retrieval tool may be couplable to the tool to be conveyed.

The apparatus may be configured to convey the retrieval tool into the well installation.

The apparatus may be configured to convey the retrieval tool and the tool to be conveyed from the well installation.

The setting tool, the release tool and/or the retrieval tool may comprise separate tools.

In other embodiments, setting, release and/or retrieval of the tool to be conveyed may be achieved with a single tool.

The tool assembly may comprise a fluid delivery arrangement.

According to a third aspect, there is provided a subsea system comprising the apparatus of the first aspect or the tool assembly of the second aspect.

Other aspects of the invention relate to use of the apparatus, tool assembly or subsea system of the first, second or third aspects to convey a tool to be conveyed to/from a well installation.

According to a fourth aspect, there is provided a method of conveying a tool into and/or from a well installation using the apparatus of the first aspect or the tool assembly of the second aspect.

The method may comprise at least one of:

conveying the tool into the well installation by reconfiguring the actuator arrangement from the retracted configuration to the extended configuration; and reconfiguring the actuator arrangement of the apparatus from the extended configuration to the retracted configuration.

Alternatively, the method may comprise at least one of:

conveying the tool into the well installation by reconfiguring the actuator arrangement of the apparatus from the extended configuration to the retracted configuration; and conveying the tool from the well installation by reconfiguring the actuator arrangement of the apparatus to from the retracted configuration to the extended configuration.

Embodiments of the invention may relate to a method for running and/or retrieving a plug, such as tubing hanger plug, to/from a wellhead, in particular but not exclusively a subsea wellhead.

The method may comprise coupling the apparatus to a valve assembly, such as subsea tree.

The apparatus may be coupled to the valve assembly at surface.

The method may comprise locking the apparatus to the valve assembly.

The method may comprise pressure testing the integrity of the coupling between the apparatus and the valve assembly.

The method may comprise deploying and/or retrieving the valve assembly to the subsea location together with the apparatus. Beneficially, the ability to install and/or retrieve the valve assembly with the apparatus simplifies and speeds up operations. In use, the apparatus and the valve assembly may be coupled at surface or other remote location and deployed to the subsea location together. Once the valve assembly has been landed and locked, and any necessary safety checks carried out, the apparatus may then be operated to convey a downhole tool, such as a tubing hanger plug, from the well installation, to facilitate access into the well installation.

Alternatively or additionally, the apparatus may be utilised to convey a downhole tool, such as a tubing hanger plug, into the well installation, to permit the valve assembly to be retrieved. Beneficially, the apparatus permits deployment and retrieval operations to be carried out in a single run.

Alternatively, the apparatus may be coupled to the valve assembly at a subsea location. In use, the apparatus may be deployed to a subsea location and coupled to the valve assembly.

The method may comprise coupling the apparatus to the well installation.

In particular embodiments, the apparatus may be coupled to the well installation via the valve assembly.

The method may comprise opening a valve of the valve assembly.

The method may comprise opening a plurality of valves of the valve assembly.

The valve may comprise a well isolation valve.

The valve may comprise a production swab valve (PSV).

The valve may comprise a production master valve (PMV).

A remotely operated vehicle (ROV) may be provided.

The method may comprise operating the apparatus using the ROV.

The method may comprise operating the ROV to open the valve or valves of the valve assembly.

In use, on opening the valve or valves of the valve assembly, the apparatus may provide the secondary isolation barrier of the well installation.

The method may comprise deploying the tool to be conveyed into the well installation.

The method may comprise applying a force to the tool to be conveyed or part of the tool to be conveyed.

The force may comprise a mechanical force. For example, at least one of movement of the apparatus to/from the extended configuration and movement of the apparatus to/from the further extended configuration may apply a mechanical force on the tool or part of the tool.

The method may comprise applying a push force on the tool or part of the tool with the conveying arrangement.

The method may comprise applying a pull force on the tool or part of the tool with the conveying arrangement.

Alternatively or additionally, the method may comprise applying a pressure force on the tool or part of the tool using the apparatus.

The method may comprise activating and/or deactivating the tool to be conveyed using the force applied by the apparatus.

In embodiments where the tool to be conveyed is fluid actuated, the tool to be conveyed may be actuated by fluid directed from surface via the apparatus, in particular by control lines of the apparatus.

In use, the apparatus may actuate the tool to be conveyed to lock the tool to be conveyed in the wellhead. For example, where the tool to be conveyed comprises a tubing hanger plug, the apparatus may actuate the tubing hanger plug to lock the tubing hanger plug to a tubing hanger.

The method may comprise performing a fluid delivery operation in and/or on a well installation using the apparatus.

The fluid delivery operation may comprise a fluid injection operation. In particular, but not exclusively, the operation may comprise a bullheading operation whereby fluid is pumped into the well to provide or assist in well control.

The method may comprise connecting a fluid conduit arrangement, for example an umbilical, to the fluid intervention module.

The method may comprise operating the ROV to connect the fluid conduit arrangement, for example umbilical, to the fluid intervention module.

The method may comprise injecting fluid into the well installation.

Alternatively or additionally, the fluid delivery operation may comprise communicating with a downhole tool, such as a formation isolation valve for example.

Alternatively or additionally, the method may comprise an operation for increased production fluid, for example oil, recovery.

The method may comprise generating one or more pressure pulse.

The method may comprise disengaging the apparatus from the tool to be conveyed.

The method may comprise retracting the piston arrangement.

The method may comprise closing the valve or valves of the valve assembly.

The ROV may be operable to close the valve or valves of the valve assembly.

The method may comprise recovering the apparatus to surface.

According to a fifth aspect, there is provided a method for deploying and/or retrieving a subsea valve assembly using the apparatus of the first aspect or the tool assembly of the second aspect.

The method may comprise installing the valve assembly, such as a subsea Christmas tree.

The method may comprise coupling the apparatus to the valve assembly.

In particular embodiments, the method may comprise coupling the apparatus to the valve assembly at surface or other remote location and deploying the apparatus and the valve assembly to a subsea location, for example a subsea wellhead, together.

The method may comprise landing the valve assembly on the well installation, for example on a subsea wellhead of the well installation.

The method may comprise locking the valve assembly to the well installation.

The method may comprise testing the integrity of the connection between the valve assembly and the well installation.

The method may comprise opening one or more valve of the valve assembly.

The method may comprise operating the apparatus to convey a downhole tool, such as a tubing hanger plug, from the well installation.

The method may comprise closing one or more valve of the valve assembly.

The method may comprise testing the integrity of the one or more valve of the valve assembly.

The method may comprise retrieving the apparatus.

The method may comprise retrieving the valve assembly, for example for repair or replacement.

The method may comprise deploying the apparatus subsea.

The method may comprise landing the apparatus on the valve assembly.

The method may comprise coupling the apparatus to the valve assembly.

The method may comprise testing the integrity of the connection between the apparatus and the valve assembly.

The method may comprise opening one or more valve of the valve assembly.

The method may comprise operating the apparatus to convey a downhole tool, such as a tubing hanger plug, into the well installation.

The method may comprise testing the downhole tool.

The method may comprise retrieving the apparatus and the coupled valve assembly together.

It should be understood that the features defined above or described below may be utilised, either alone or in combination with any other defined or described feature.

BRIEF DESCRIPTION OF THE DRAWINGS

These and other aspects will now be described, by way of example only, with reference to the accompanying drawings, in which.

DETAILED DESCRIPTION OF THE DRAWINGS

Figure 1:
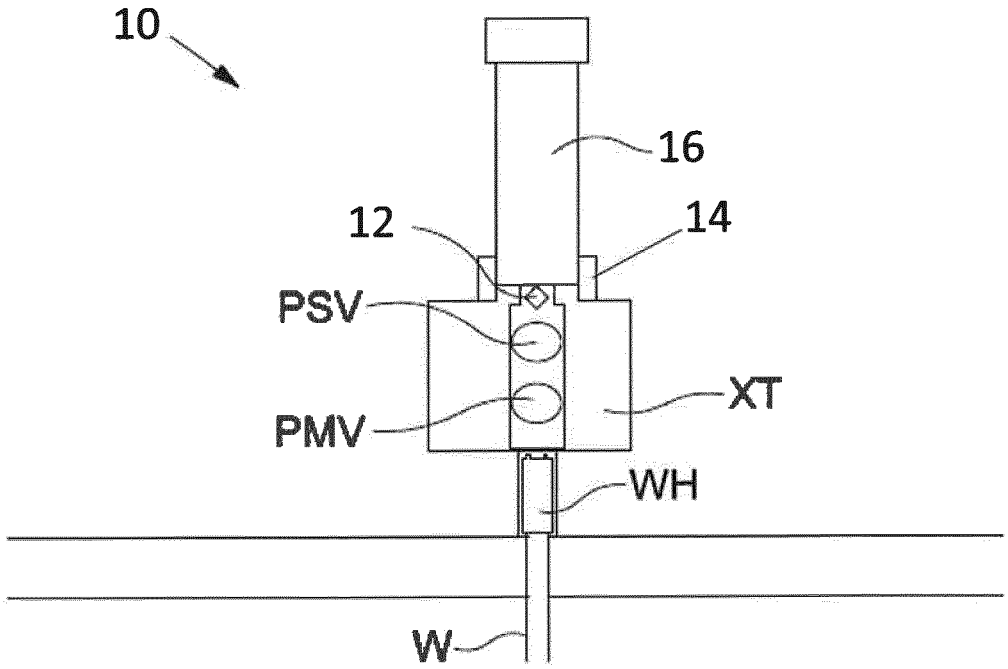
FIG. 1 shows a diagrammatic view of an apparatus for conveying a tool into and/or from a well installation, according to a first embodiment of the present invention.

Referring first to FIG. 1 of the accompanying drawings, there is shown an apparatus 10 for conveying a tool 12 into and/or from a well installation W, according to a first embodiment.

In the illustrated embodiment, the well installation W takes the form of a subsea well, the apparatus 10 configured for coupling to a subsea valve assembly in the form of Christmas tree XT disposed on a wellhead WH of the well installation W.

In use, the apparatus 10 is operable to convey the tool 12—in the illustrated embodiment a tubing hanger plug—into and/or from the wellhead WH through the production safety valve PSV and production master valve PMV of the Christmas tree XT. However, it will be understood that the apparatus 10 may be configured to convey any suitable tool 12 into and/or from the well installation W.

As will be described in more detail below, in some applications the apparatus 10 is configured for coupling to the Christmas tree XT at a subsea location and operable to convey the tool 12 into and/or from the well installation W via the Christmas tree XT. In other applications, the apparatus 10 may form part of a tool assembly 1000 comprising the apparatus 10 and the Christmas tree XT, the apparatus 10 thus also facilitating the conveying, e.g. deployment and/or retrieval, of the Christmas tree XT; beneficially obviating the requirement to convey the Christmas tree XT in a separate operation.

Figure 2:
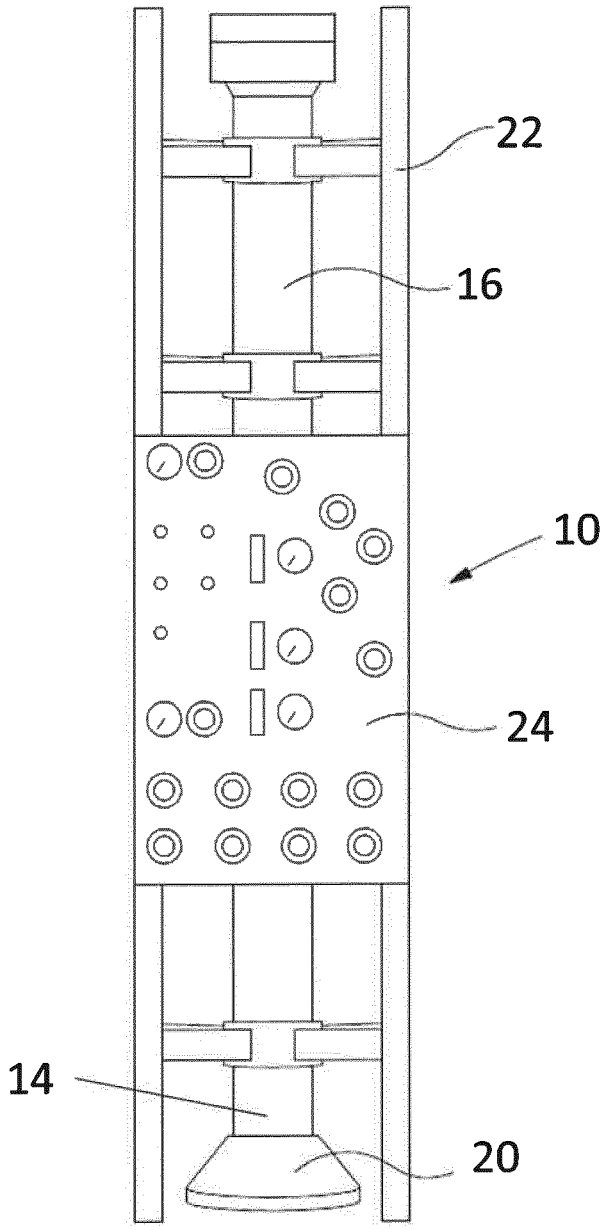
FIGS. 2 to 4 show an embodiment of the apparatus shown in FIG. 1.
Figure 3:
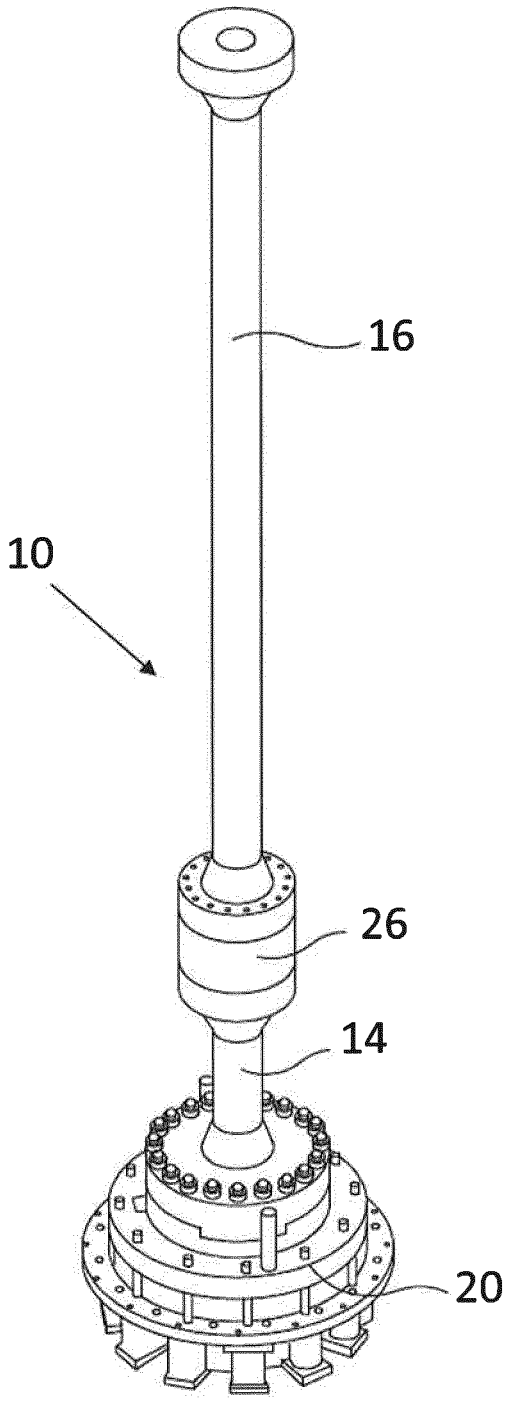
Figure 4:
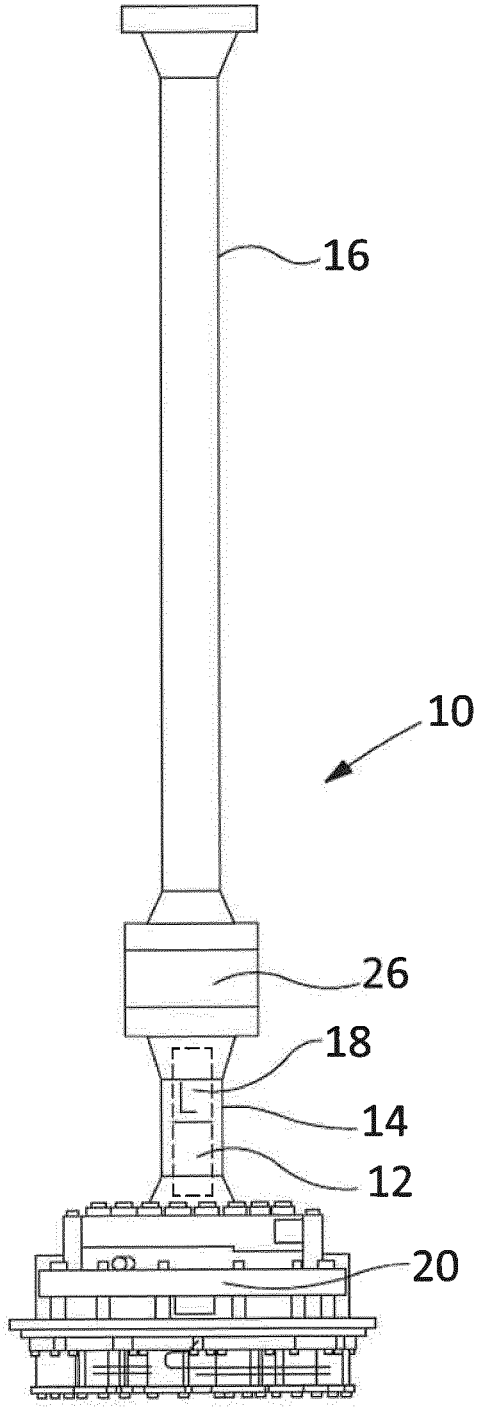

FIGS. 2 to 4 of the accompanying drawings show the apparatus 10 of FIG. 1 in more detail.

As shown, the apparatus 10 comprises a housing 14 for coupling the apparatus 10 to the well installation W and a conveying arrangement 16 for conveying the tool 12 into and/or from the well installation W. The housing 14 and the conveying arrangement 16 are configured to be coupled together.

The housing 14 is configured to house the tool 12 to be conveyed and associated tooling 18, such as a setting tool, a release tool and/or a retrieval tool, and carries a connector 20 for coupling the apparatus 10 to the Christmas tree XT.

As shown in FIG. 2, the apparatus 10 further comprises a lifting frame 22 which facilitates handling of the apparatus 10 (and the Christmas tree XT where required) and a control panel 24 which facilitates control of the apparatus 10 by remotely operated vehicle ROV (the lifting frame 22 and the control panel 24 are not shown in FIGS. 3 and 4 for ease of reference).

The housing 14 is configured to form a pressure containing body of the apparatus 10 when connected to the Christmas tree XT. A packing seal arrangement 26 is disposed between the conveying arrangement 16 and the housing 14. The packing seal arrangement 26 ensures pressure competent sealing between the housing 14 and the conveying arrangement 16.

Figure 5:
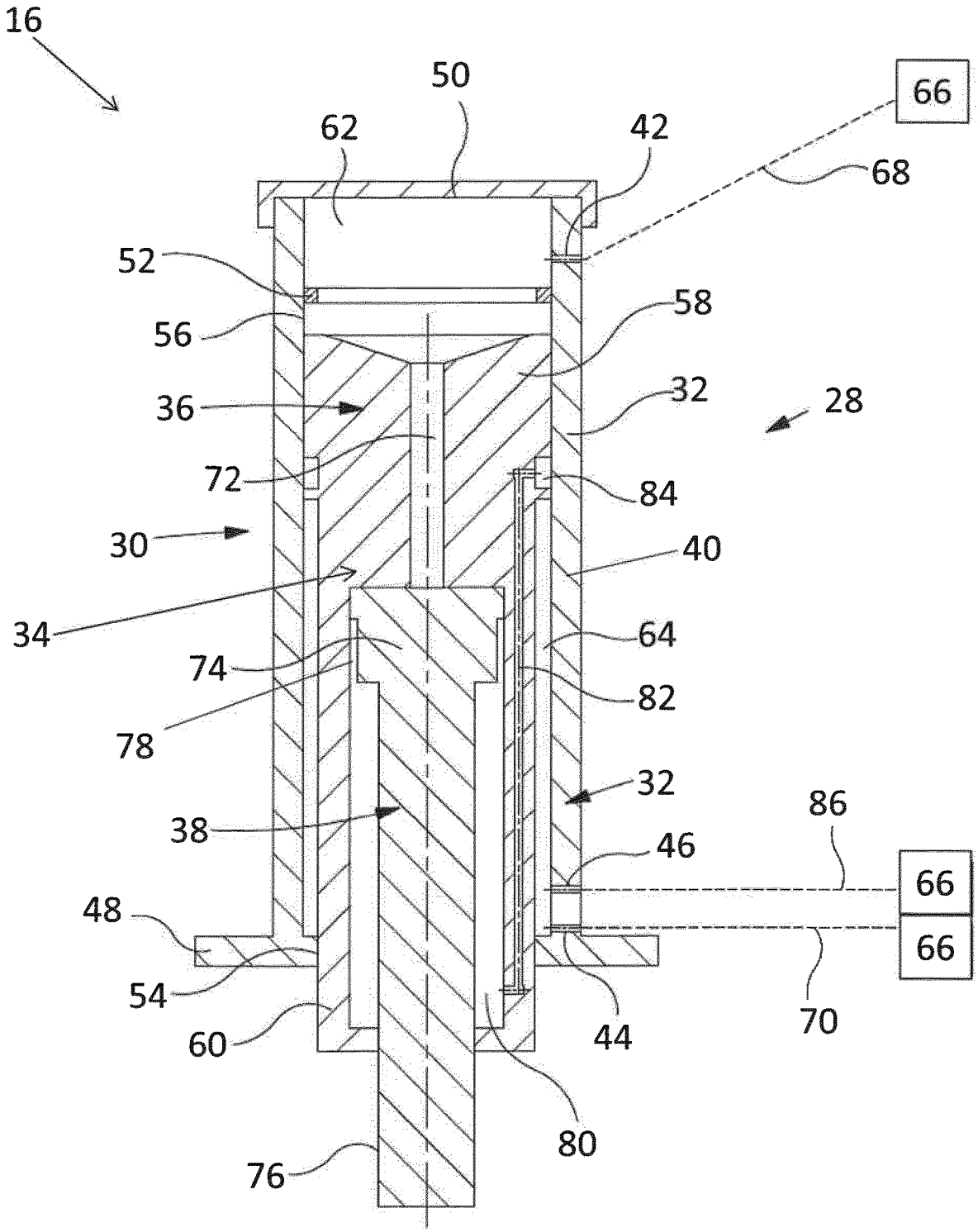
FIG. 5 shows a longitudinal section view of the conveying arrangement of the apparatus shown in FIGS. 1 to 4, in a first configuration.
Figure 6:
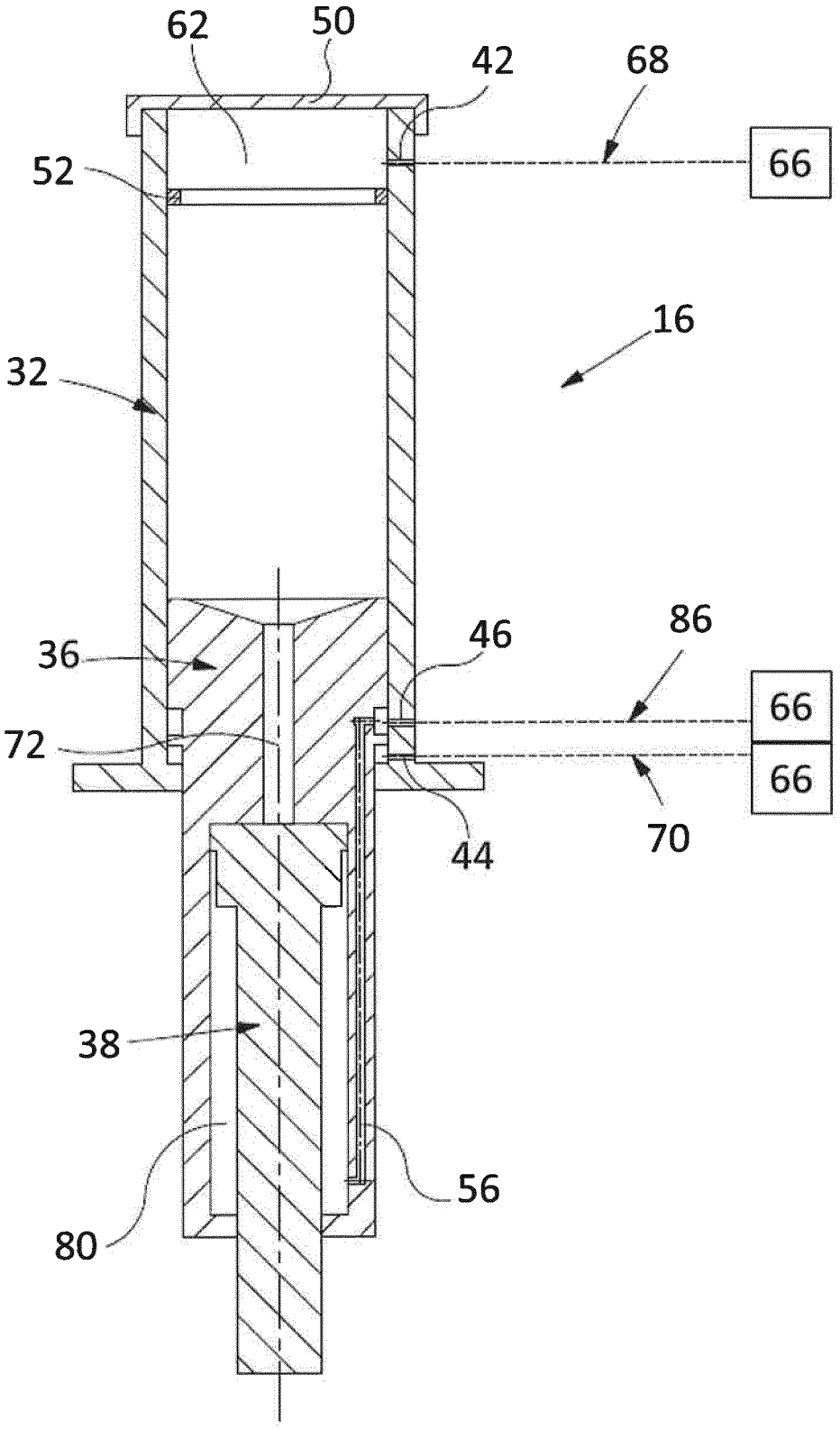
FIG. 6 shows a longitudinal section view of the conveying arrangement shown in FIG. 5, in a second configuration.
Figure 7:
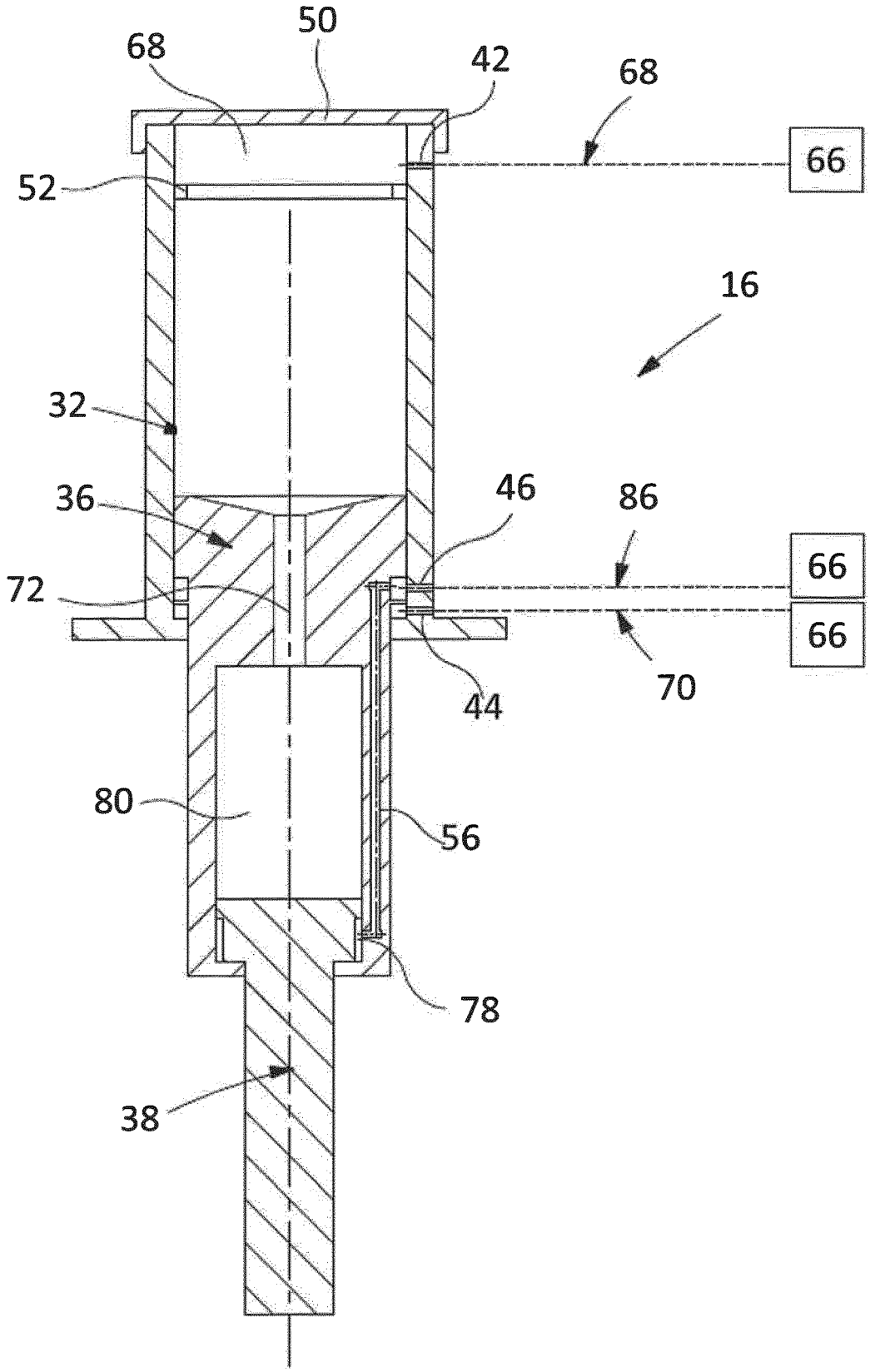
FIG. 7 shows a longitudinal section view of the conveying arrangement shown in FIG. 5, in a third configuration.

FIGS. 5, 6 and 7 of the accompanying drawings show the conveying arrangement 16 of the apparatus 10 in more detail.

As shown in FIGS. 5 to 7, the conveying arrangement 16 comprises an actuator arrangement—represented generally by 28—having a single actuator 30 in the form of hydraulic linear actuator. While in the illustrated embodiment, the actuator 30 takes the form of a hydraulic linear actuator, the actuator 30 may comprise a pneumatic actuator, an electric actuator, or the like.

As will be described further below, the actuator arrangement 28 is configurable between a retracted configuration, an extended configuration and a further extended configuration. FIG. 5 shows the conveying arrangement 16 in a first configuration, with the actuator arrangement 28 in the retracted configuration. FIG. 6 shows the conveying arrangement 16 in a second configuration, with the actuator arrangement 28 in an extended configuration. FIG. 7 shows the conveying arrangement 16 in a third configuration, with the actuator arrangement 28 in the further extended configuration.

As shown, the actuator 30 has a cylinder 32 and a piston arrangement 34. In the illustrated embodiment, the piston arrangement 34 takes the form of a telescopic piston arrangement having a first piston member 36 and a second piston member 38.

In use, the piston arrangement 34 is moveable relative to the cylinder 32 between a retracted position relative to the cylinder 32 (as shown in FIG. 4) and an extended position relative to the cylinder 32 (as shown in FIG. 5), the actuator arrangement 28 defining the extended configuration when the piston arrangement 34 is positioned in the extended position relative to the cylinder 32. The piston arrangement 34 is itself extendable from a retracted configuration (as shown in FIGS. 4 and 5) to an extended configuration (as shown in FIG. 6), the actuator arrangement 28 defining the further extended configuration (as shown in FIG. 7) when the piston arrangement 34 is extended.

As shown, the cylinder 32 comprises a generally cylindrical body 40 having a number of ports 42, 44, 46. A flange portion 48 is provided at a first end of the body 40 (the lower end as shown in the figures) and, in use, the flange portion 48 couples the conveying arrangement 16 to the housing 14. In the illustrated embodiment, the flange portion 48 is integrally formed with the body 40. However, it will be recognised that the flange portion 48 may alternatively comprise a separate component coupled to the body 40. A cap 50 is disposed at a second end of the body 40 (the upper end as shown in the figures), the cap 50 forming a closure of the body 40.

The piston arrangement 34 is slidably disposed in the body 40 between the retracted configuration and the extended configuration, and stops 52, 54 are provided for limiting movement of the first piston member 36. Stop 52 limits retraction of the first piston member 36 and is disposed within the body 40 between the cap 50 and the piston arrangement 34. In the illustrated embodiment, stop 52 takes the form of an annular ring coupled to an inner surface 56 of the body 40. However, it will be recognised that the stop 52 may alternatively be integrally formed with the body 40. Stop 54 limits extension of the first piston member 36. Stop 54 is integrally formed with the body 40. However, it will be recognised that the stop 54 may alternatively comprise a separate component coupled to the body 40.

First piston member 36 is slidably disposed in the cylinder 32 and comprises a piston 58 and a piston rod 60. The first piston member 36 divides the interior of the cylinder 32 into a first chamber 62 and a second chamber 64. In use, the first piston member 36 isolates the first chamber 62 from the second chamber 64.

The first chamber 62 communicates with a fluid supply 66 via port 42 and a conduit 68, in the illustrated embodiment the fluid supply 66 taking the form a hydraulic fluid supply and the conduit 68 taking the form of a hydraulic line.

The second chamber 64 communicates with the fluid supply 66 (or a separate fluid supply) via port 44 and a conduit 70, in the illustrated embodiment the conduit 70 taking the form of a hydraulic line.

A passage 72 is disposed in the first piston member 36, the passage 72 providing fluid communication between the first chamber 62 and the second piston member 38 such that fluid directed to the first chamber 62 also acts on the second piston member 38.

In use, fluid directed to first chamber 62 via port 42 urges the piston arrangement 34 towards an extended position relative to the cylinder 32. As the second piston member 38 is carried by the first piston member 36, fluid directed to the first chamber 62 urges both the first piston member 36 and the second piston member 38 towards the extended position (to the position as shown in FIG. 5).

The second piston member 38 is slidably disposed in the first piston member 36 and comprises a piston 74 and a piston rod 76. The piston 74 of the second piston member 38 has a stepped profile, having a recess 78.

As described above, the passage 72 provides fluid communication between the first chamber 62 and the second piston member 38 such that fluid directed to the first chamber 62 also acts on the second piston member 38. As the area of the first piston member 36 exposed to a fluid pressure in first chamber 62 is larger than the area of the second piston member exposed to the fluid pressure, the resulting pressure force (equal to pressure multiplied by area) acting on the first piston member 36 is greater than the pressure force (equal to pressure multiplied by area) acting on the second piston member 38. Thus, the first and second piston members 36, 38 will move together towards the extended position until the first piston member 36 engages stop 52. While further movement of the first piston member 16 is prevented by the stop 52, the force acting on the second piston member 38 will urge the second piston member 38 to the extended position relative to the first piston member 36, and thus the conveying arrangement 16 to the further extended configuration.

A third chamber 80 is provided between the first piston member 36 and the second piston member 38. A gallery 82 provided in the first piston member 36 provides fluid communication between a cavity 84 in the first piston member 36 and the third chamber 80. As shown, the third chamber 80 is initially isolated, since the cavity 84 is not aligned with the port 46. However, when the actuator arrangement 28 is moved to the extended configuration, and in the further extended configuration, the cavity 84 is aligned with the port 46, such that the third chamber 80 communicates with the fluid supply 66 (or a separate fluid supply) via the gallery 82, port 46 and a conduit 86, in the illustrated embodiment the conduit 86 taking the form of a hydraulic line.

In use, fluid directed to third chamber 80 urges the second piston member 38 towards the retracted position relative to the first piston member 36.

It should be understood that the embodiments described herein are merely examples and that various modifications may be made thereto without departing from the scope of the invention.

For example, FIGS. 8 to 14 of the accompanying drawings show an apparatus 110 for conveying a tool 112 into and/or from a well installation W, according to a second embodiment.

As in the apparatus 10, the apparatus 110 is configured for coupling to a subsea valve assembly in the form of Christmas tree XT disposed on a wellhead WH of a well installation W.

In use, the apparatus 110 is operable to convey the tool 112—in the illustrated embodiment a tubing hanger plug—into and/or from the wellhead WH through the Christmas tree XT. However, it will be understood that the apparatus 110 may be configured to convey any suitable tool 112 into and/or from the well installation W.

As will be described in more detail below, in some applications the apparatus 110 is configured for coupling to the Christmas tree XT at a subsea location and operable to convey the tool 112 into and/or from the well installation W via the Christmas tree XT. In other applications, the apparatus 110 may form part of a tool assembly 1000 comprising the apparatus 110 and the Christmas tree XT, the apparatus 110 thus also facilitating the conveying, e.g. deployment and/or retrieval, of the Christmas tree XT; beneficially obviating the requirement to convey the Christmas tree XT in a separate operation.

Figure 8:
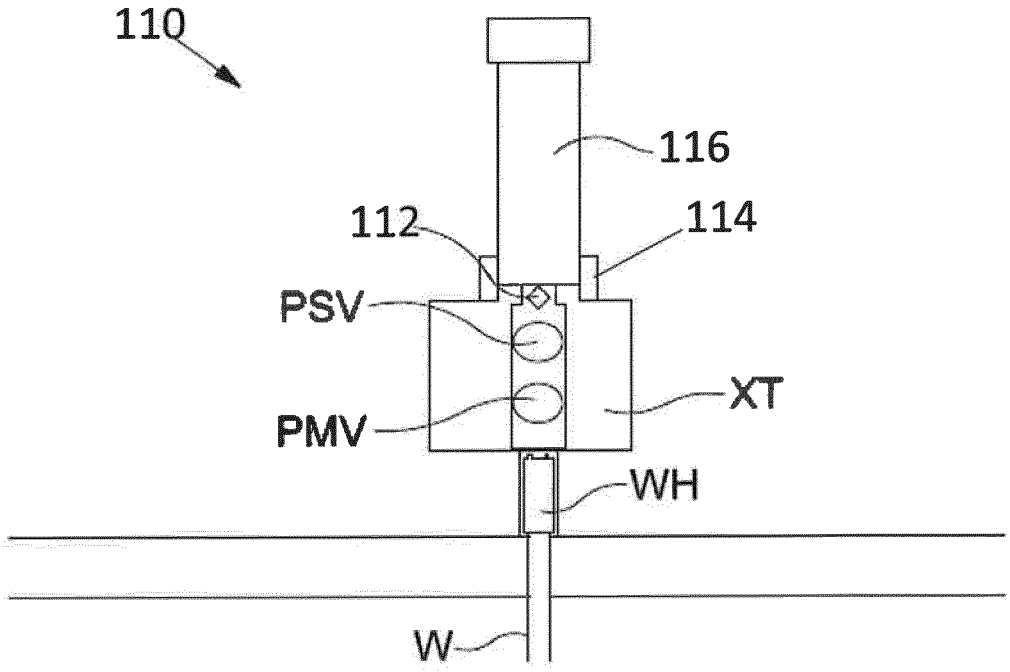
FIG. 8 shows a diagrammatic view of an apparatus for conveying a tool into and/or from a well installation, according to a second embodiment of the present invention.
Figure 9:
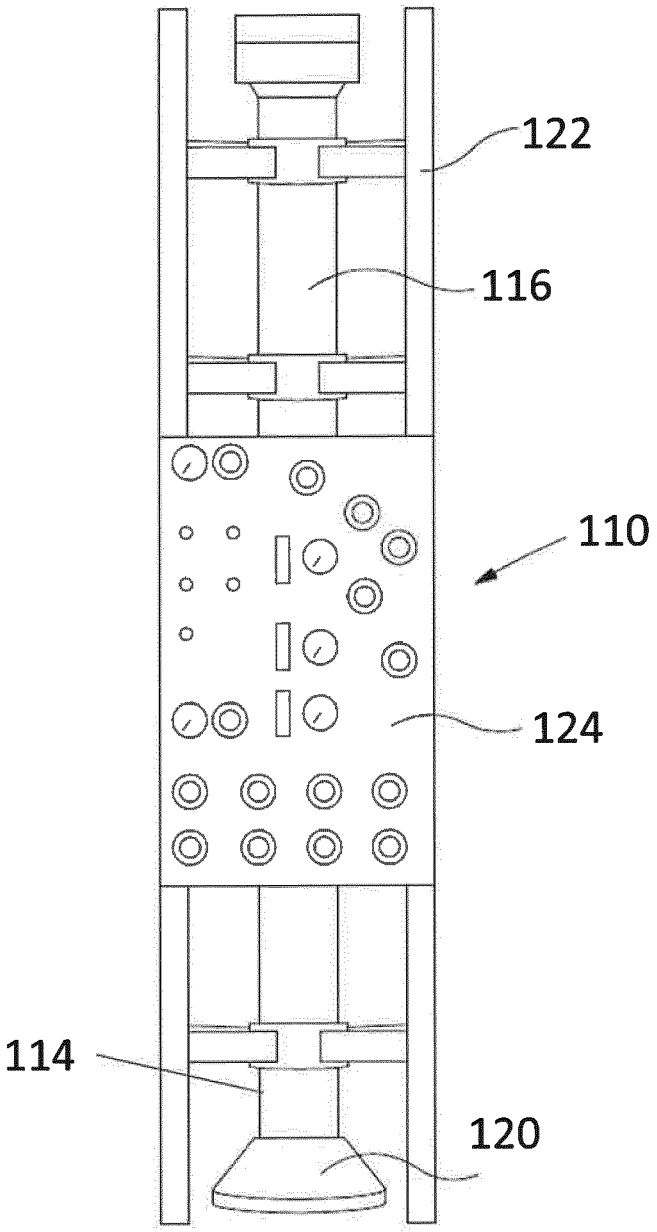
FIGS. 9 to 11 an embodiment of the apparatus shown in FIG. 8.
Figure 10:
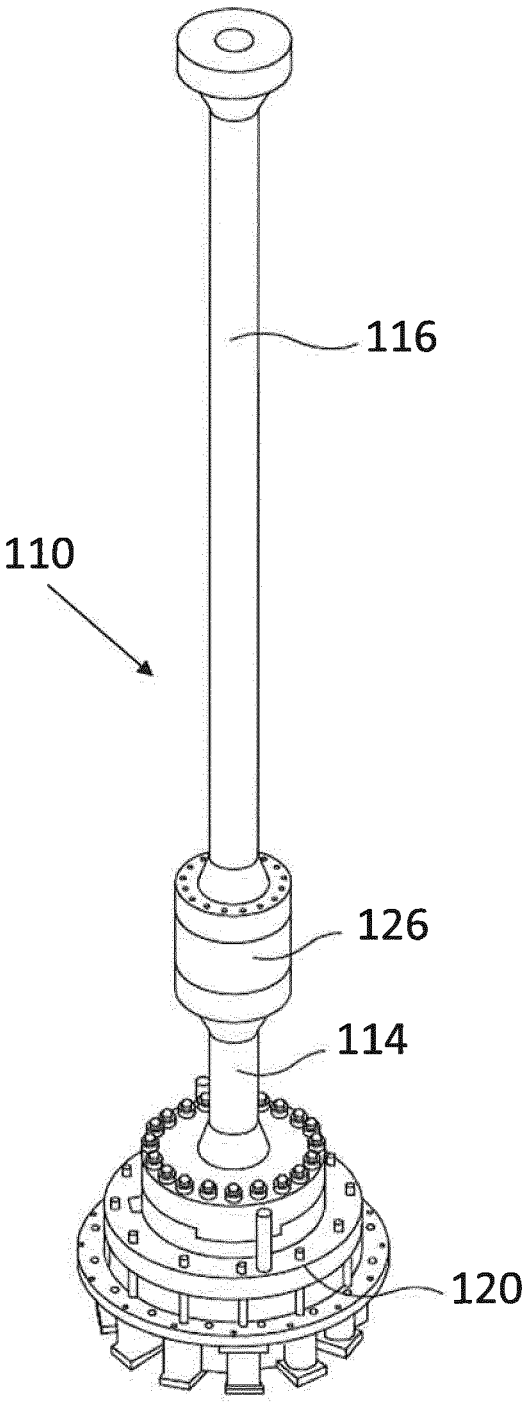
Figure 11:
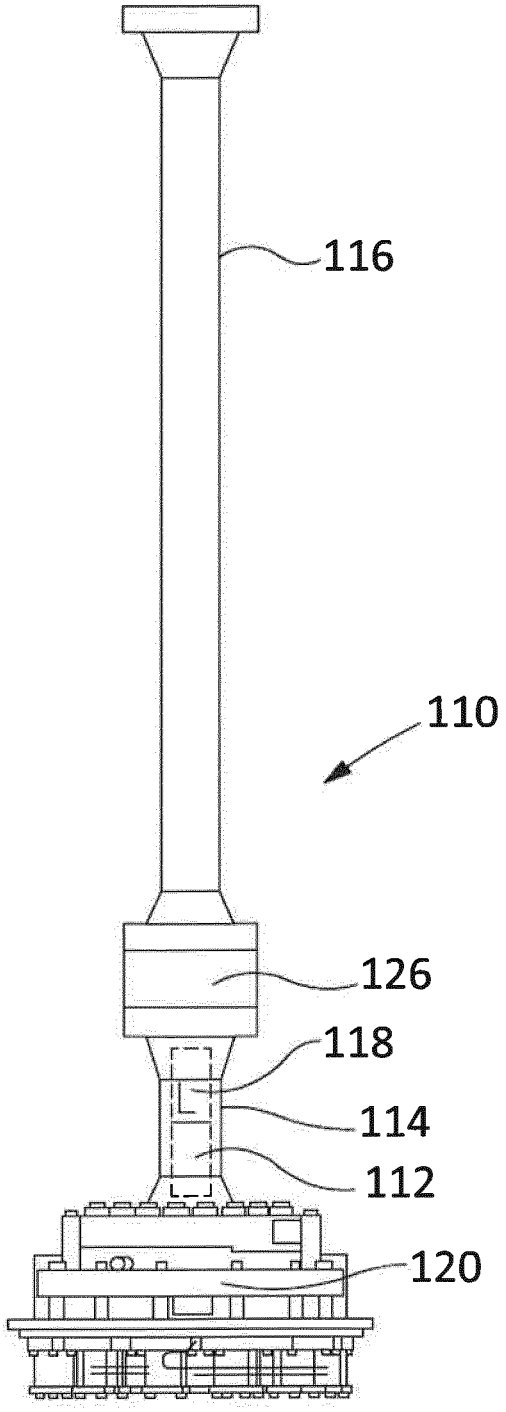

FIGS. 9 to 11 of the accompanying drawings show the apparatus 110 of FIG. 8 in more detail.

As shown in FIG. 9, the apparatus 110 comprises a housing 114 for coupling the apparatus 110 to the well installation W and a conveying arrangement 116 for conveying the tool 112 into and/or from the well installation W. The housing 114 and the conveying arrangement 116 are configured to be coupled together.

The housing 114 is configured to house the tool 112 to be conveyed and associated tooling 118, such as a setting tool, a release tool and/or a retrieval tool, and carries a connector 120 for coupling the apparatus 10 to the Christmas tree XT.

As shown in FIG. 9, the apparatus 110 further comprises a lifting frame 122 which facilitates handling of the apparatus 110 (and the Christmas tree XT where required) and a control panel 124 which facilitates control of the apparatus 10 by remotely operated vehicle ROV (the lifting frame 122 and the control panel 124 are not shown in FIGS. 10 and 11 for ease of reference).

The housing 114 is configured to form a pressure containing body of the apparatus 110 when connected to the Christmas tree XT. A packing seal arrangement 126 is disposed between the conveying arrangement 116 and the housing 114. The packing seal arrangement 126 ensures pressure competent sealing between the housing 114 and the conveying arrangement 116.

Figure 12:
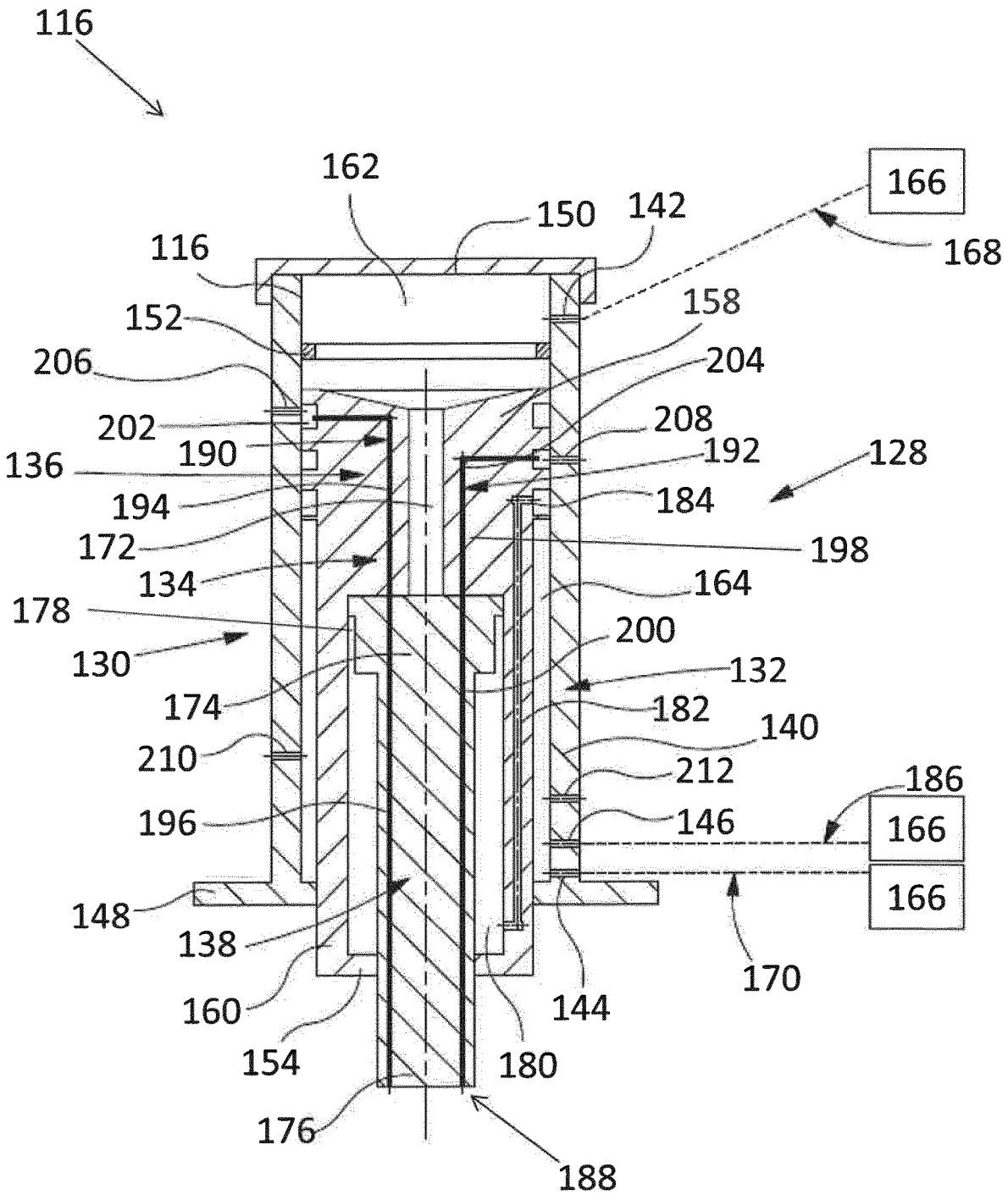
FIG. 12 shows a longitudinal section view of the conveying arrangement of the apparatus shown in FIGS. 8 to 11, in a first configuration.
Figure 13:
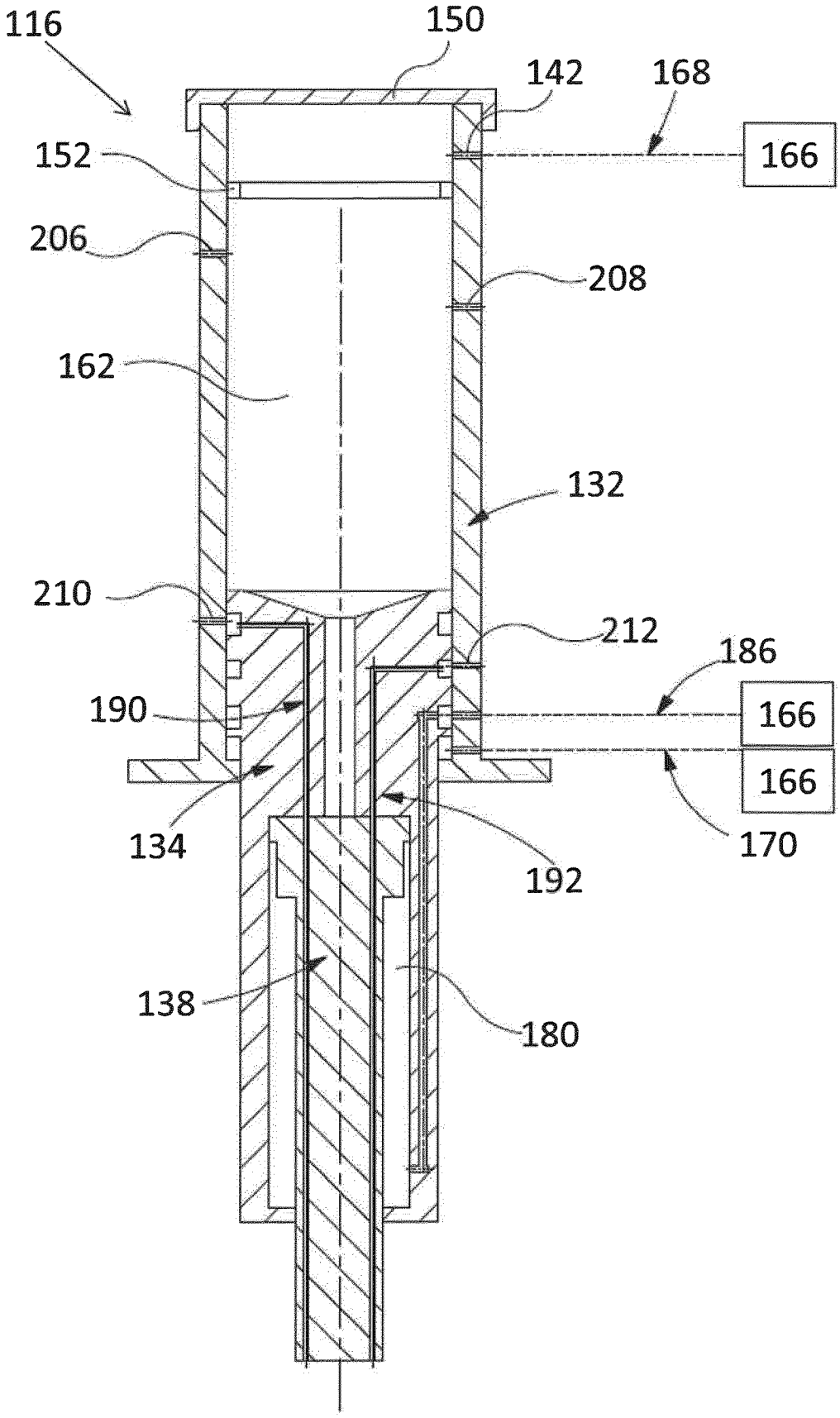
FIG. 13 shows a longitudinal section view of the conveying arrangement shown in FIG. 12, in a second configuration.
Figure 14:
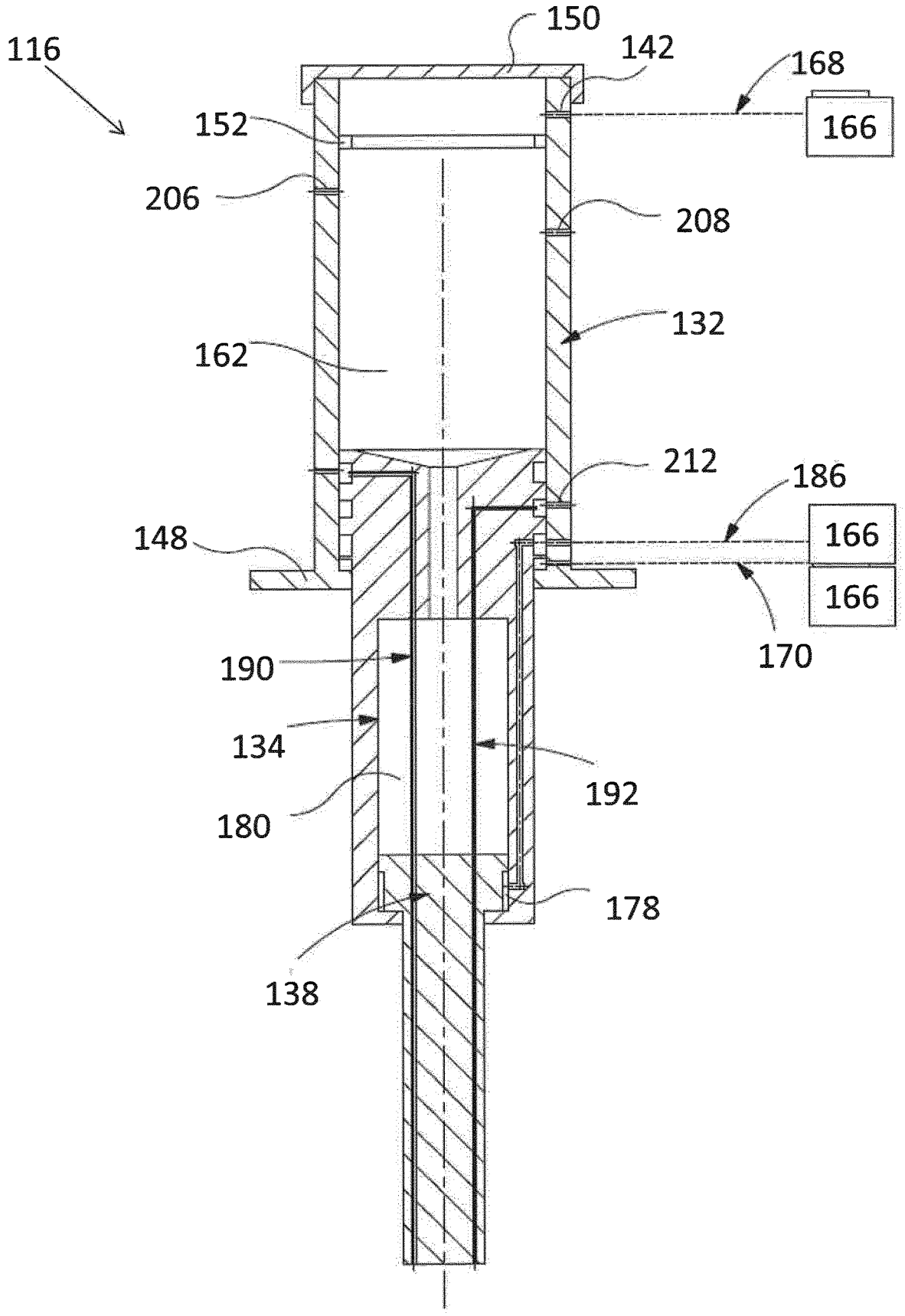
FIG. 14 shows a longitudinal section view of the conveying arrangement shown in FIG. 12, in a third configuration.

FIGS. 12, 13 and 14 of the accompanying drawings show the conveying arrangement 116 of the apparatus 110 in more detail.

As shown in FIGS. 12 to 14, the conveying arrangement 116 comprises an actuator arrangement—represented generally by 128—having a single actuator 130 in the form of hydraulic linear actuator. While in the illustrated embodiment, the actuator 130 takes the form of a hydraulic linear actuator, the actuator 130 may comprise a pneumatic actuator, an electric actuator, or the like.

As will be described further below, the actuator arrangement 128 is configurable between a retracted configuration, an extended configuration and a further extended configuration. FIG. 12 shows the conveying arrangement 116 in a first configuration, with the actuator arrangement 128 in the retracted configuration. FIG. 13 shows the conveying arrangement 116 in a second configuration, with the actuator arrangement 128 in an extended configuration. FIG. 14 shows the conveying arrangement 116 in a third configuration, with the actuator arrangement 128 in the further extended configuration.

As shown, the actuator 130 has a cylinder 132 and a piston arrangement 134. In the illustrated embodiment, the piston arrangement 134 takes the form of a telescopic piston arrangement having a first piston member 136 and a second piston member 138.

In use, the piston arrangement 134 is moveable relative to the cylinder 132 between a retracted position relative to the cylinder 132 (as shown in FIG. 12) and an extended position relative to the cylinder 132 (as shown in FIG. 13), the actuator arrangement 128 defining the extended configuration when the piston arrangement 134 is positioned in the extended position relative to the cylinder 132. The piston arrangement 134 is itself extendable from a retracted configuration (as shown in FIGS. 12 and 13) to an extended configuration (as shown in FIG. 14), the actuator arrangement 128 defining the further extended configuration when the piston arrangement 134 is extended.

As shown, the cylinder 132 comprises a generally cylindrical body 140 having a number of ports 142, 144, 146. A flange portion 148 is provided at a first end of the body 140 (the lower end as shown in the figures) and, in use, the flange portion 148 couples the conveying arrangement 116 to the housing 114. In the illustrated embodiment, the flange portion 128 is integrally formed with the body 140. However, it will be recognised that the flange portion 148 may alternatively comprise a separate component coupled to the body 140. A cap 150 is disposed at a second end of the body 140 (the upper end as shown in the figures), the cap 150 forming a closure of the body 140.

The piston arrangement 134 is slidably disposed in the body 140 between the retracted configuration and the extended configuration, and stops 152, 154 are provided for limiting movement of the first piston member 136. Stop 152 limits retraction of the first piston member 136 and is disposed within the body 140 between the cap 150 and the piston arrangement 134. In the illustrated embodiment, stop 152 takes the form of an annular ring coupled to an inner surface 156 of the body 140. However, it will be recognised that the stop 152 may alternatively be integrally formed with the body 140. Stop 154 limits extension of the first piston member 136. Stop 154 is integrally formed with the body 140. However, it will be recognised that the stop 154 may alternatively comprise a separate component coupled to the body 140.

First piston member 136 is slidably disposed in the cylinder 132 and comprises a piston 158 and a piston rod 160 extending through the cylinder 132. The first piston member 136 divides the interior of the cylinder 132 into a first chamber 162 and a second chamber 164. In use, the first piston member 136 isolates the first chamber 162 from the second chamber 164.

The first chamber 162 communicates with a fluid supply 166 via port 142 and a conduit 168, in the illustrated embodiment the fluid supply 166 taking the form a hydraulic fluid supply and the conduit 168 taking the form of a hydraulic line.

The second chamber 164 communicates with the fluid supply 166 (or a separate fluid supply) via port 144 and a conduit 170, in the illustrated embodiment the conduit 170 taking the form of a hydraulic line.

A passage 172 is disposed in the first piston member 136, the passage 172 providing fluid communication between the first chamber 162 and the second piston member 138 such that fluid directed to the first chamber 162 also acts on the second piston member 138.

In use, fluid directed to first chamber 162 via port 142 urges the piston arrangement 34 towards an extended position relative to the cylinder 132. As the second piston member 138 is carried by the first piston member 136, fluid directed to the first chamber 162 urges both the first piston member 136 and the second piston member 138 towards the extended position (to the position as shown in FIG. 12).

The second piston member 138 is slidably disposed in the first piston member 136 and comprises a piston 174 and a piston rod 176 extending through the first piston member 136. The piston 174 of the second piston member 138 has a stepped profile, having a recess 178.

As described above, the passage 172 provides fluid communication between the first chamber 162 and the second piston member 138 such that fluid directed to the first chamber 162 also acts on the second piston member 138. As the area of the first piston member 136 exposed to a fluid pressure in first chamber 162 is larger than the area of the second piston member exposed to the fluid pressure, the resulting pressure force (equal to pressure multiplied by area) acting on the first piston member 136 is greater than the pressure force (equal to pressure multiplied by area) acting on the second piston member 138. Thus, the first and second piston members 136, 138 will move together towards the extended position until the first piston member 136 engages stop 152. While further movement of the first piston member 116 is prevented by the stop 152, the force acting on the second piston member 138 will urge the second piston member 138 to the extended position relative to the first piston member 136, and thus the conveying arrangement 116 to the further extended configuration.

A third chamber 180 is provided between the first piston member 136 and the second piston member 138. A gallery 182 provided in the first piston member 136 provides fluid communication between a cavity 184 in the first piston member 136 and the third chamber 180. As shown, the third chamber 180 is initially isolated, since the cavity 184 is not aligned with the port 146. However, when the actuator arrangement 128 is moved to the extended configuration, and in the further extended configuration, the cavity 184 is aligned with the port 146, such that the third chamber 180 communicates with the fluid supply 166 (or a separate fluid supply) via the gallery 182, port 146 and a conduit 186, in the illustrated embodiment the conduit 186 taking the form of a hydraulic line.

In use, fluid directed to third chamber 180 urges the second piston member 138 towards the retracted position relative to the first piston member 136.

As shown in FIGS. 12 to 14, it can be seen that the apparatus 110 differs from the apparatus 10 in that the apparatus 110 further comprises a fluid communication arrangement—generally represented by 188—which permits fluid communication via the apparatus 110.

The fluid communication arrangement 188 comprises a first control line 190 and a second control line 192. A first portion 194 of the first control line 190 is disposed in the first piston member 136 and a second portion 196 of the first control line 190 is disposed in the second piston member 138, the first portion 194 and second portion 196 being telescopically arranged so as to provide a continuous fluid communication path through the conveying arrangement 116.

The second control line 192 is similarly arranged, having a first portion 198 disposed in the first piston member 136 and a second portion 200 disposed in the second piston member 138, the first portion 136 and the second portion 200 of the second control line 192 being telescopically arranged so as to provide a continuous fluid communication path through the conveying arrangement 116.

As shown in FIGS. 12 to 14, the first portion 194 of the first control line 190 communicates with a cavity 202 disposed in the first piston member 136 and the first portion 198 of the second control line 192 communicates with a cavity 204 disposed in the first piston member 136.

The first control line 190 and the second control line 192 selectively communicate with communication ports 206, 208, 210, 212 disposed in the housing 114, the apparatus 110 configured so that the first control line 190 initially communicates with the communication port 206 and so that the second control line 192 communicates with the communication port 208. As shown in FIG. 13, on moving to the extended configuration, and in the further extended configuration, the first control line 190 communicates with communication port 210 and the second control line 192 communicates with communication port 212.

The apparatus 10,110 may be utilised to perform a number of different workover operations on the well installation W, or a plurality of well installations.

As described above, in some applications the apparatus 110 (or the apparatus 10) may form part of a tool assembly 1000 comprising the apparatus 110 (or apparatus 10) and the Christmas tree XT while in other applications the apparatus 10 is configured for coupling to the Christmas tree XT at a subsea location and operable to convey the tool 12 into and/or from the well installation W via the Christmas tree XT. In other applications, FIGS. 15 to 21 illustrate one such workover operation in which the apparatus 110 is utilised to convey (in this case retrieve) the tool 112—which in the illustrated embodiment takes the form of a tubing hanger plug—from the well installation W.

Figure 15:
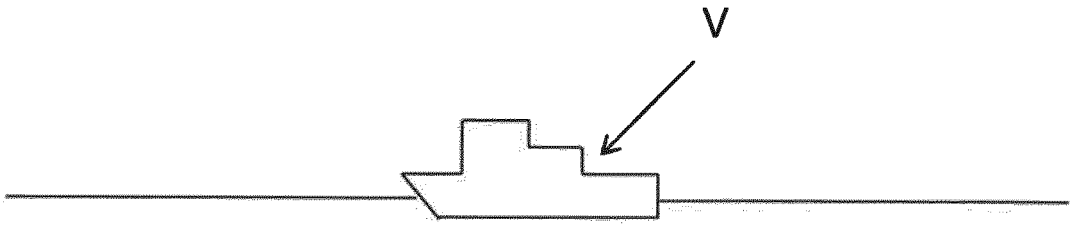
FIGS. 15 to 21 illustrate a system and method of conveying a tool from a wellhead of a well installation using the apparatus shown in FIGS. 8 to 14.
Figure 15:
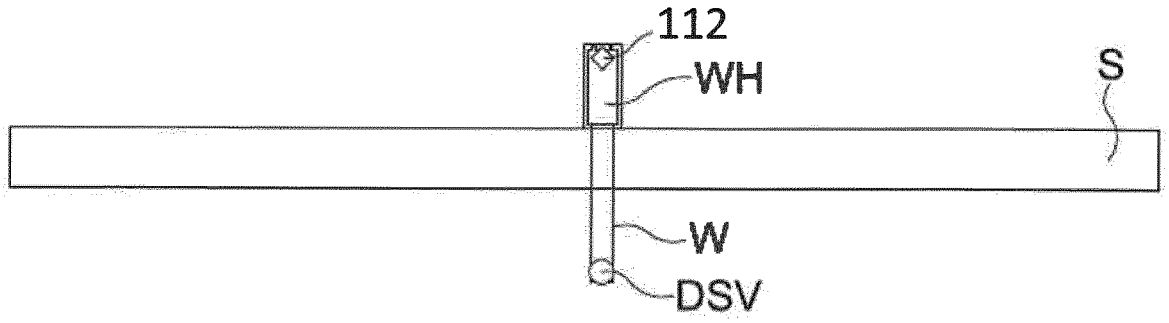

FIG. 15 shows well installation W having its surface termination at wellhead WH disposed on the seabed S. In order to ensure that there is at least two safety barriers, the well installation W includes a primary downhole safety valve DSV in addition to tool 112 disposed in the wellhead WH. It will be recognised that other safety barrier configurations may be provided.

Figure 16:
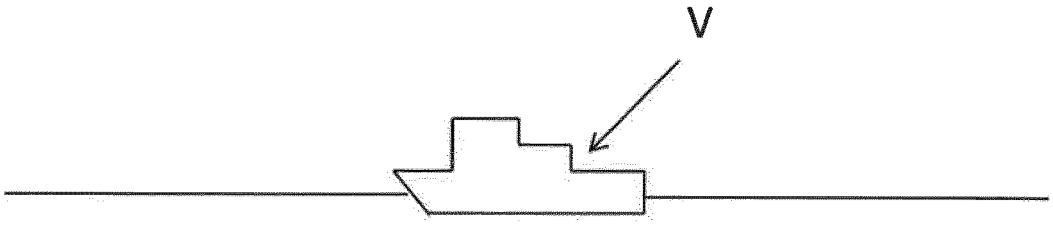
Figure 16:
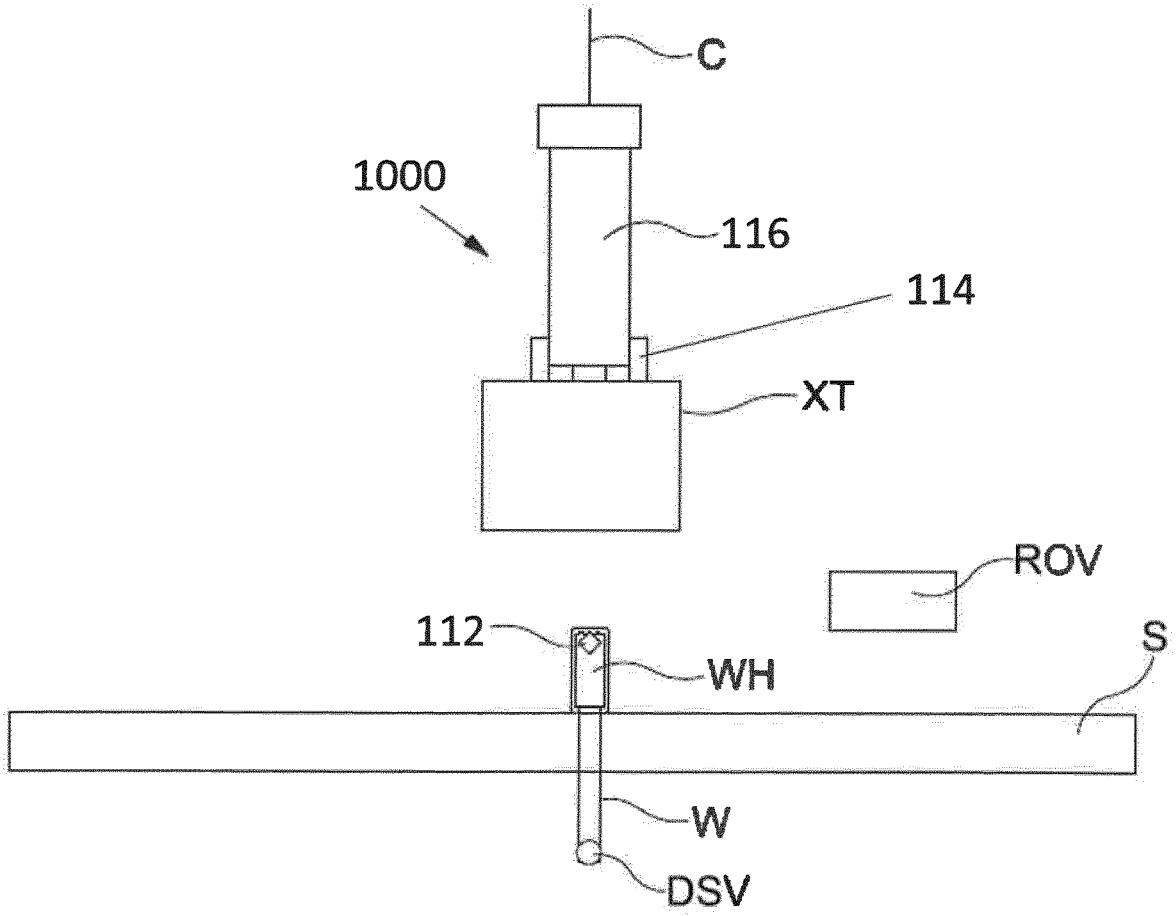

As shown in FIG. 16, tool assembly 1000 including apparatus 110 coupled to Christmas tree XT (which in the illustrated embodiment is a vertical Christmas tree) is deployed subsea using a conveyance in the form of wire C. Where required, the tool assembly 1000 is manipulated into position on the wellhead WH by remotely operated vehicle ROV.

Figure 17:
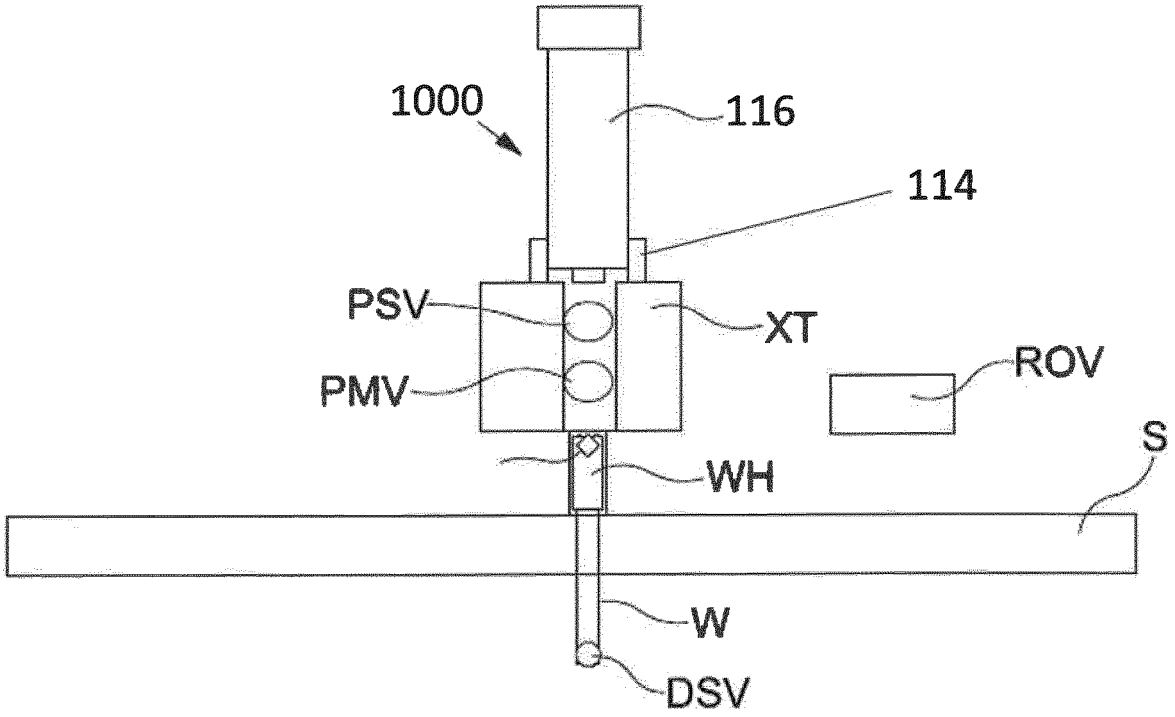
Figure 18:
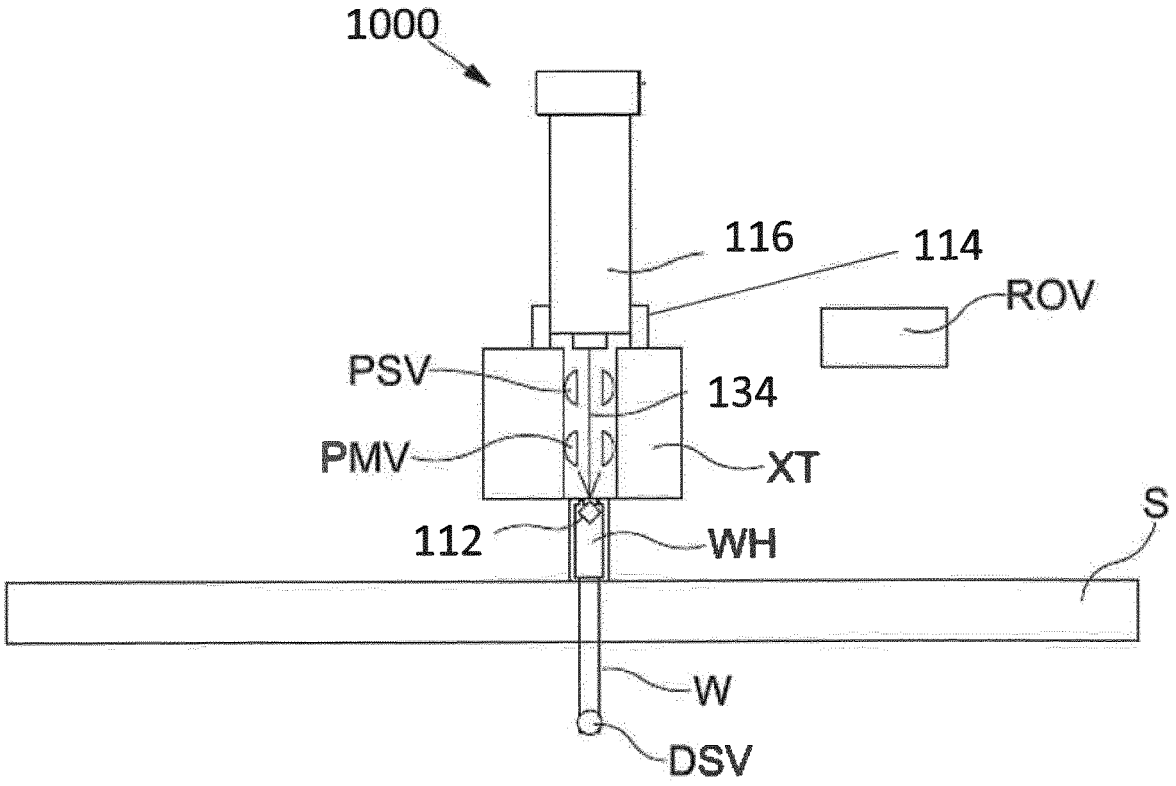

Once located on the wellhead WH, the wire C is retrieved and the remotely operated vehicle ROV is operated to lock the Christmas tree XT onto the wellhead WH and carry out functional checks and testing operations on the Christmas tree XT, as illustrated in FIG. 17.

Once the functional checks and testing operations have been carried out, the remotely operated vehicle ROV is operated to open production swab valve PSV and production master valve PMV of the Christmas tree XT, the remotely operated vehicle ROV then being operated to reconfigure the apparatus 110 to extend the piston arrangement 134 of the conveying arrangement 116 and coupled tooling 118 through the Christmas tree XT and into the wellhead WH.

Once the tooling 118 has engaged the tool 112, the apparatus 110 is operated via the remotely operated vehicle ROV and fluid communication arrangement 188 to unlock the tool to be conveyed 112 from the wellhead WH (in particular from a tubing hanger disposed in the wellhead WH).

Figure 19:
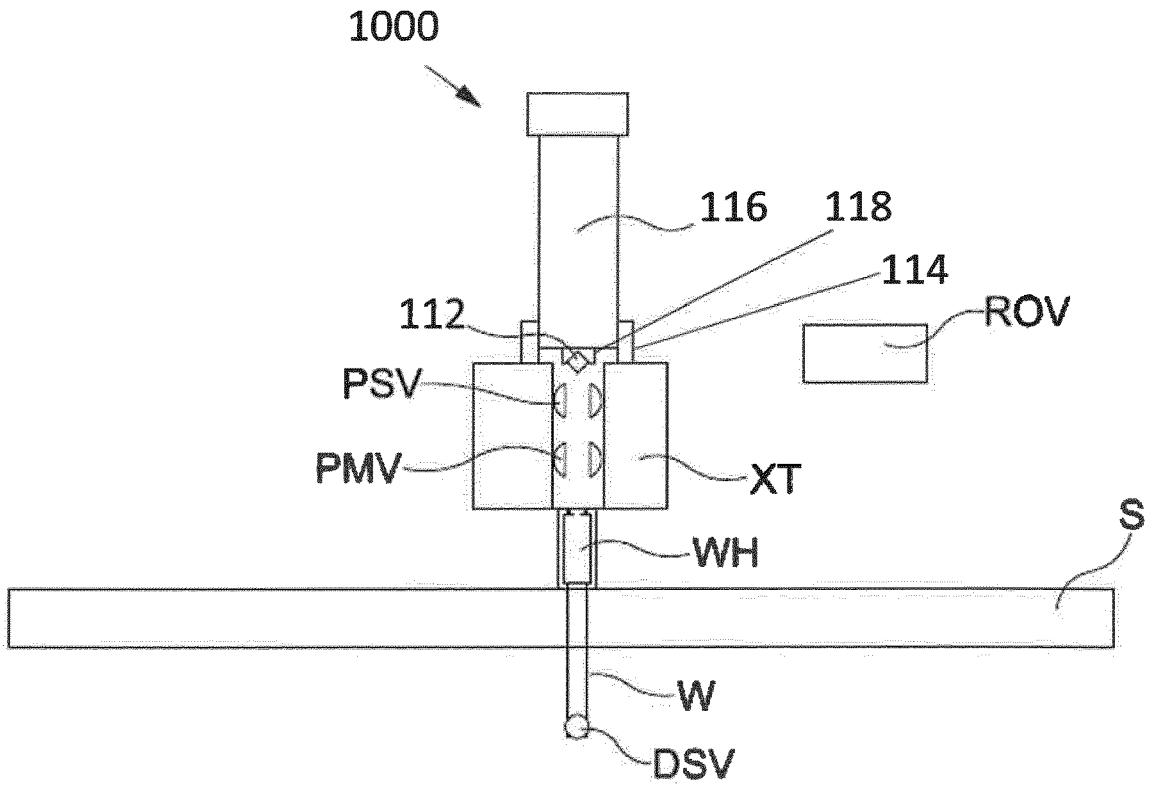

The remotely operated vehicle ROV is then operated to retract the piston arrangement 134 of the apparatus 110, together with the tooling 118 and tool to be conveyed 112, so as to retrieve the tool to be conveyed 112 into the housing, as illustrated in FIG. 19. At this stage in the operation, the pressure competent housing 114 of the apparatus 110 forms the secondary safety barrier of the well installation W.

Figure 20:
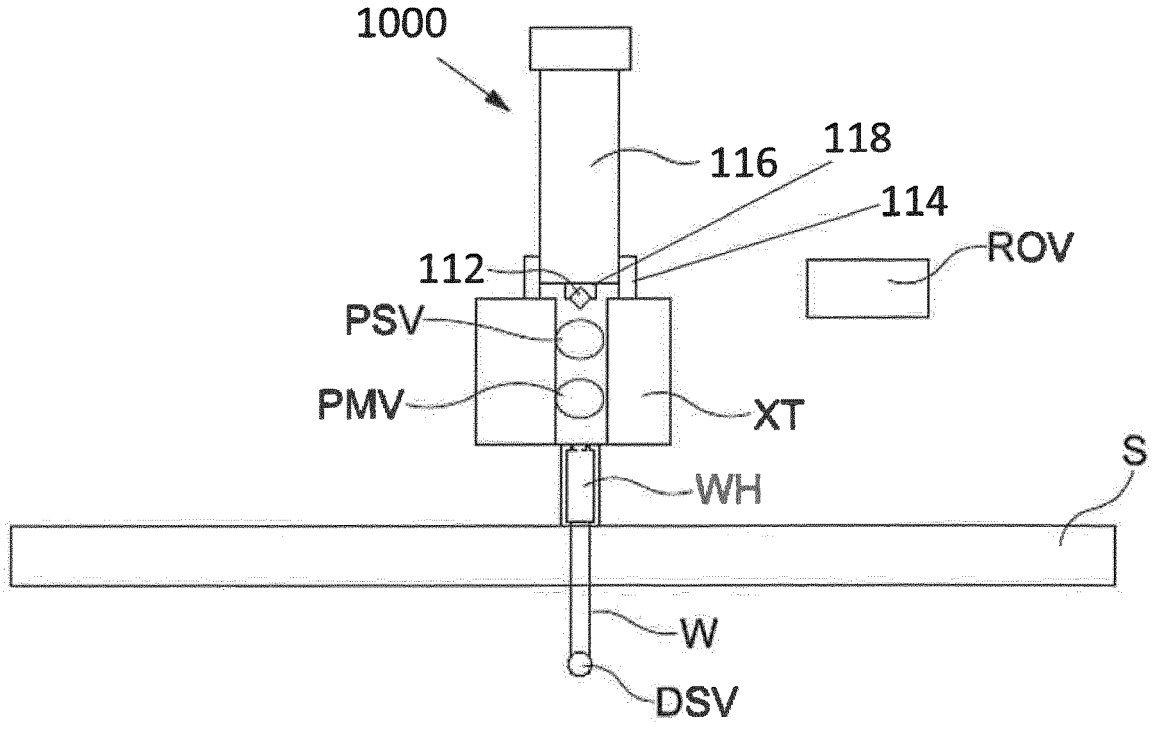
Figure 21:
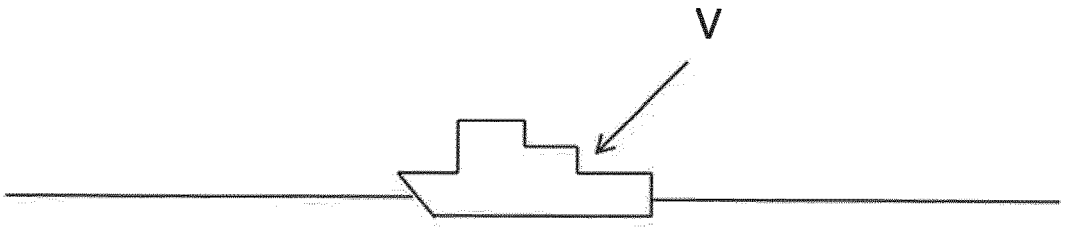
Figure 21:
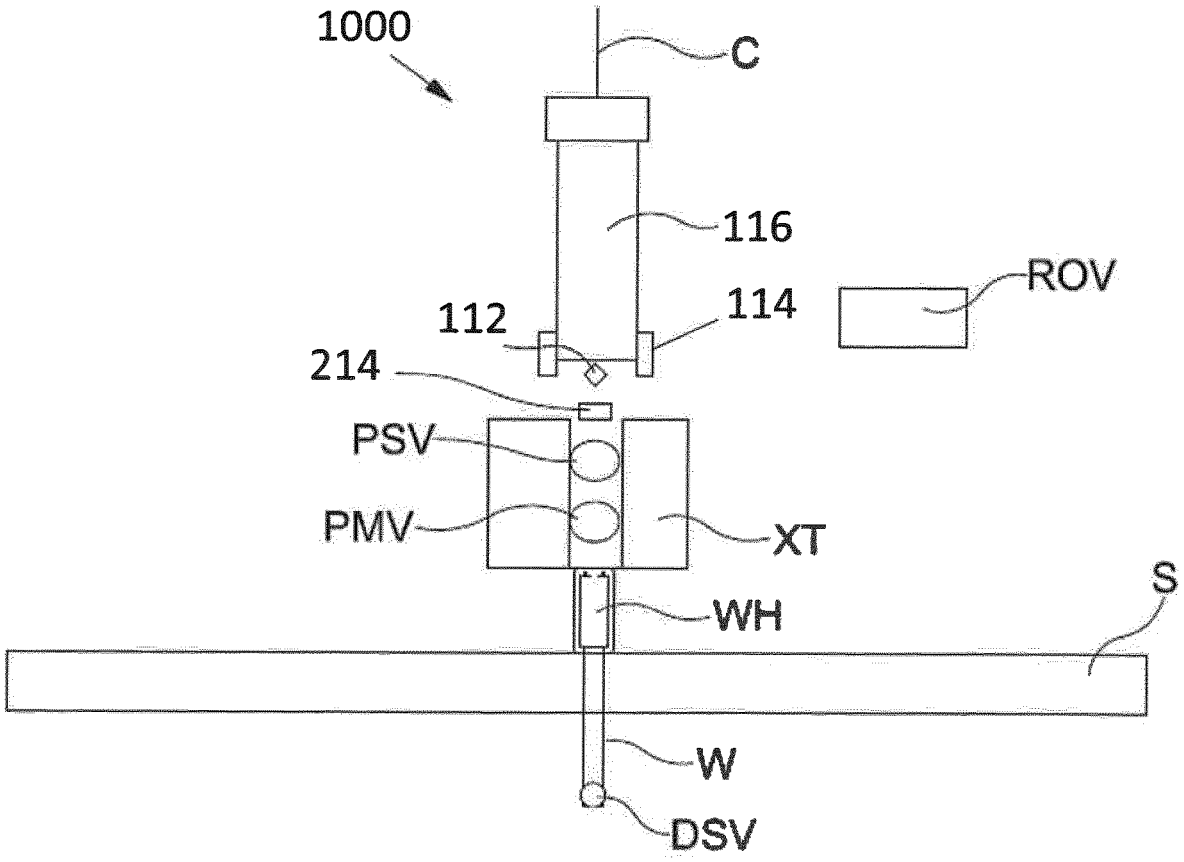

Once the tool to be conveyed 112 has been retrieved from the wellhead WH, the remotely operated vehicle ROV is operated to close the production swab valve PSV and production master valve PMV of the Christmas tree XT, and carry out integrity tests on the production swab valve PSV and production master valve PMV. At this stage in the operation, the Christmas tree XT now forms the secondary safety barrier of the well installation W, as shown in FIG. 20.

The remotely operated vehicle ROV is operated to flush the space between the Christmas tree XT and the apparatus 110, the tool assembly 1000 then being retrieved to surface via the wire C. Finally, the remotely operated vehicle ROV is operated to locate a Christmas tree mandrel cover 214 into place.

Beneficially, embodiments of the present invention permit the Christmas tree XT to be deployed and tool to be conveyed 112 retrieved in a single run, and from a lower category vessel than required for conventional operations.

FIGS. 22 to 29 illustrate another operation in which the apparatus 110 may be used, in this case to deploy the tool to be conveyed 112, in the illustrated embodiment a tubing hanger plug, into the wellhead WH and retrieve the Christmas tree XT, for example where the Christmas tree XT has developed a fault requiring it to be recovered to surface for replacement or repair.

Figure 22:
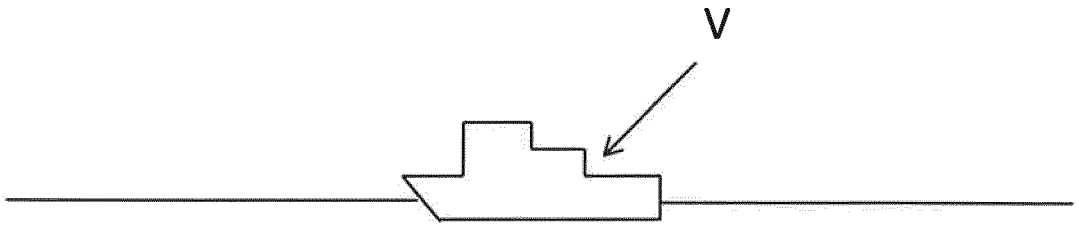
FIGS. 22 to 29 illustrate a system and method of conveying a tool into a wellhead of a well installation using the apparatus shown in FIGS. 8 to 14.
Figure 22:
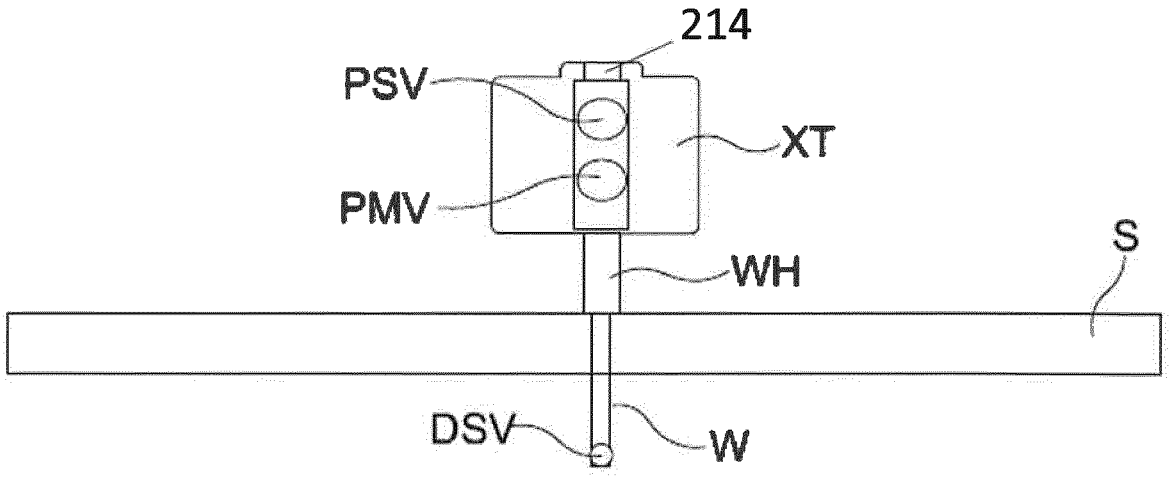

FIG. 22 shows well installation W having its surface termination at wellhead WH disposed on the seabed S. Valve assembly in the form of a Christmas tree XT (in the illustrated embodiment a Vertical Christmas tree) is located on the wellhead WH and is operable—via production swab valve PSV and production master valve PMV—to control access into and/or from the well installation W. In order to ensure that there is at least two safety barriers, the production swab valve PSV and production master valve PMV of the Christmas tree XT provide the secondary barrier in addition to the primary downhole safety valve DSV. It will be recognised that other safety barrier configurations may be provided.

Figure 23:
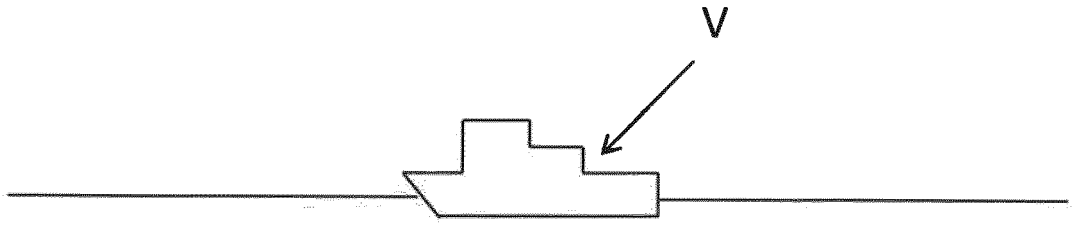
Figure 23:
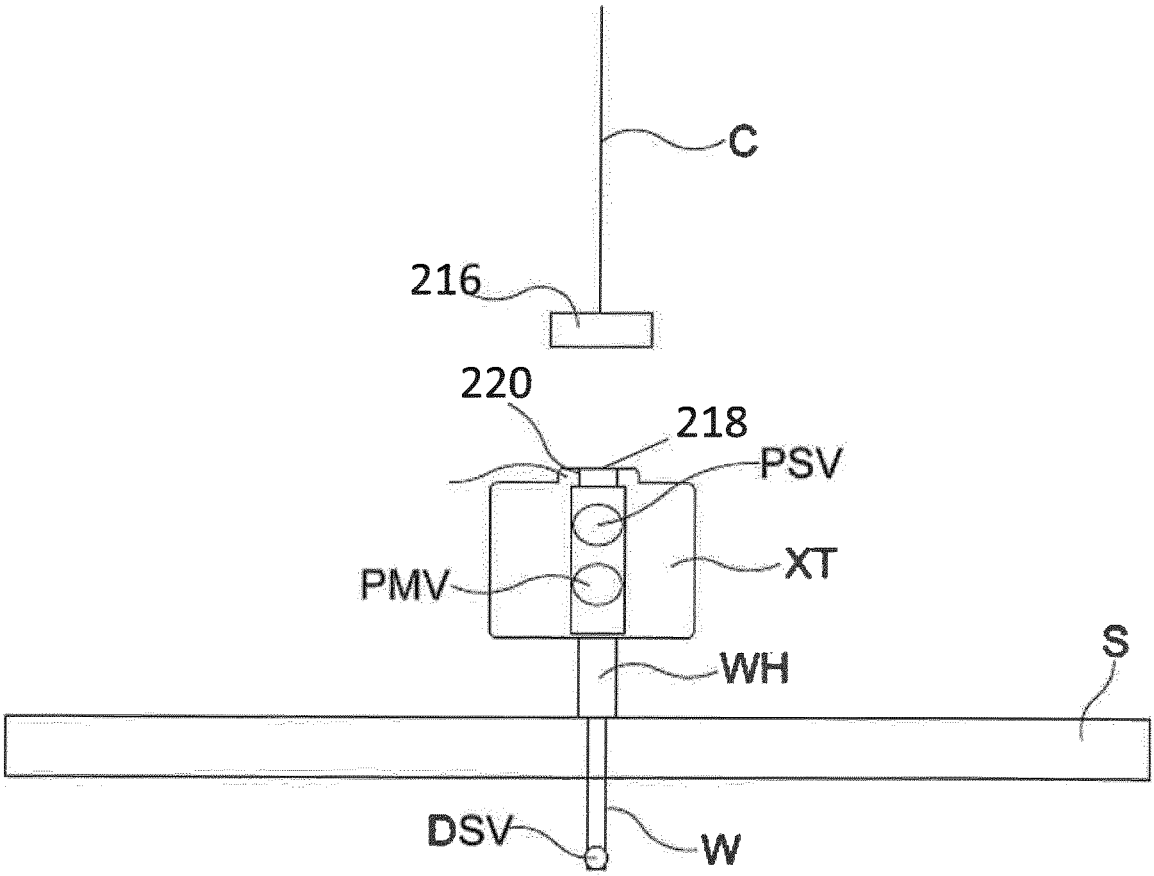

As shown in FIG. 23, a conveyance in the form of a wire C is utilised to deploy a tree cap running/retrieval tool 216 for removing tree cap 218 from the re-entry mandrel 220 of the Christmas tree XT. The illustrated embodiment shows an internal tree cap 218, however it will be recognised that the tree cap 218 may alternatively comprise an external tree cap.

Figure 24:
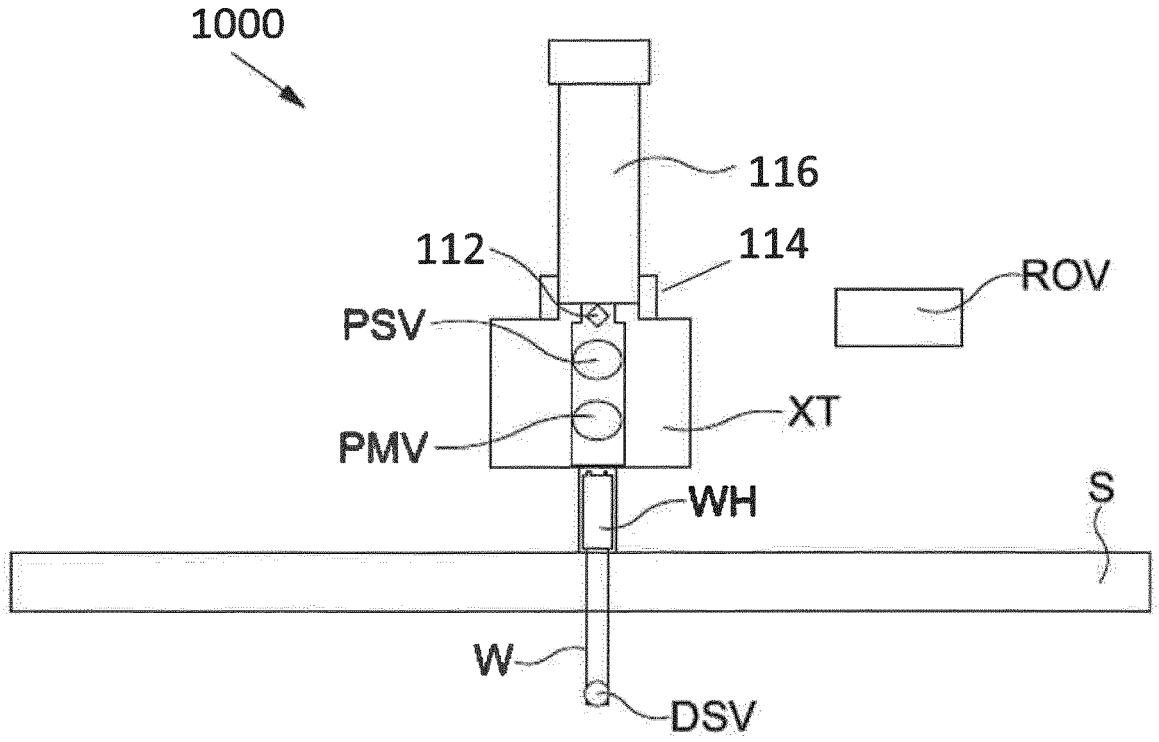

The apparatus 110—including housing 114 and conveying arrangement 116—is then deployed subsea via the wire C. Where required, the apparatus 110 is manipulated into position on the Christmas tree XT by the remotely operated vehicle ROV, as shown in FIG. 24.

Once located on the Christmas tree XT, the remotely operated vehicle ROV is operated to lock the apparatus 110 onto the Christmas tree XT and then test the connection between the apparatus 110 and the Christmas tree XT. The wire C is then retrieved.

Figure 25:
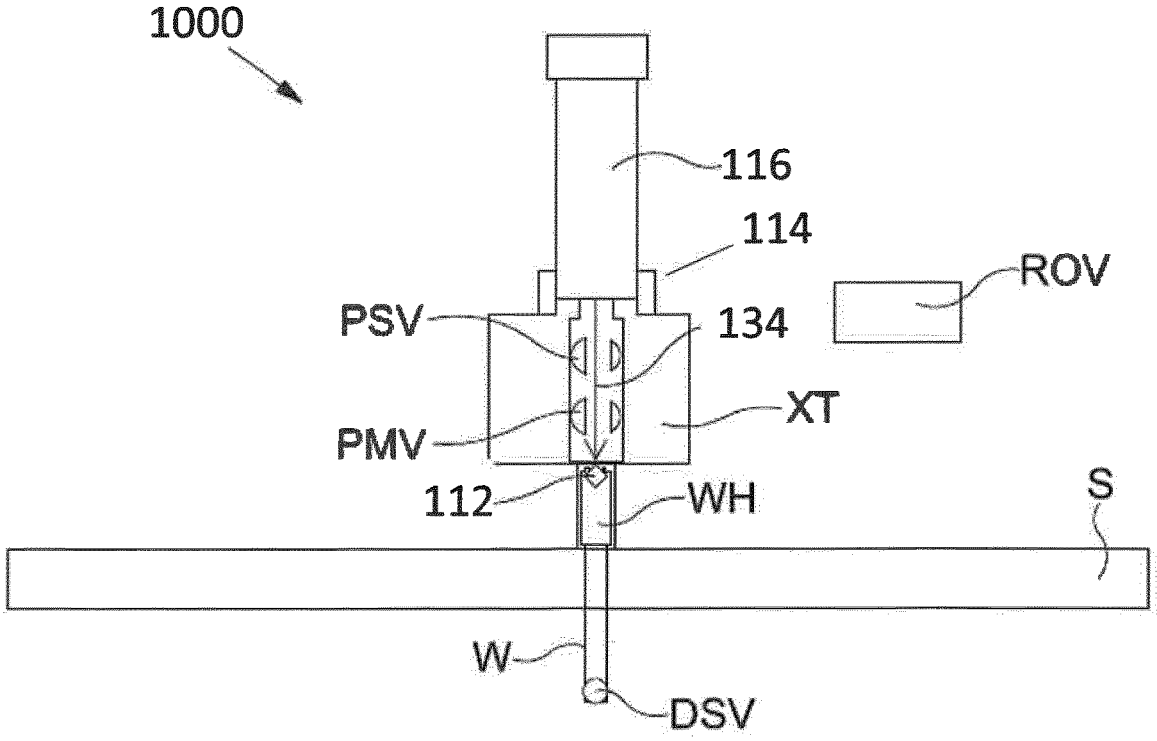

The remotely operated vehicle ROV is then operated to open the production swab valve PSV and production master valve PMV of the Christmas tree XT, the remotely operated vehicle ROV then being operated to reconfigure the apparatus 110 to extend the piston arrangement 134 and coupled tooling 118 and tool to be conveyed 112 through the Christmas tree XT and into the wellhead WH, as shown in FIG. 25.

The apparatus 110 is then operated via the remotely operated vehicle ROV and fluid communication arrangement 188 to lock the tool to be conveyed 112 in place in the wellhead WH (in particular in the tubing hanger disposed in the wellhead WH).

Figure 26:
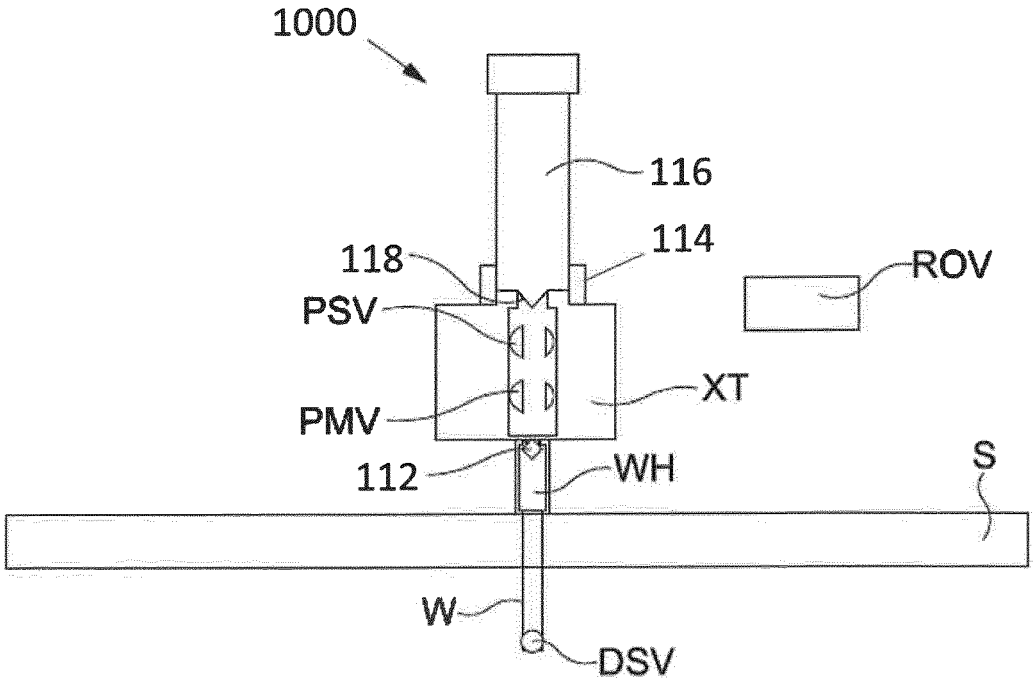

The remotely operated vehicle ROV is then operated to retract the piston arrangement 134 of the apparatus 110, together with the coupled tooling 118, into the housing 114 of the apparatus 110, as illustrated in FIG. 26. At this stage in the operation, the apparatus 110 forms the secondary safety barrier of the well installation W.

Figure 27:
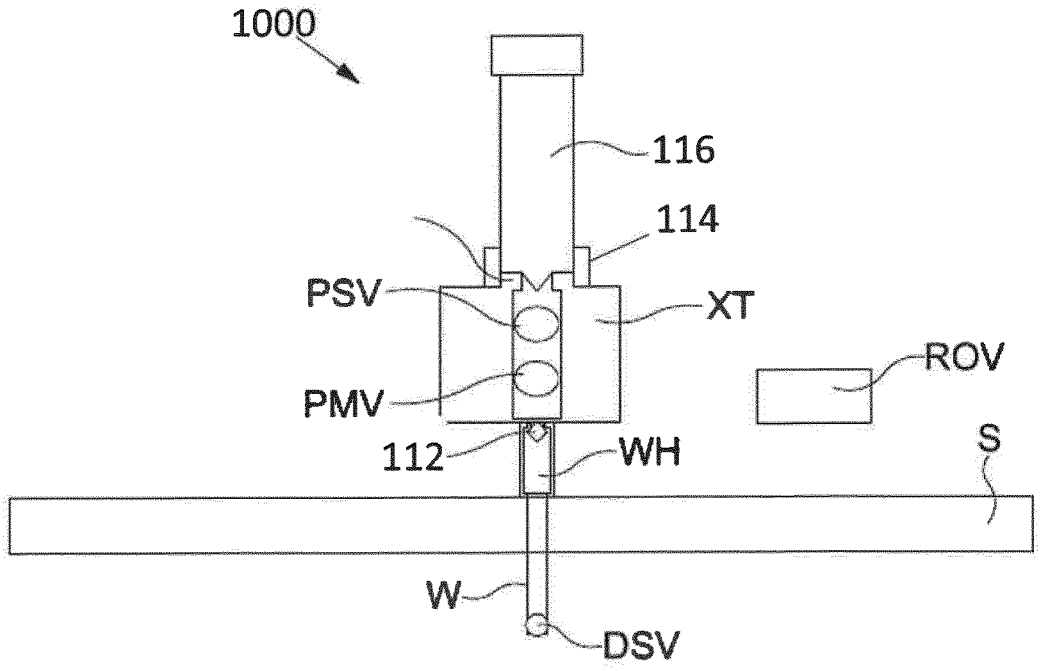
Figure 28:
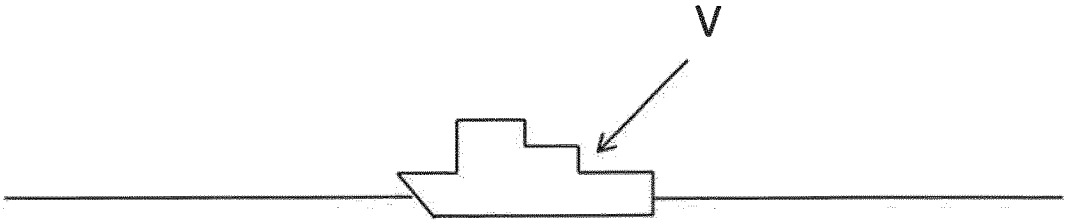
Figure 28:
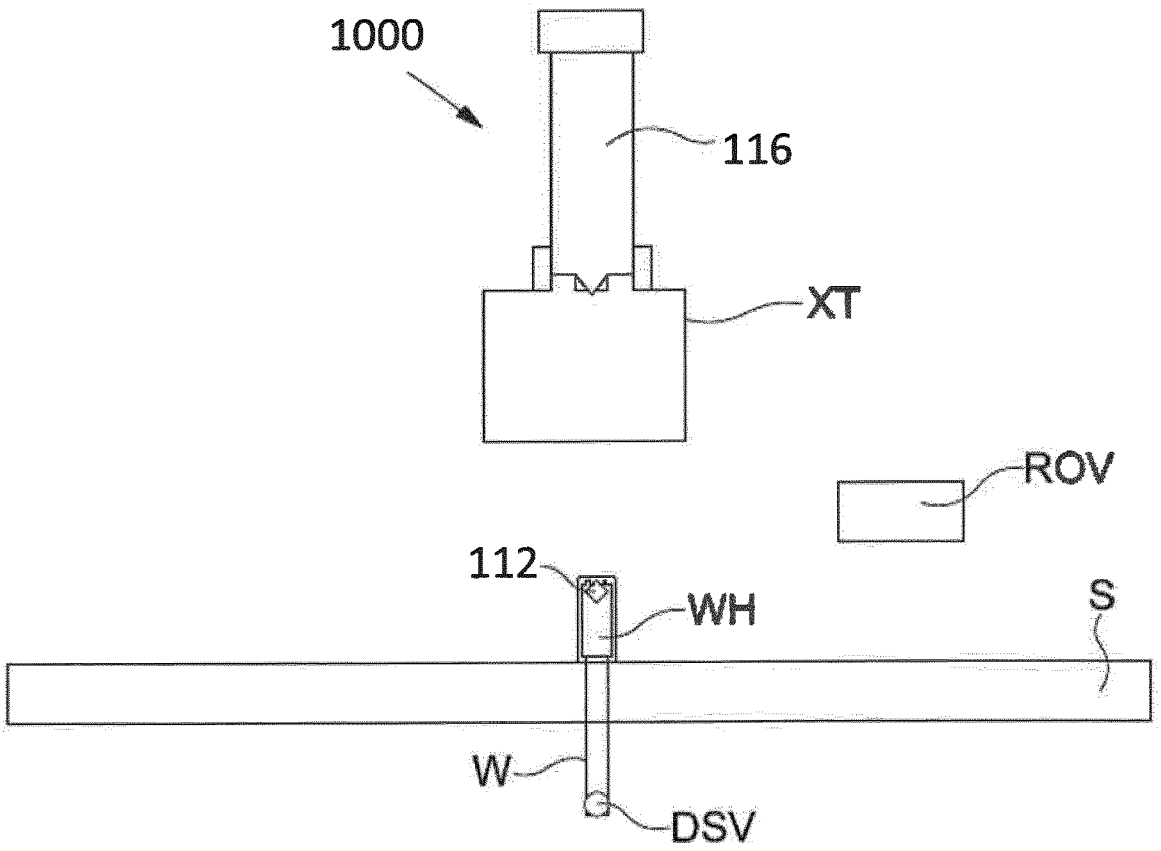
Figure 29:
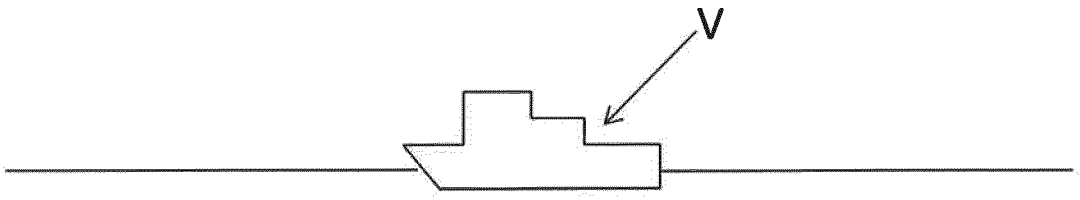
Figure 29:
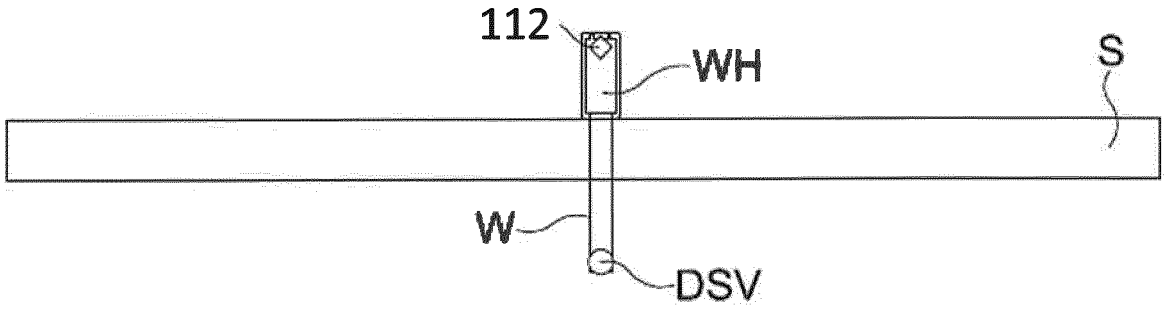

Once the tooling 118 has been retrieved from the wellhead WH, the remotely operated vehicle ROV is operated to close the production swab valve PSV and production master valve PMV of the Christmas tree XT, and carry out integrity tests on the tool to be conveyed 112 to ensure that the tool 112 is secure to act as a secondary safety barrier, as shown in FIG. 27. At this stage in the operation, with the tool 112 now forming a secure secondary safety barrier of the well installation W, the Christmas tree XT and apparatus 110—together forming tool assembly 1000—can be recovered to surface using the tool assembly 200, as shown in FIGS. 28 and 29.

Beneficially, embodiments of the present invention permit a tubing hanger plug to be deployed and Christmas tree retrieved in a single deployment run, and from a lower category vessel than required for conventional operations.

As described above, the apparatus 10,110 may be utilised to perform a number of additional workover operations, and FIGS. 30 to 33 illustrate two such operations.

Figure 30:
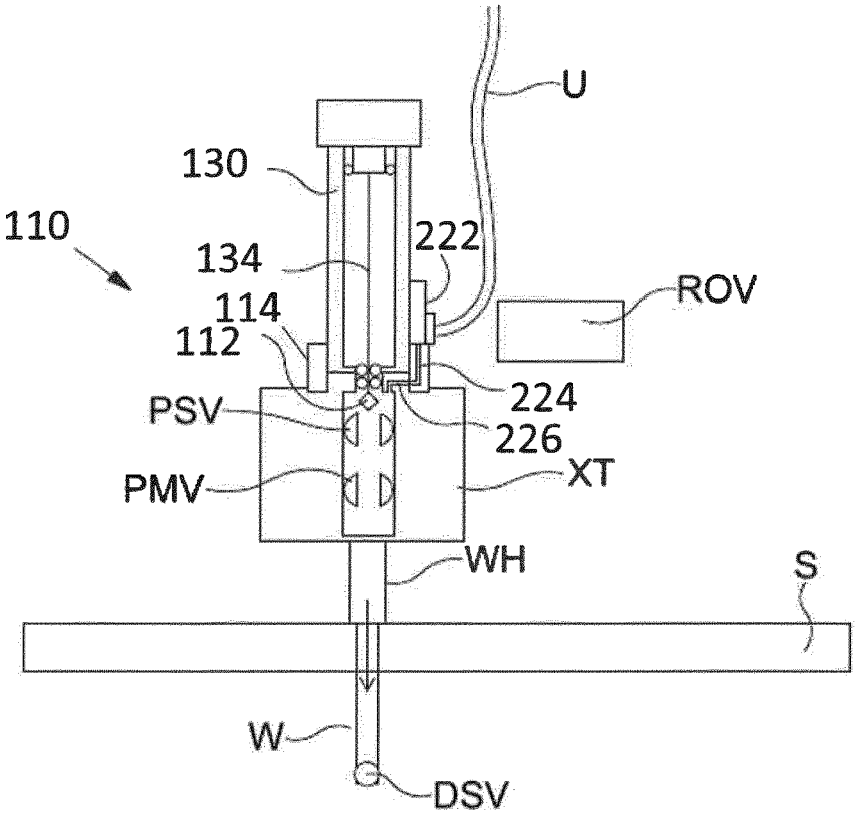
FIGS. 30 and 31 illustrate a system and method for carrying out a fluid delivery operation in and/or on the well installation using the apparatus shown in FIGS. 8 to 14.
Figure 31:
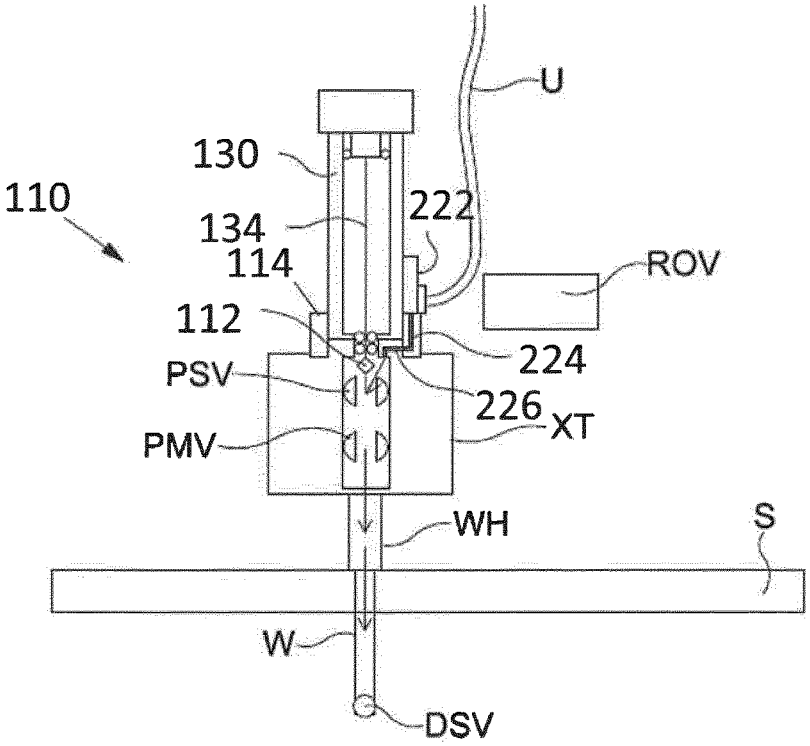

In FIGS. 30 and 31, the apparatus 110 is used to deliver fluid into the well installation W to facilitate a fluid injection operation, such as a bullheading operation whereby fluid is pumped into the well installation to provide or assist in well control.

As shown in FIG. 30, the apparatus 110 comprises, is coupled to, or otherwise operatively associated with, a fluid intervention module 222. A fluid communication channel 224 is provided in the apparatus 210. The Christmas tree XT is also provided with a fluid communication channel 226 which communicates with the well installation W. The fluid communication channels 224, 226 are configured to communicate fluid from the fluid intervention module 222 into the well installation W.

It will be recognised that the fluid channel 226 may be the production bore of the Christmas tree XT, the annulus bore or a dedicated fluid injection bore.

In the illustrated embodiment, an umbilical U is provided to supply fluid to the fluid intervention module 222. However, in other embodiments other means for conveying fluid to the fluid intervention module 222 may be used. For example, the fluid may be supplied via the remotely operated vehicle ROV, or from a reservoir held on the apparatus 110.

As shown in FIG. 30, the apparatus 110 comprises, is coupled to, or otherwise operatively associated with, a fluid intervention module 222. A fluid communication channel 224 is provided in the apparatus 110. The Christmas tree XT is also provided with a fluid communication channel 226 which communicates with the well installation W. The fluid communication channels 224, 226 are configured to communicate fluid from the fluid intervention module 222 into the well installation W.

Once located on the Christmas tree XT, the remotely operated vehicle ROV is operated to lock the apparatus 110—including housing 114 and conveying arrangement 116—onto the Christmas tree XT and then test the connection between the apparatus 110 and the Christmas tree XT.

The remotely operated vehicle ROV is then operated to open the production swab valve PSV and production master valve PMV of the Christmas tree XT.

The remotely operated vehicle ROV is then operated to reconfigure the apparatus 110 to extend the piston arrangement 134 and retrieve tool to be conveyed 112—in the illustrated embodiment tubing hanger plug—into the housing 114 of the apparatus 110. At this stage in the operation, the apparatus 110 forms the secondary safety barrier of the well installation W.

The remotely operated vehicle ROV is then operated to connect the umbilical U to the fluid intervention module 222.

With the tool to be conveyed 112 removed, fluid may be directed through the umbilical U, the fluid intervention module 222, fluid communication channels 224, 226 into the well installation W, as shown in FIG. 31.

Figure 32:
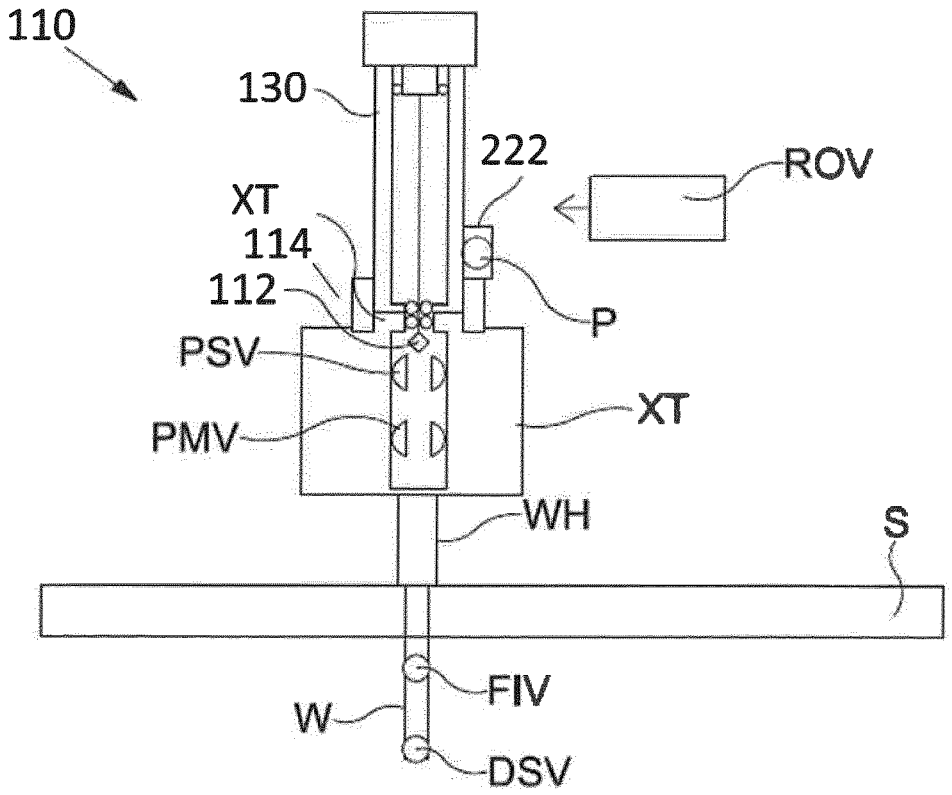
FIGS. 32 and 33 illustrate an alternative system and method for carrying out a fluid delivery operation in and/or on the well installation using the apparatus shown in FIGS. 8 to 14.
Figure 33:
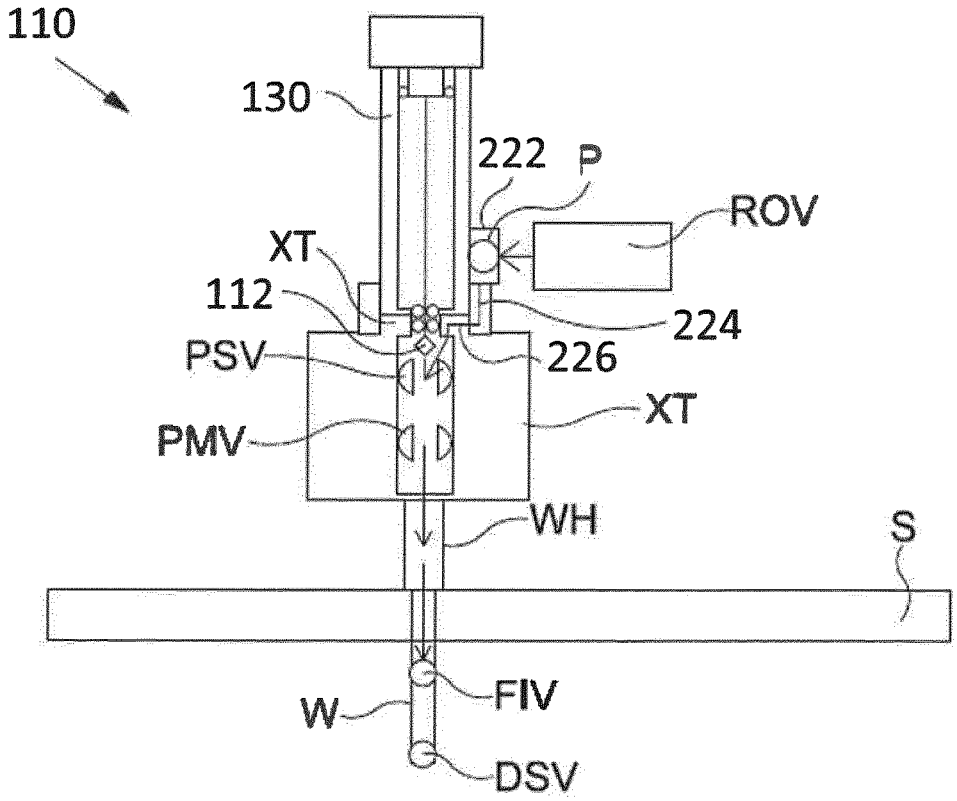

In FIGS. 32 and 33, the apparatus 110 is used to deliver fluid into the well installation W to facilitate communication with a downhole tool, such as a formation isolation valve FIV, for example by a pressure signal and more particularly but not exclusively by pressure pulses.

As shown in FIG. 32, the apparatus 110 comprises, is coupled to, or otherwise operatively associated with, fluid intervention module 222. A fluid communication channel 224 is provided in the apparatus 110. The Christmas tree XT is also provided with fluid communication channel 226 which communicates with the well installation W. The fluid communication channels 224, 226 are configured to communicate fluid from the fluid intervention module 222 into the well installation W.

In the illustrated embodiment, the pressure pulses are provided by pump P. However, in other embodiments other means for conveying pressure pulses may be used. For example, a fluid reservoir and/or pump P may be provided on the ROV, or fluid may be supplied via an umbilical, such as the umbilical U shown in FIGS. 30 and 31.

FIG. 32 shows well installation W having its surface termination at wellhead WH disposed on the seabed S. A valve assembly in the form of a Christmas tree XT (in the illustrated embodiment a Vertical Christmas tree) is located on the wellhead WH and is operable—via production swab valve PSV and production master valve PMV—to control access into and/or from the well installation W. The production swab valve PSV and production master valve PMV of the Christmas tree XT provide additional barriers to those provided by the primary downhole safety valve DSV. It will be recognised that other safety barrier configurations may be provided.

Once located on the Christmas tree XT, the remotely operated vehicle ROV is operated to lock the apparatus 113—including housing 114 and conveying arrangement 116—onto the Christmas tree XT and then test the connection between the apparatus 110 and the Christmas tree XT.

The remotely operated vehicle ROV is then operated to open the production swab valve PSV and production master valve PMV of the Christmas tree XT.

The remotely operated vehicle ROV is then operated to reconfigure the apparatus 110 to extend the piston arrangement 134 and retrieve the tool to be conveyed 112 into the housing 114 of the apparatus 110. At this stage in the operation, the apparatus 110 forms the secondary safety barrier of the well installation W.

With the tool to be conveyed 112 removed, fluid pressure pulses may be directed into the well installation W to communicate with and/or actuate the Formation Isolation Valve FIV.

Once the operation has been completed, the remotely operated vehicle ROV is operated to disconnect the apparatus 110 from the Christmas tree XT and the apparatus 110 is recovered to surface. Alternatively, the both the apparatus 110 and the Christmas tree XT may be recovered to surface, where required.

As described above, various modifications may be made to the apparatus, assemblies and systems described above without departing from the scope of the invention.

Figure 34:
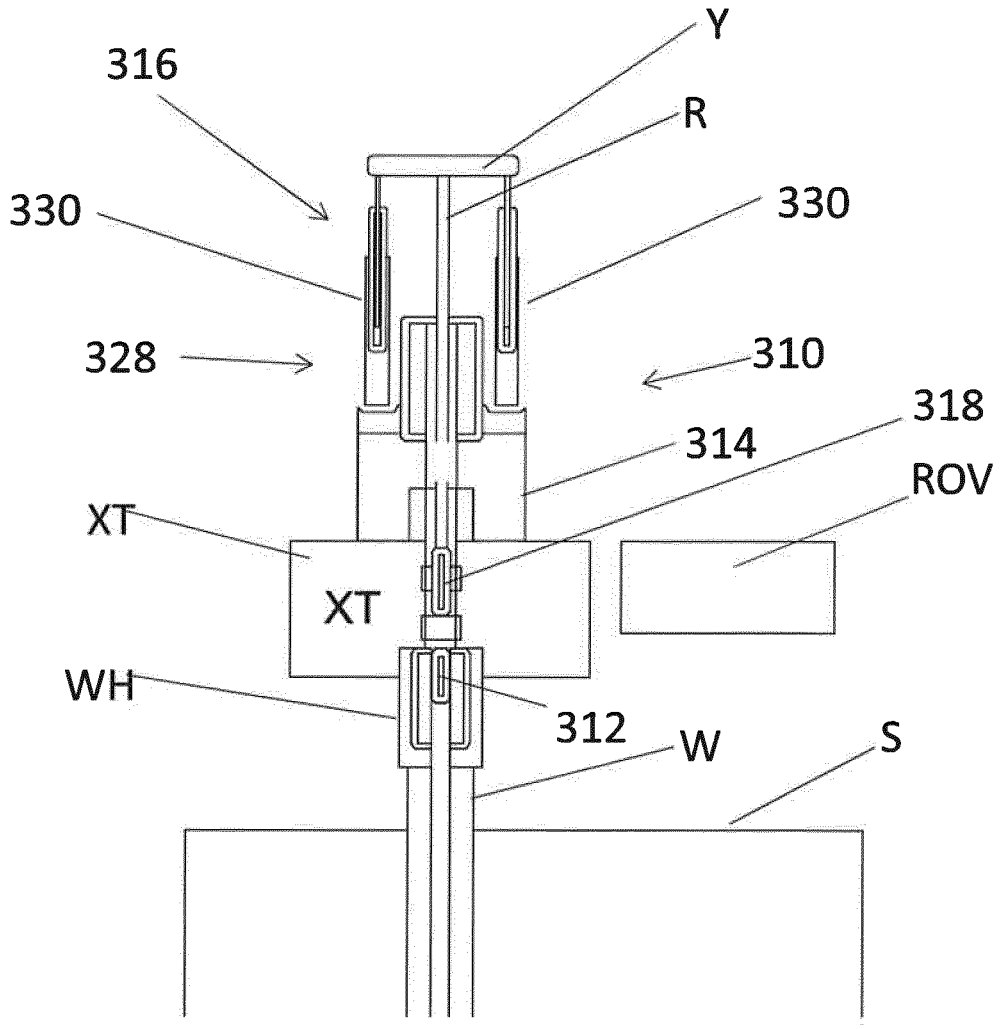
FIG. 34 shows a diagrammatic view of an apparatus for conveying a tool into and/or from a well installation, according to a third embodiment of the present invention.

FIG. 34 of the accompanying drawings shows an apparatus 310 for conveying a tool 312 into and/or from a well installation W, according to a third embodiment.

In the illustrated embodiment, the well installation W takes the form of a subsea well, the apparatus 310 configured for coupling to a subsea valve assembly in the form of Christmas tree XT disposed on the wellhead WH of the well installation W extending upwards from seabed S.

In use, the apparatus 310 is operable to convey the tool 312—in the illustrated embodiment a tubing hanger plug—into and/or from the wellhead WH through the Christmas tree XT. However, it will be understood that the apparatus 310 may be configured to convey any suitable tool 312 into and/or from the well installation W.

Figure 35:
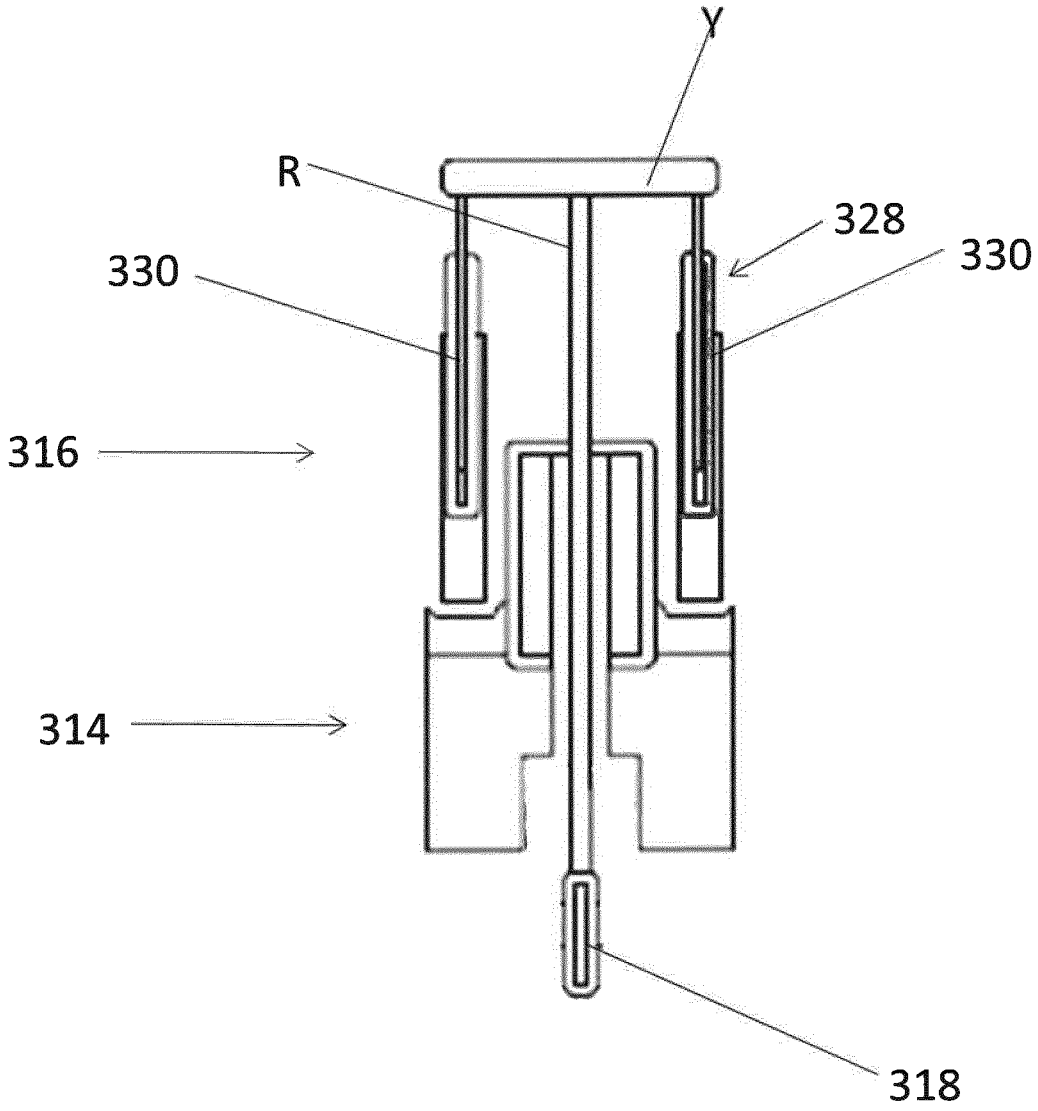
FIG. 35 shows a diagrammatic view of the conveying arrangement of the apparatus shown in FIG. 34, in a first configuration.
Figure 36:
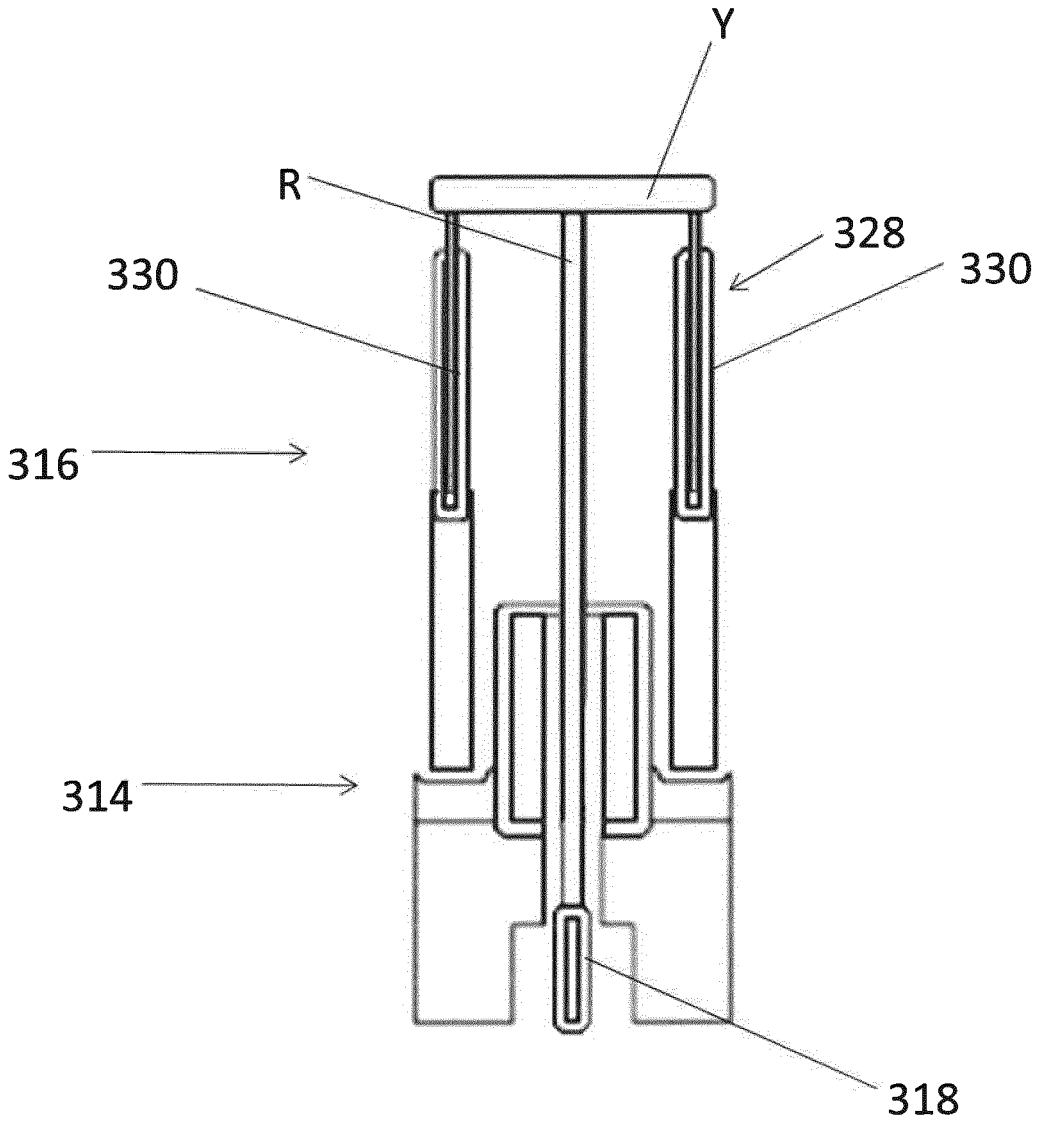
FIG. 36 shows a diagrammatic view of the conveying apparatus shown in FIG. 35 in a second configuration.
Figure 37:
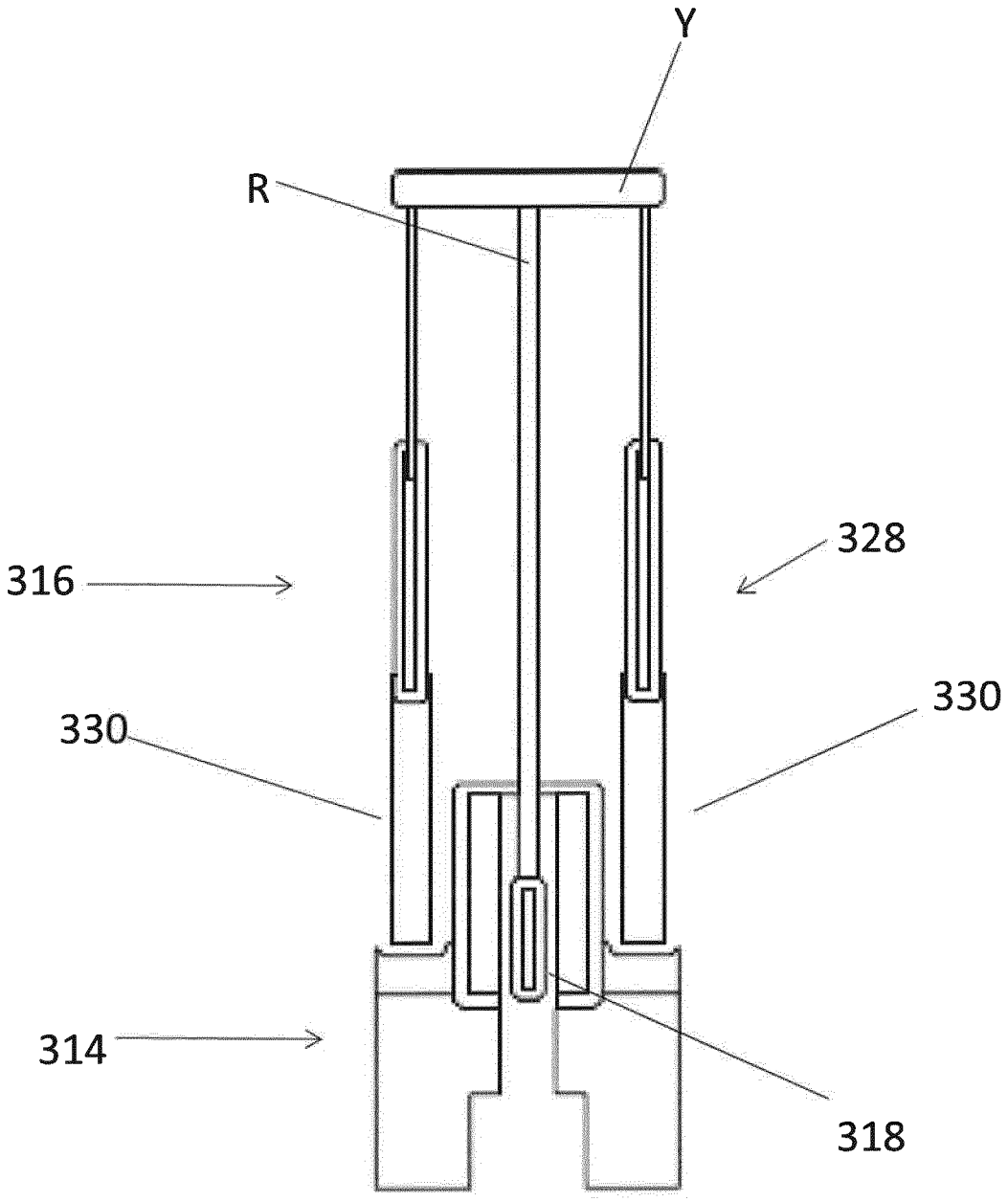
FIG. 37 shows a diagrammatic view of the conveying apparatus shown in FIG. 35 in a third configuration.

FIGS. 35, 36 and 37 of the accompanying drawings show the apparatus 310 of FIG. 34 in more detail.

As shown in FIG. 35, the apparatus 310 comprises a housing 314 for coupling the apparatus 310 to the well installation W and a conveying arrangement 316 for conveying the tool 312 into and/or from the well installation W. The housing 314 and the conveying arrangement 316 are configured to be coupled together.

The housing 314 is configured to house the tool to be conveyed 312 and associated tooling 318, such as a setting tool, a release tool and/or a retrieval tool.

The housing 314 is configured to form a pressure containing body of the apparatus 310 when connected to the Christmas tree XT.

As shown in FIGS. 34 to 37, the conveying arrangement 316 comprises an actuator arrangement—represented generally by 328. In the illustrated embodiment, the actuator arrangement 328 comprises two actuators 330. The conveying arrangement 316 further comprises a coupling arrangement which in the illustrated embodiment takes the form of a yoke Y and a rod R, the rod R extending through the housing 314.

As can be seen from the figures, the apparatus 310 differs from the apparatus 10 and the apparatus 110 in that the actuators 330 are oriented such that reconfiguration of the actuator arrangement 328 from the retracted configuration to the extended configuration acts to retrieve the tool to be conveyed 312 from the well installation W rather than deploy the tool to be conveyed 312.

Moreover, while in the illustrated embodiment the actuator arrangement 328 of the apparatus 310 comprises two actuators 330, it will be understood that the actuator arrangement 328 may alternatively comprise a single actuator 330 or more than two actuators 330 where required. For example, the actuator arrangement 328 may comprise a plurality of actuators 330 arranged around the housing 314.

In the illustrated embodiment, each of the actuators 330 of the apparatus 310 corresponds to the actuator 330 described above, albeit oriented in the opposite direction.

In use, and as will be described further below, the actuator arrangement 328 of the apparatus 310 is configurable between a retracted position relative to the housing 314 (as shown in FIG. 35) and an extended position relative to the housing 314 (as shown in FIG. 36). The piston arrangement 334 of the actuator arrangement 328 is itself extendable from a retracted configuration (as shown in FIGS. 35 and 36) to an extended configuration (as shown in FIG. 37).

The apparatus 310 may be utilised to perform a number of different workover operations, and FIGS. 38 to 56 illustrate one such operation in which the apparatus 310 is utilised to retrieve tool 312 from the wellhead WH of well installation W.

Figure 38:
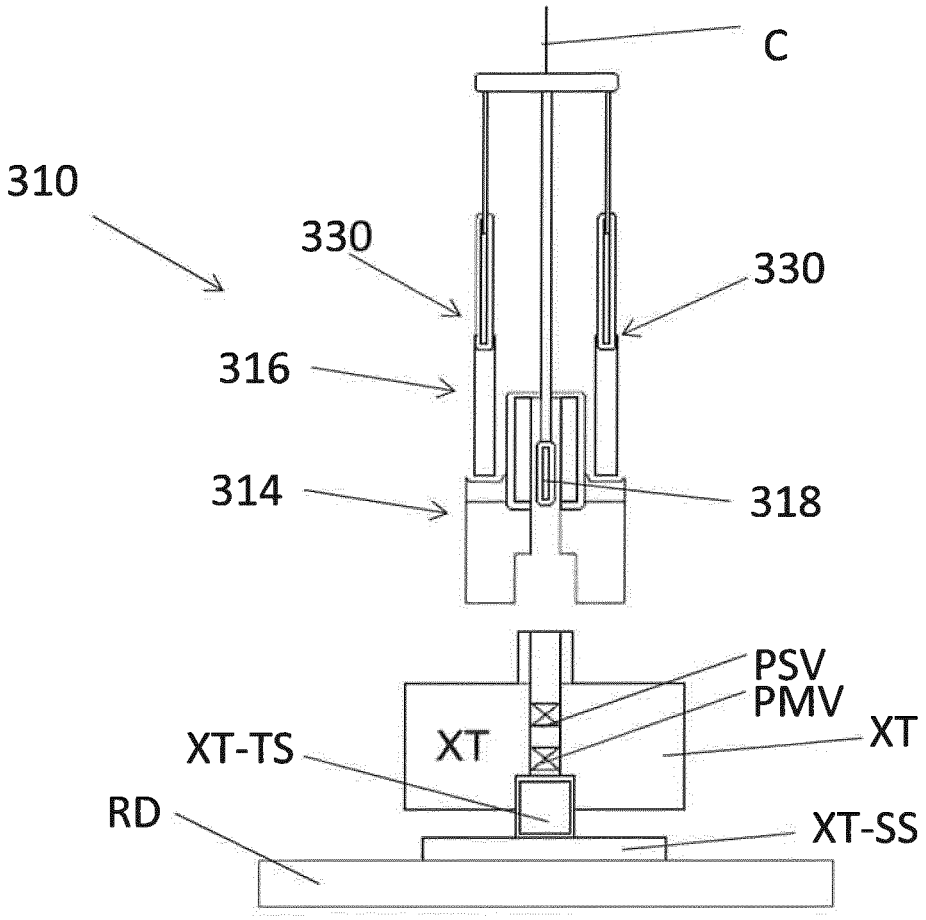
FIGS. 38 to 53 illustrate a system and method of conveying a tool into a wellhead using the apparatus shown in FIGS. 34 to 37.
Figure 39:
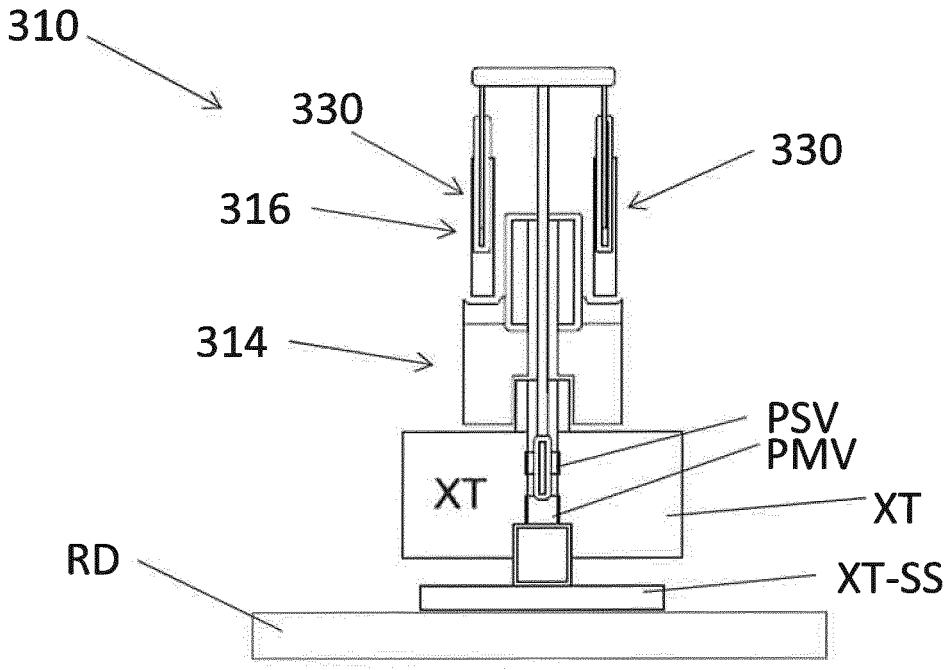
Figure 40:
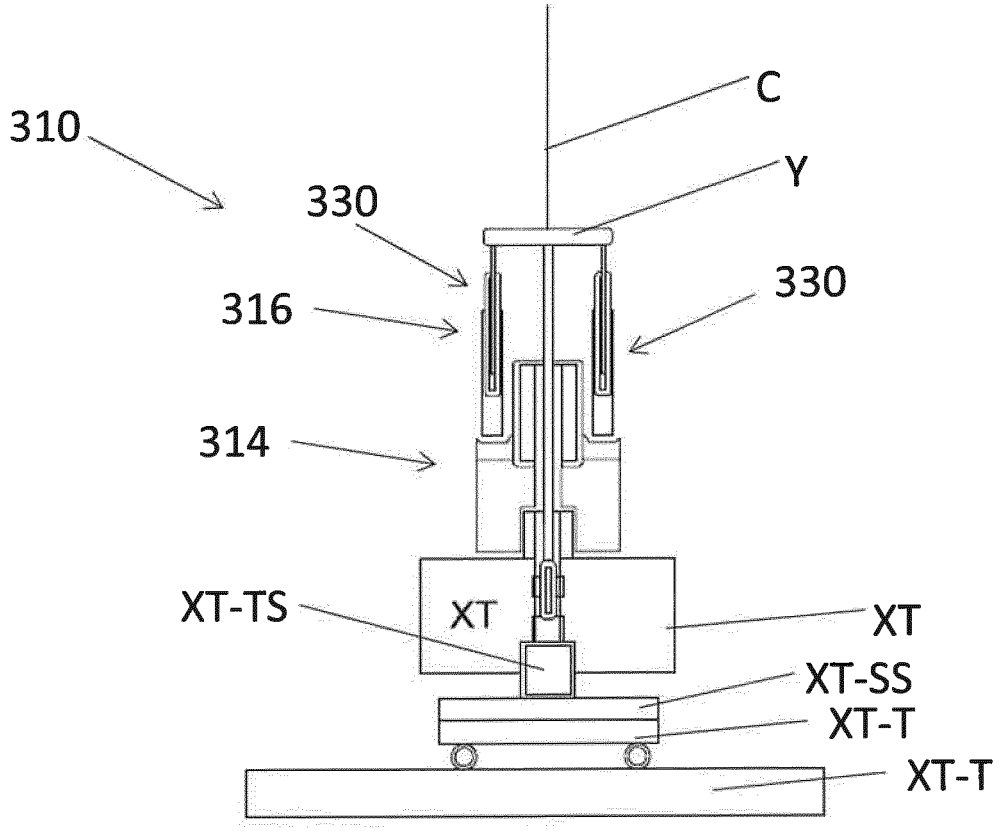
Figure 41:
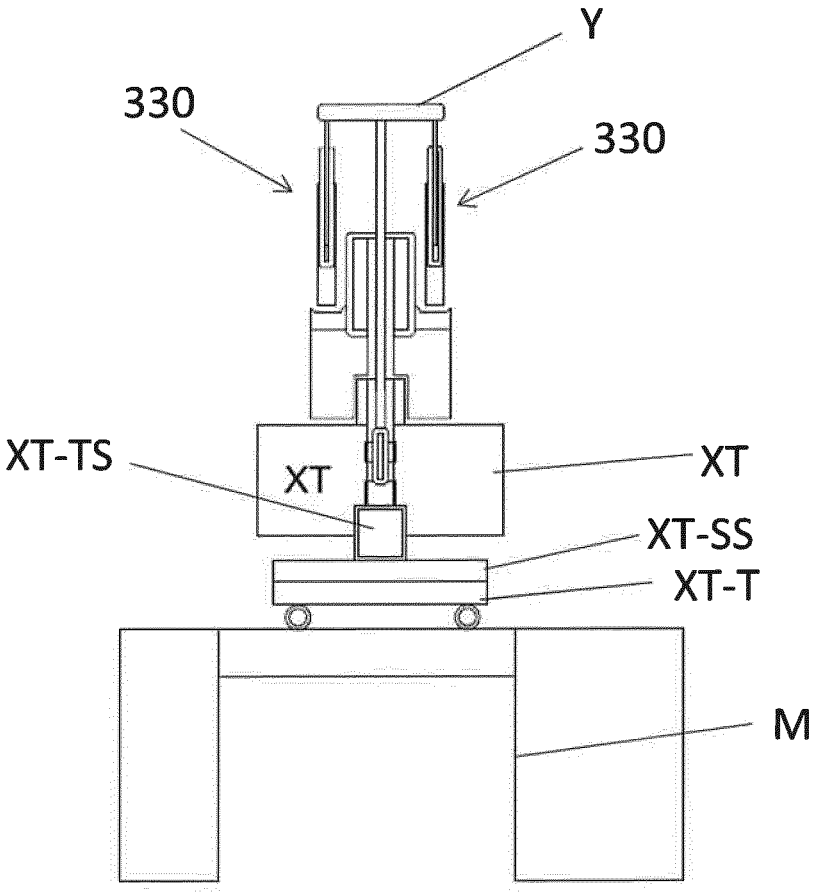
Figure 42:
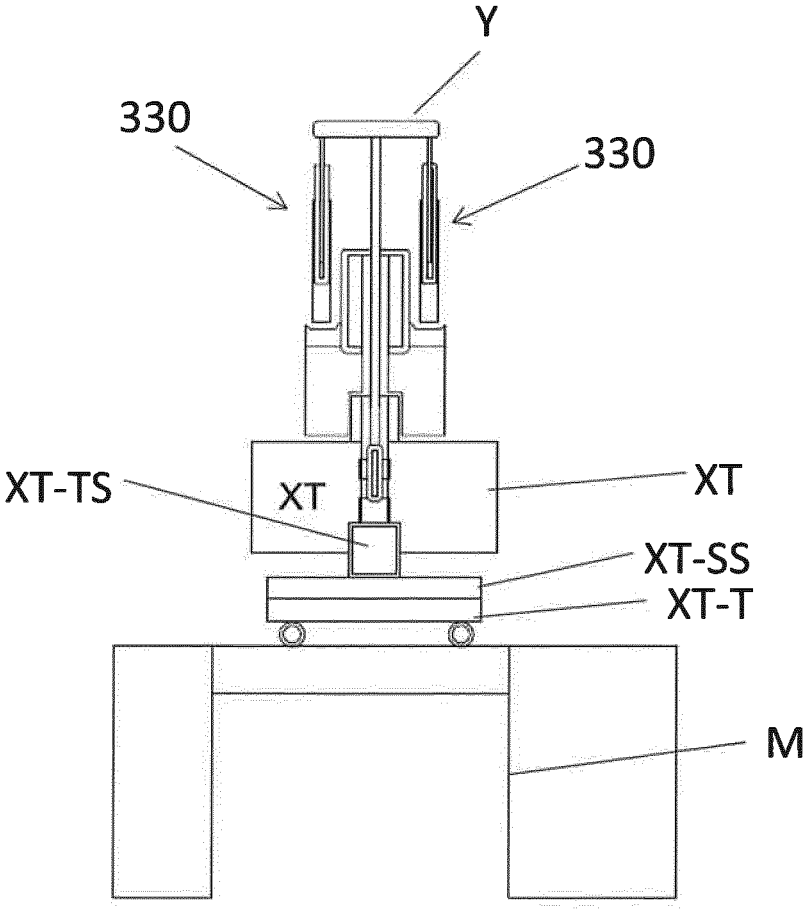
Figure 43:
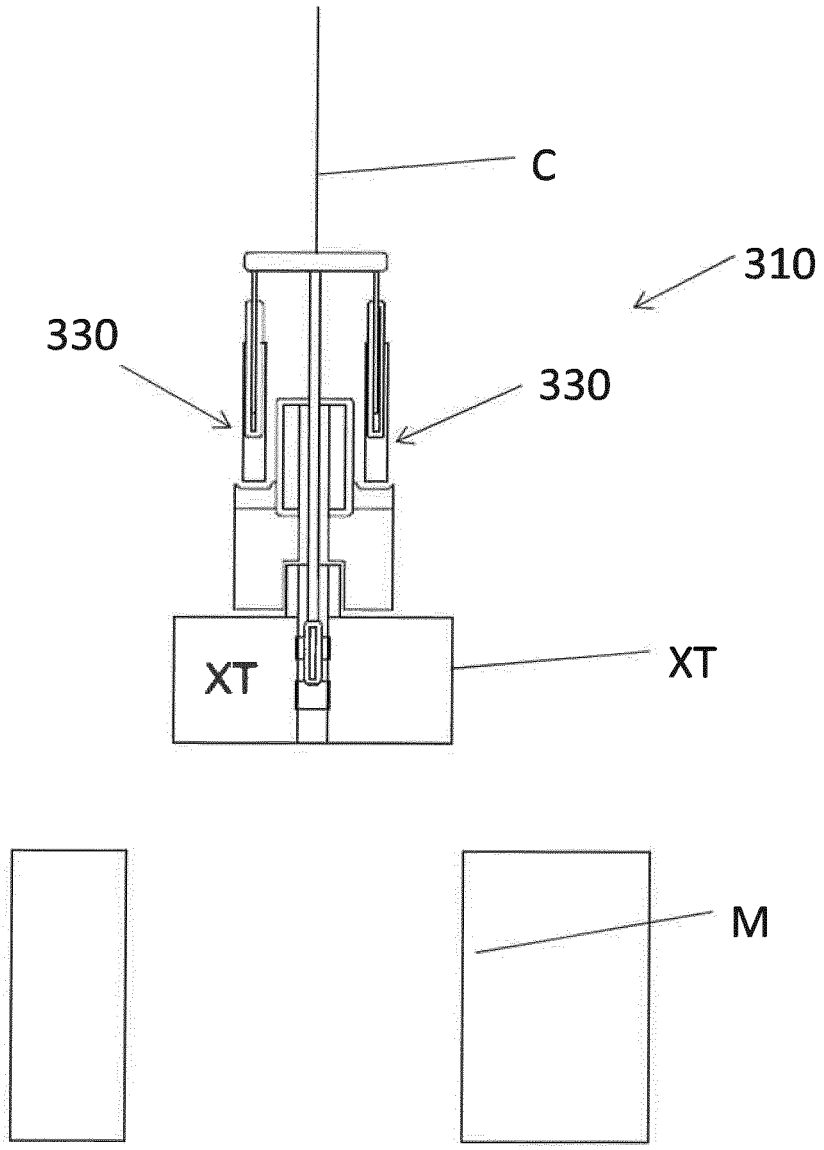

Referring initially to FIGS. 38 and 39, the apparatus 310 is initially configured with the conveying arrangement 316 in the further extended configuration (the configuration shown in FIG. 37), such that the tooling 318 is disposed within the housing 314.

Following pre-deployment checks, the apparatus 310 is lowered onto Christmas tree XT, which is disposed on Christmas tree test stump XT-TS and Christmas tree skid stack XT-SS on the rear deck RD of the intervention vessel V, as shown in FIG. 39. In the illustrated embodiment, the Christmas tree XT takes the form of a vertical Christmas tree. The apparatus 310 is then locked onto the Christmas tree XT via connector 320 to form tool assembly 1000. The wire C is then removed. The integrity of the connection between the apparatus 310 and the Christmas tree XT is tested. Prior to deployment, the actuators 330 of the apparatus 310 are reconfigured from their further extended configuration (the configuration shown in FIG. 37) to their retracted configuration (the configuration shown in FIG. 35).

Referring now also to FIGS. 40 to 43 of the accompanying drawings, the wire C is attached to the apparatus 310 and the assembly 310, Christmas tree XT, test stump XT-TS and Christmas tree skid stack XT-SS are lifted onto a Christmas tree trolley XT-T disposed on the rear deck RD of the intervention vessel V. The wire C is then removed. The apparatus 310, Christmas tree XT, test stump XT-TS and Christmas tree skid stack XT-SS are then transferred to the moonpool area M of the intervention vessel V using the trolley XT-T. The wire C is attached and the apparatus 310 and Christmas tree XT are lifted clear of the Christmas tree skid XT-S which remains on the Christmas tree trolley XT-T. The Christmas tree trolley XT-T is removed and the moonpool M opened.

Figure 44:
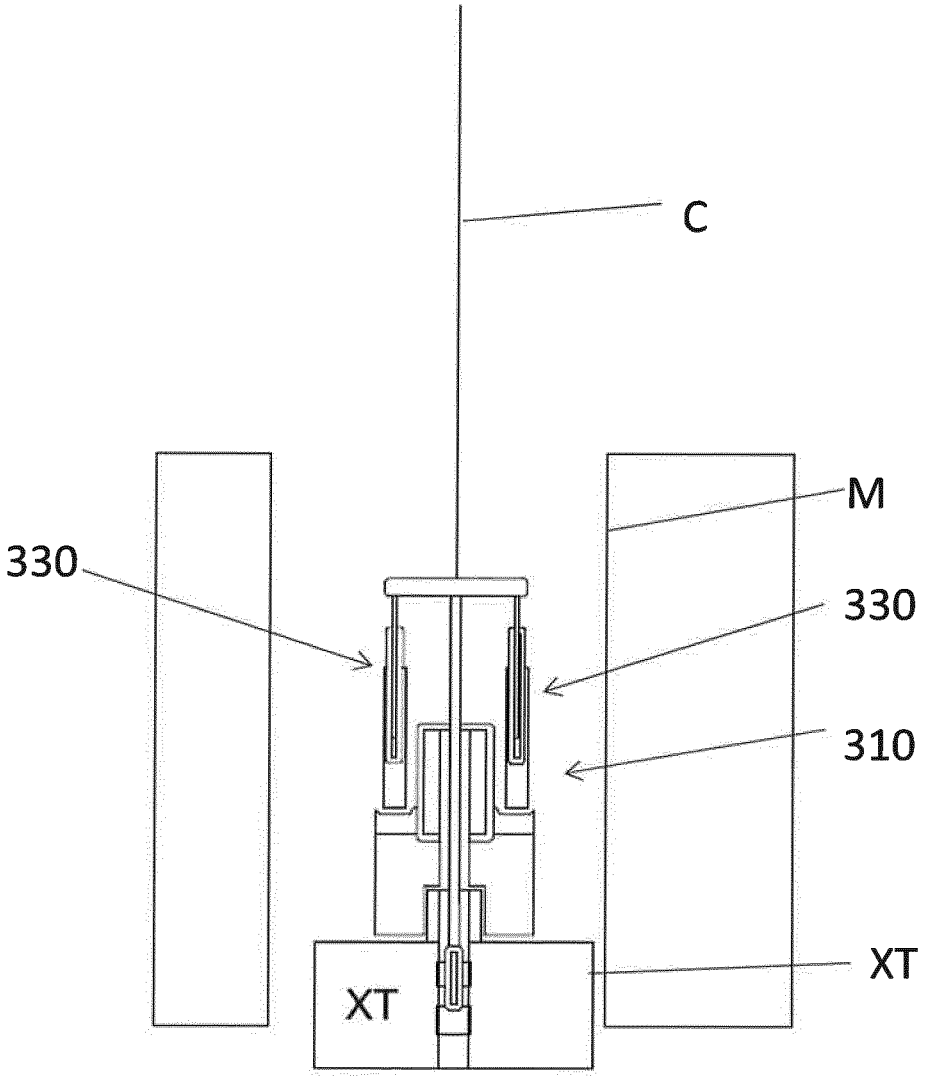
Figure 45:
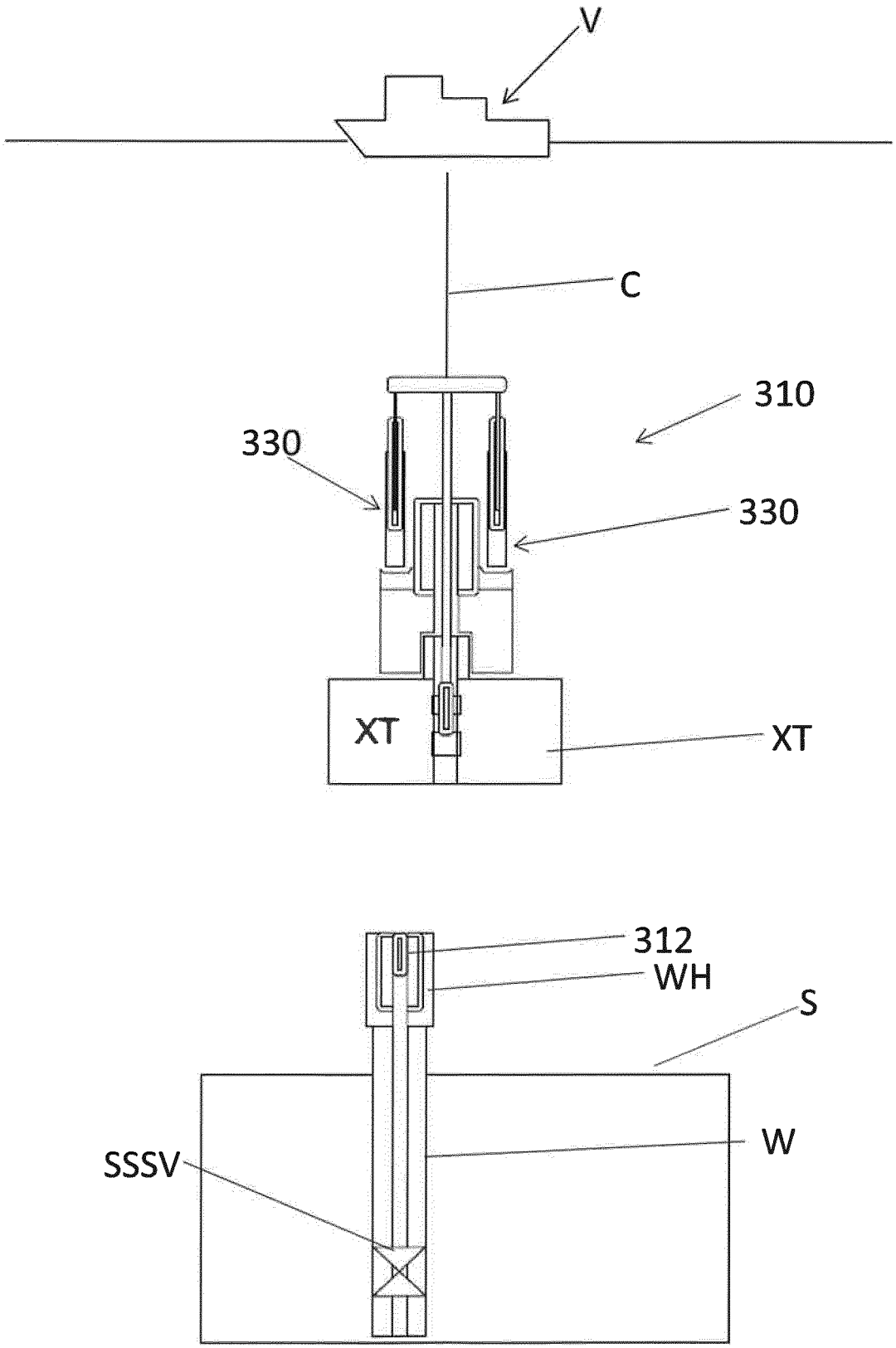
Figure 46:
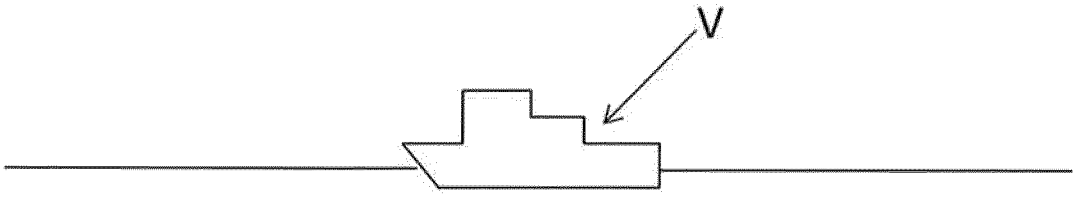
Figure 46:
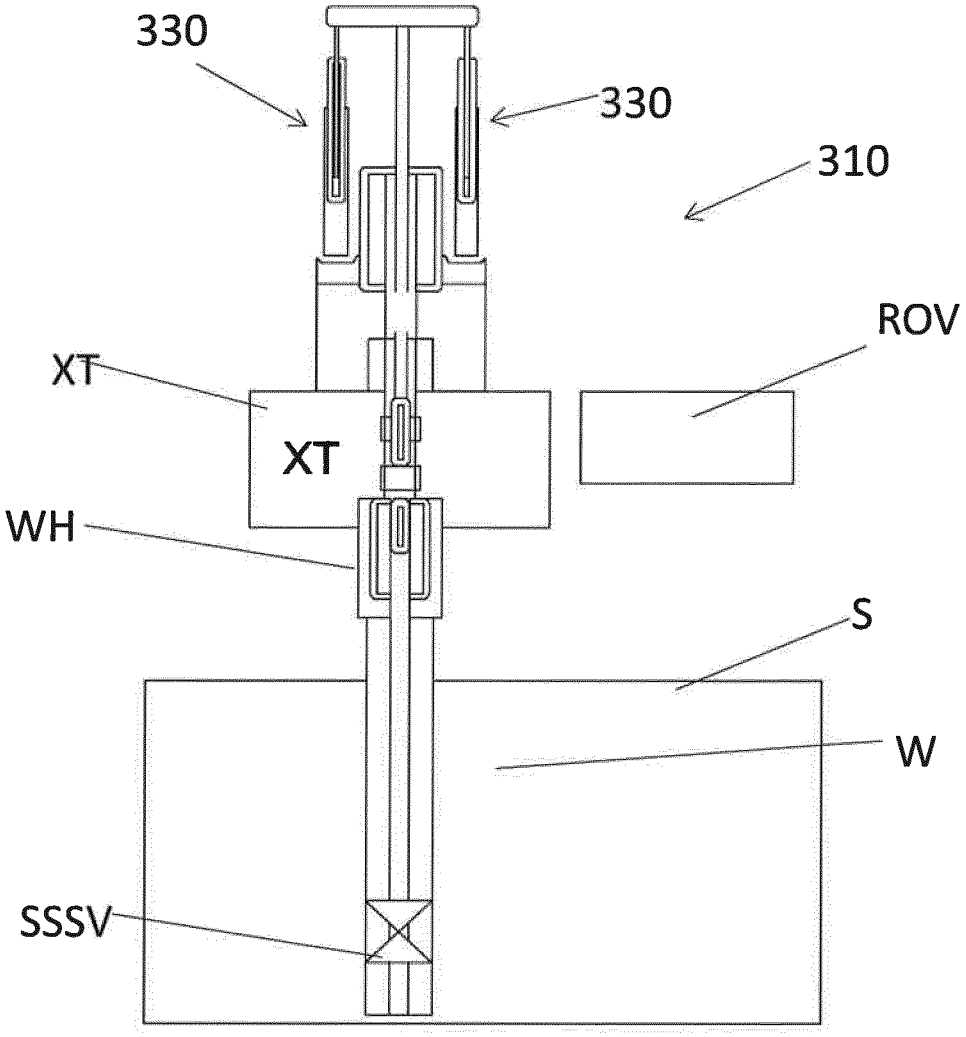
Figure 47:
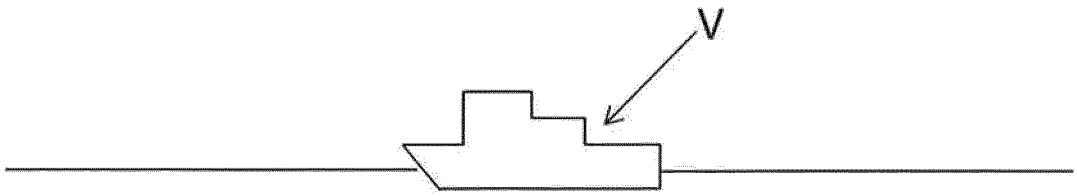
Figure 47:
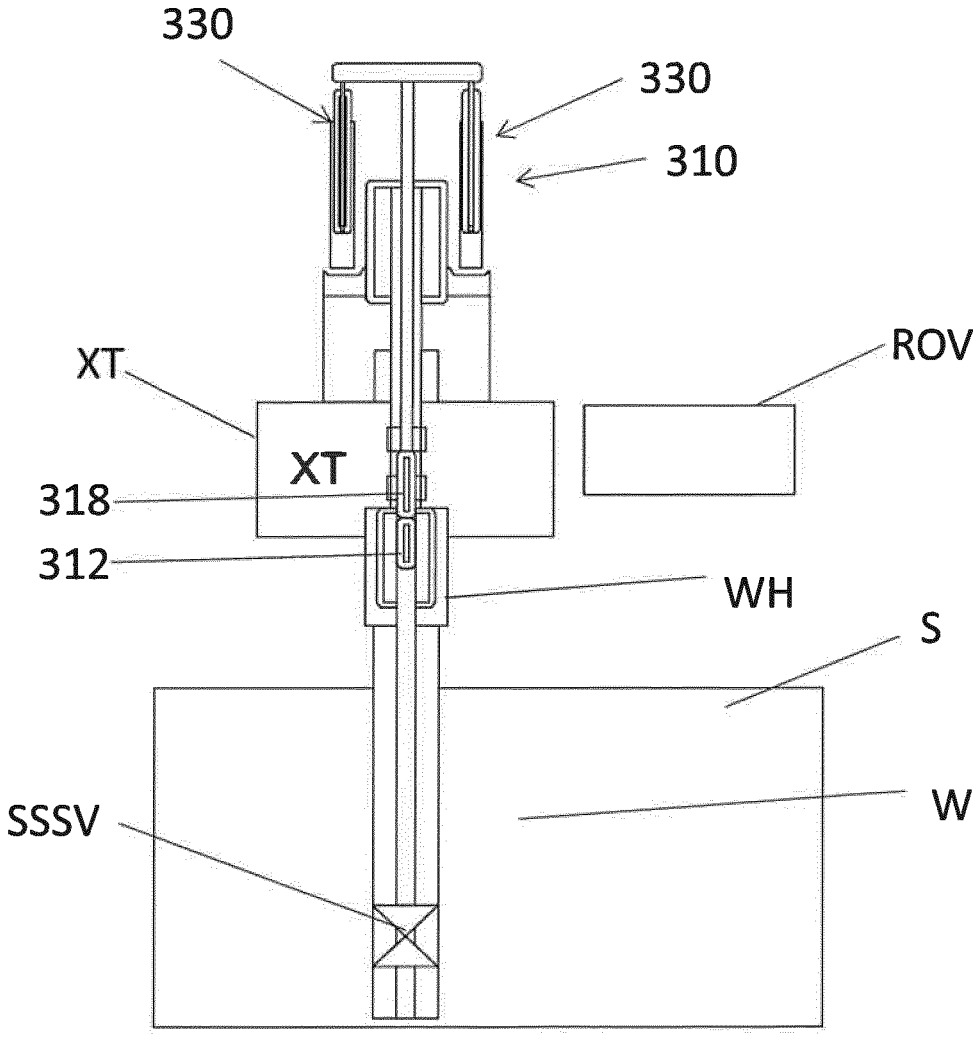

FIGS. 44, 45 and 46 show the running operation, whereby the tool assembly 1000—including the apparatus 310 and the Christmas tree XT—is deployed to the subsea location using the wire C. The assembly 1000 is then manipulated into place on the wellhead WH by the remotely operated vehicle ROV. Once the tool assembly 1000 and Christmas tree XT have landed on the wellhead WH, the remotely operated vehicle ROV locks the Christmas tree XT to the wellhead WH via Christmas tree connector (not shown) and the remotely operated vehicle ROV is operated to validate the connection between the Christmas tree XT and the wellhead WH. The wire C is then removed.

Figure 48:
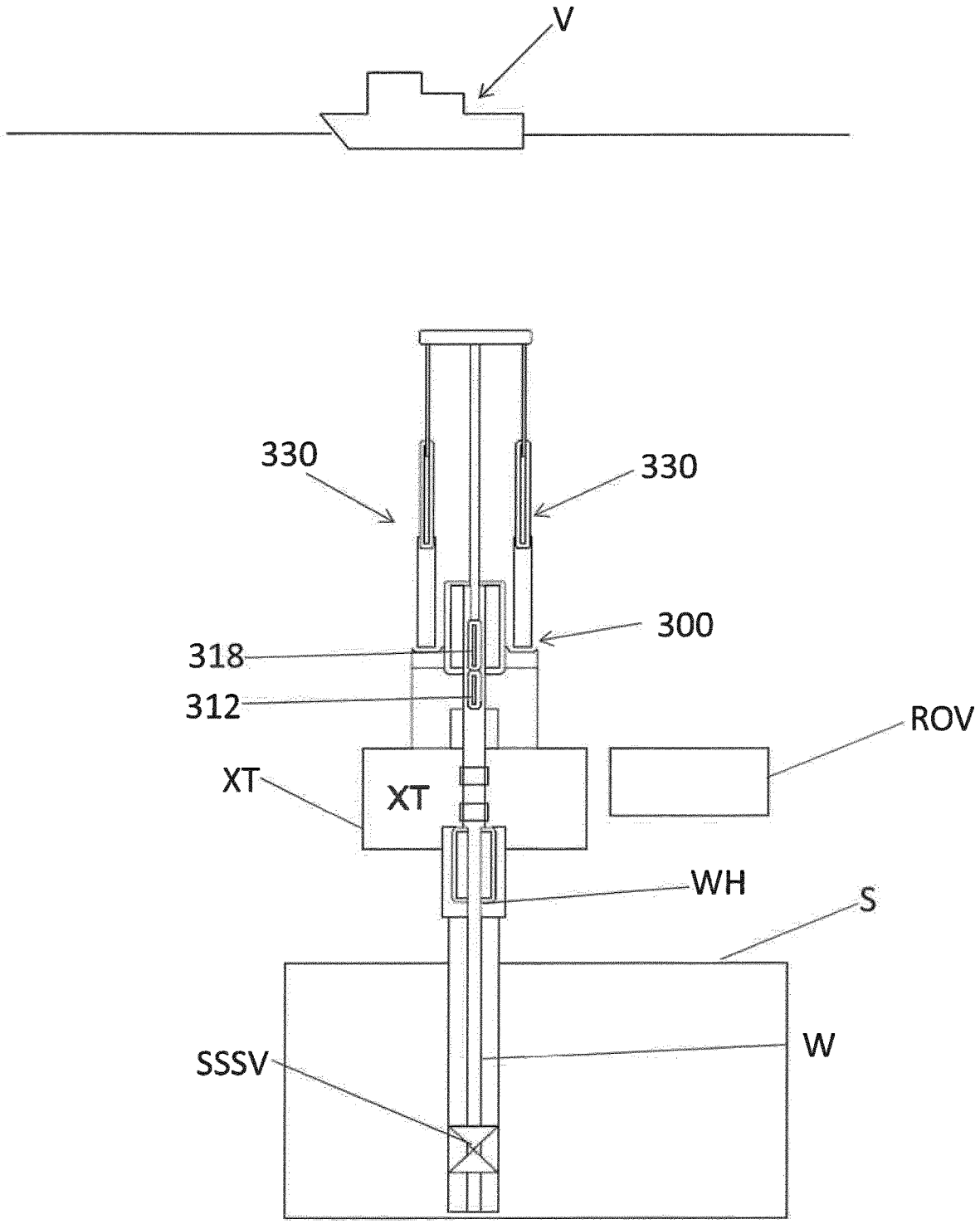
Figure 49:
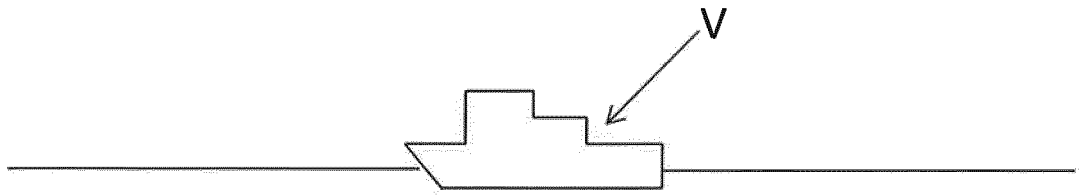
Figure 49:
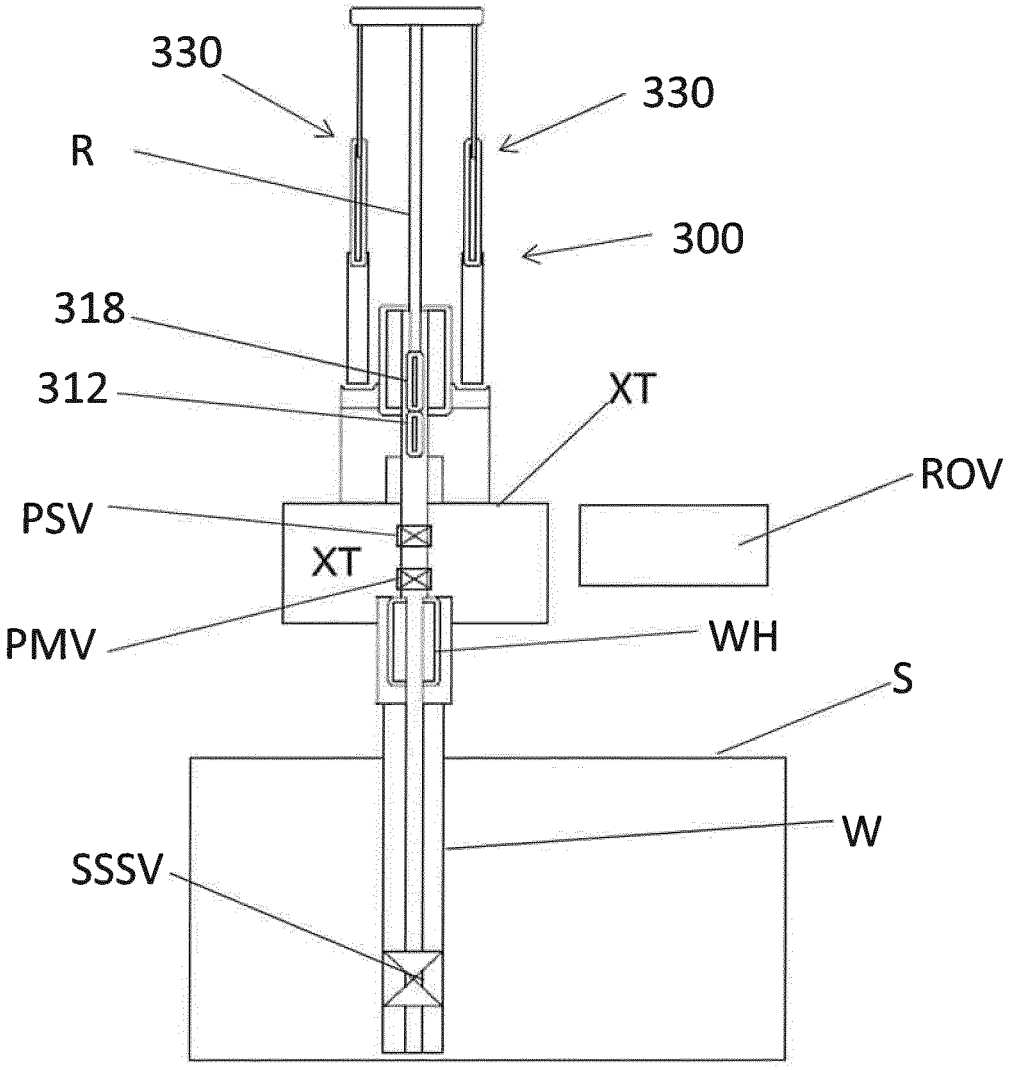
Figure 50:
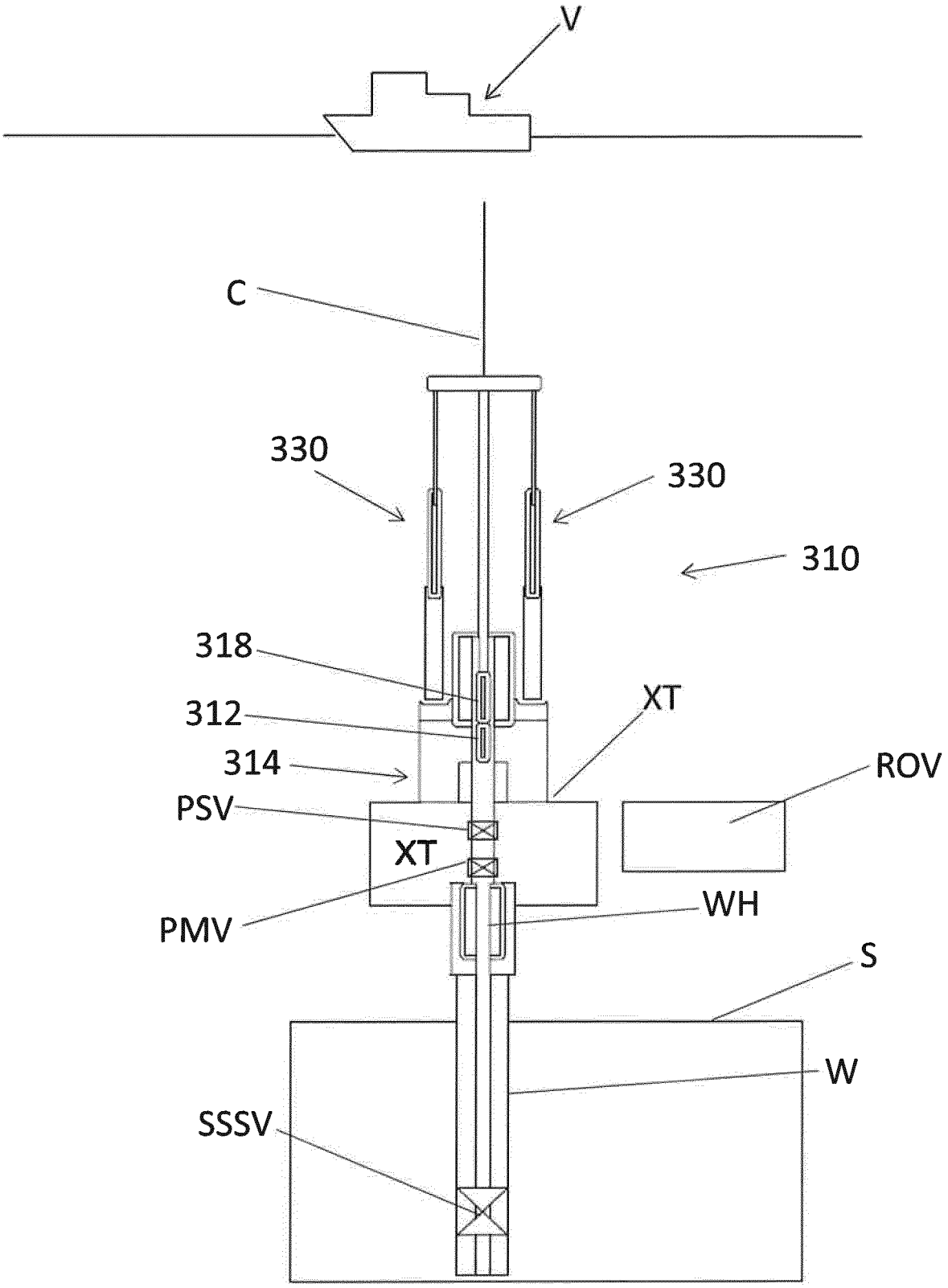

As shown in FIGS. 48, 49 and 50, in order to convey the tooling 318 from the wellhead WH, the remotely operated vehicle ROV is operated to reconfigure the conveying arrangement 316 from the extended configuration (the configuration shown in FIG. 36) to the retracted configuration (as shown in FIG. 35)—which by virtue of the connection between the apparatus 310 and tooling 318 provided by yoke Y and rod R lowers tooling 318 into the wellhead WH, where it engages the tool to be conveyed 312. The remotely operated vehicle ROV is then operated to reconfigure the actuator 330 to the further extended configuration (as shown in FIG. 37) and retrieve the tool 312 into the housing 314. In this configuration, dual safety barriers are maintained, with subsurface safety valve SSSV providing a primary safety barrier and the tool assembly 1000 providing a secondary safety barrier. Once the tool 312 has been retrieved from the wellhead WH, the remotely operated vehicle ROV is then operated to close the swab valve PSV and master valve PMV. As shown, movement of the rod R pulls the tooling 318 and tool to be conveyed plug 312 clear of the Christmas tree XT.

Figure 51:
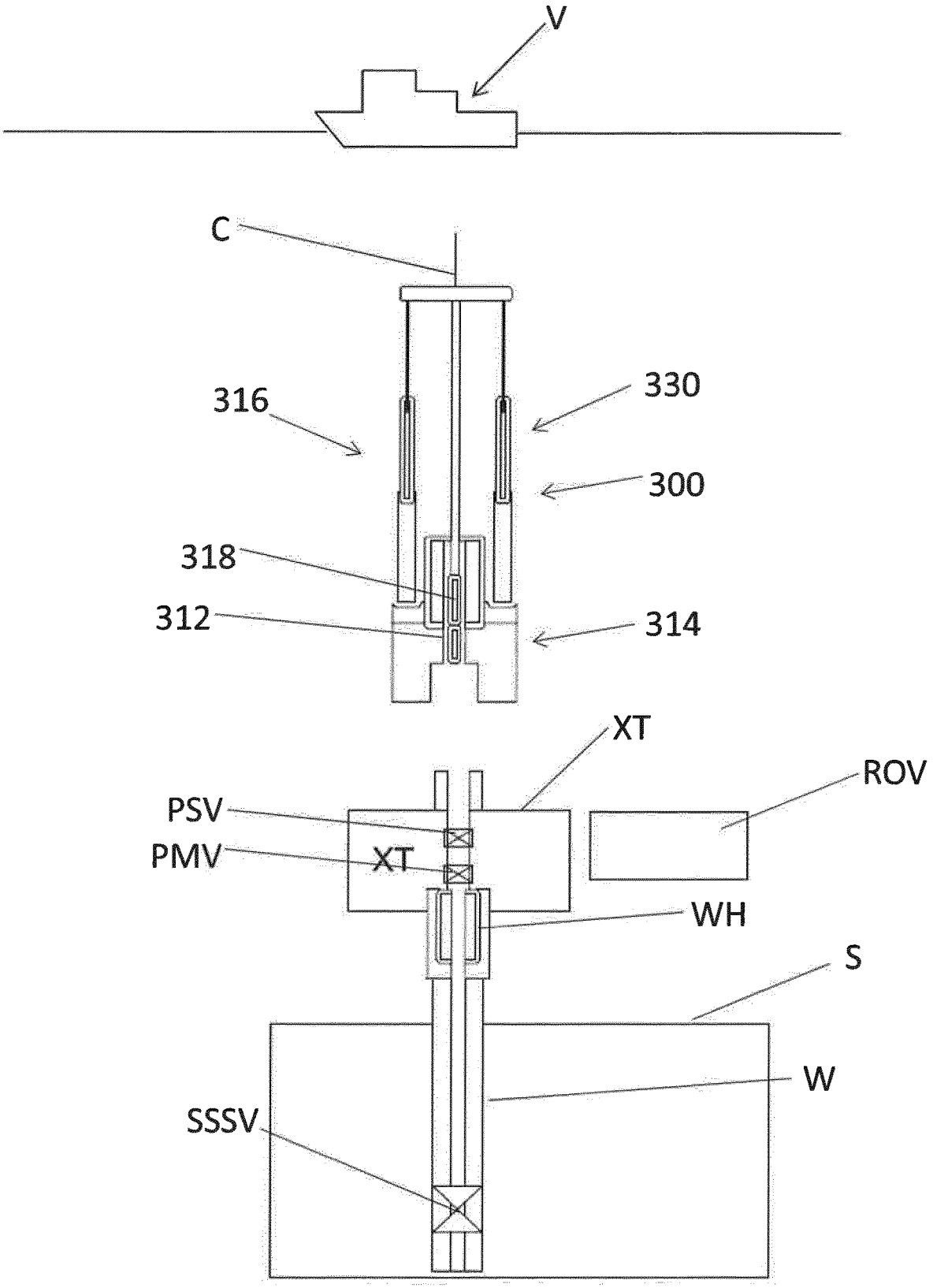
Figure 52:
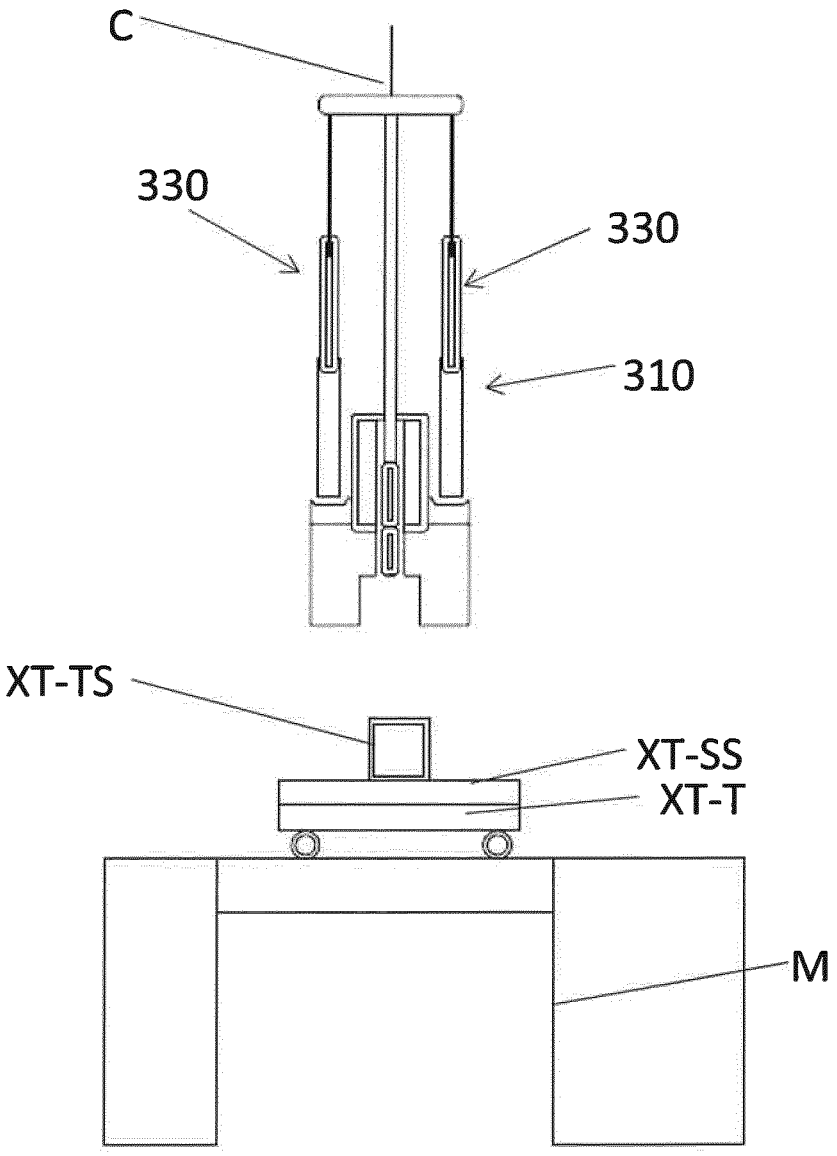
Figure 53:
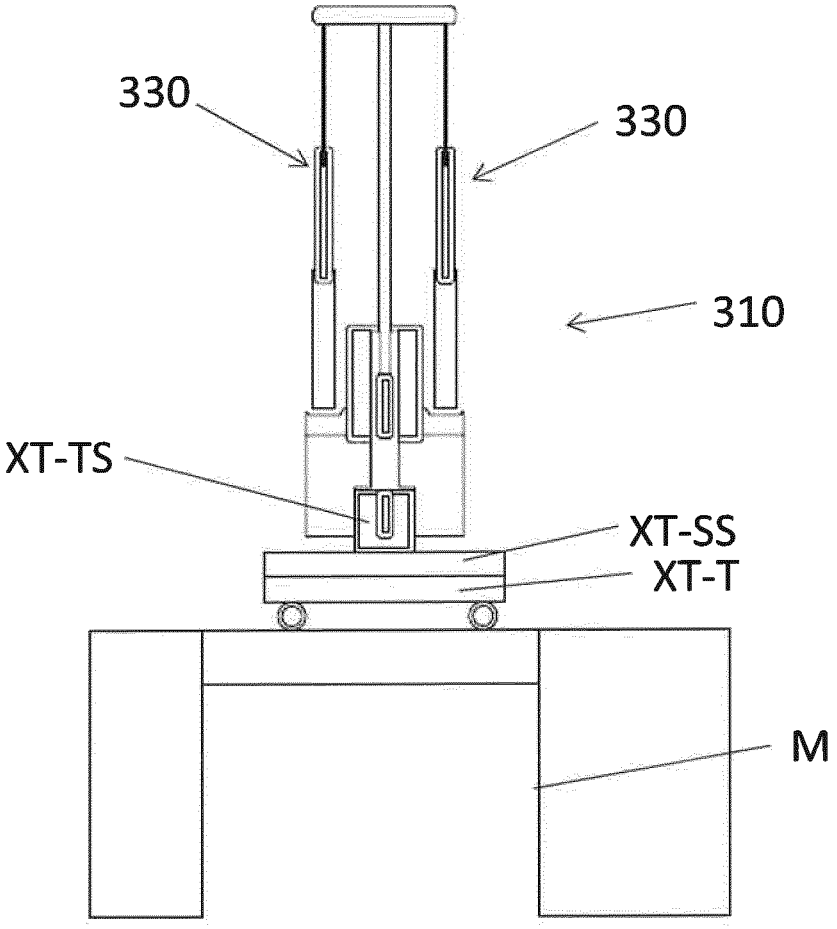

As shown in FIGS. 51, 52 and 53, the remotely operated vehicle ROV is then operated to unlock the assembly 1000, the tool assembly 1000 then being recovered to the intervention vessel V through the moonpool M, which is then closed. The Christmas tree trolley XT-T and Christmas tree skid XT-S are positioned below the tool assembly 1000 and the tool assembly 1000 is landed onto the Christmas tree skid XT-S. The conveying arrangement is then reconfigured to the extended configuration to engage the tool 312 on the Christmas tree skid XT-S, the tooling 318 functioned to release the tool 312. The actuators 330 are then reconfigured to the fully retracted configuration ready to complete another operation.

As described above, various modifications may be made to the apparatus, assemblies and systems described above without departing from the scope of the invention.

For example, it will be recognised that while illustrated embodiments describe the conveyance of a tubing hanger plug, the apparatus may be used with a variety of tools to be conveyed.

As described above, the apparatus, system and methods described provide a number of benefits. Embodiments of the present invention, amongst other things, provide a compact apparatus which has reduced transport volume compared to conventional systems while retaining functionality. In the case of a subsea well installation, an apparatus according to embodiments of the present invention may be transported on, deployed from and/or retrieved to a lower category vessel compared to those highly specialised vessels required by conventional systems, such as a Completion Workover Riser (CWOR) system or a Light Well Intervention System (LWIS). By way of example, a lower category vessel is generally smaller than a conventional subsea construction vessel, dedicated well intervention vessel and/or drilling rig and may be outfitted with less equipment, for example a subsea crane and a remotely operated vehicle (ROV), and/or less complex equipment than required by conventional systems. The capability to transport, deploy and/or retrieve the apparatus with a lower category vessel in turn results in reduced equipment and personnel requirements, resulting in a significant cost benefit to the operator. Moreover, the ability to perform operations via a lower category vessel means that there is more capacity to carry out operations when required or desired, since such lower category vessels have higher availability compared to the highly specialised vessels and personnel required with conventional systems.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Aspects from the various embodiments described, as well as other known equivalents for each such aspects, can be mixed and matched by one of ordinary skill in the art to construct additional embodiments and techniques in accordance with principles of this application.

The invention claimed is:

1. An apparatus suitable for location on a wellhead of a well installation and for conveying a tool into and/or from the well installation, the apparatus comprising:

a conveying arrangement couplable to the tool to be conveyed and configured to mount to a housing configured to receive the tool to be conveyed into and/or from the well installation;

the conveying arrangement comprising an actuator arrangement configurable between a retracted configuration, an extended configuration and a further extended configuration to move the tool into and/from the housing and convey the tool into and/or from the well installation; and the actuator arrangement comprising one or more actuators, each actuator comprising a housing and a piston arrangement comprising a first piston member and a second piston member carried by the first piston member, the first piston member defining a first chamber and a second chamber in the housing such that fluid in, or supplied to, the first chamber urges the first piston member towards an extended position relative to the housing, wherein the first piston member comprises a channel for directing fluid in, or supplied to, the first chamber to the second piston member such that fluid in, or supplied to, the first chamber urges the second piston member towards the extended position relative to the first piston member.

2. The apparatus of claim 1, wherein the apparatus is configured to convey the tool to be conveyed a distance greater than the minimum overall height of the actuator arrangement.

3. The apparatus of claim 2, wherein the first member and the second member of each piston arrangement are telescopically arranged.

4. The apparatus of claim 1, wherein the conveying arrangement comprises a coupling arrangement to couple the conveying arrangement to the tool to be conveyed.

5. The apparatus of claim 4, wherein the coupling member comprises any one of or all of the following components: a yoke, a rod, a tie, and a tube.

6. The apparatus of claim 1, further comprising a communication arrangement.

7. The apparatus of claim 6, wherein the communication arrangement comprises a fluid communication arrangement.

8. The apparatus of claim 6, wherein the communication arrangement comprises a control line arrangement.

9. The apparatus of claim 8, wherein the control line arrangement comprises one or more control lines, each control line comprising a first portion and a second portion telescopically arranged relative to each other.

10. The apparatus of claim 1, wherein the apparatus comprises, is coupled to, or is operatively associated with a fluid delivery arrangement for delivering fluid into the well installation.

11. The apparatus of claim 10, wherein the fluid delivery arrangement comprises a fluid communication passage formed in, or disposed in, the apparatus.

12. A tool assembly comprising:

the apparatus of claim 1; and a valve assembly, wherein the valve assembly comprises a subsea tree.

13. A method of conveying a tool into and/or from a well installation using the apparatus of claim 1.

14. The method of claim 13, comprising at least one of:

conveying the tool into the well installation by reconfiguring the actuator arrangement of the apparatus from the retracted configuration to the extended configuration;

conveying the tool into the well installation by reconfiguring the actuator arrangement of the apparatus from the extended configuration to a further extended configuration;

conveying the tool from the well installation by reconfiguring the actuator arrangement of the apparatus from the extended configuration to the retracted configuration; and conveying the tool from the well installation by reconfiguring the actuator arrangement of the apparatus from a further extended configuration to the extended configuration.

15. The method of claim 13, comprising at least one of:

conveying the tool into the well installation by reconfiguring the actuator arrangement of the apparatus from the extended configuration to the retracted configuration;

conveying the tool into the well installation by reconfiguring the actuator arrangement of the apparatus from a further extended configuration to the extended configuration;

conveying the tool from the well installation by reconfiguring the actuator arrangement of the apparatus from the retracted configuration to the extended configuration; and conveying the tool from the well installation by reconfiguring the actuator arrangement of the apparatus from the extended configuration to the further extended configuration.

16. The method of claim 13, further comprising conveying a valve assembly using the apparatus.

17. The method of claim 13, further comprising applying a force to the tool to be conveyed or part of the tool to be conveyed, the force comprising one or both of:

a mechanical force, movement of the conveying arrangement applying the mechanical force to the tool to be conveyed or part of the tool to be conveyed; and a pressure force.

18. The method of claim 13, further comprising performing a fluid delivery operation in and/or on a well installation using the apparatus.

* * * * *